United States Patent [19]

Carson

[11] Patent Number: 4,649,264

[45] Date of Patent: Mar. 10, 1987

[54] ELECTRONIC VOTING MACHINE

[75] Inventor: William H. Carson, Indianapolis, Ind.

[73] Assignee: Carson Manufacturing Company, Inc., Indianapolis, Ind.

[21] Appl. No.: 794,071

[22] Filed: Nov. 1, 1985

[51] Int. Cl.[4] ..... G07C 13/00

[52] U.S. Cl. ..... 235/54 F; 235/50 B

[58] Field of Search ..... 235/50 R–50 B, 235/51, 54 E, 54 F

[56] References Cited

U.S. PATENT DOCUMENTS

| | | | |
|---|---|---|---|
| 3,186,638 | 6/1965 | Detering et al. | 235/51 |
| 3,468,477 | 9/1969 | Gray, Jr. | 235/50 |
| 3,710,105 | 1/1973 | Oxendine, Jr. et al. | 235/54 F |
| 3,722,793 | 3/1973 | Aronoff | 235/50 A |
| 3,739,151 | 6/1973 | Moldovan, Jr. et al. | 235/54 F |
| 3,779,453 | 12/1973 | Kirby et al. | 235/54 F |
| 3,793,505 | 2/1974 | McKay et al. | 235/54 F |
| 3,847,345 | 11/1974 | Moldovan, Jr. et al. | 235/54 F |
| 3,941,976 | 3/1976 | Huhn | 235/545 |
| 3,947,669 | 3/1976 | Simmons et al. | 235/156 |
| 3,963,899 | 6/1976 | MacDuff | 235/50 B |
| 4,010,353 | 3/1977 | Moldovan, Jr. et al. | 235/54 F |
| 4,015,106 | 3/1977 | DePhillipo | 235/54 F |
| 4,021,780 | 5/1977 | Narey et al. | 340/172.5 |
| 4,025,757 | 5/1977 | McKay et al. | 235/54 F |
| 4,066,871 | 1/1978 | Cason, Sr. et al. | 235/54 F |
| 4,178,501 | 12/1979 | Luther | 235/54 F |
| 4,227,643 | 10/1980 | Luther | 235/54 F |
| 4,362,925 | 12/1982 | Paloian et al. | 235/51 |
| 4,445,731 | 5/1984 | Ahmann | 235/50 B X |

*Primary Examiner*—Benjamin R. Fuller

*Attorney, Agent, or Firm*—Pearne, Gordon, McCoy & Granger

[57] ABSTRACT

A portable, self-contained, programmable electronic voting machine includes a motor-driven scroll mechanism carrying a plurality of printed ballot sheets, the scroll mechanism presenting to a voter, in a controlled manner, only a preselected portion of the ballot sheets at any one time. Each selected portion of the ballot sheets is viewed by a voter through a window panel along opposite vertical edges of which extend single columns of push-button switches positioned next to voter selections on the portion of the ballot sheets then being viewed. A voter depresses appropriate push-button switches to make vote selections. The voting selection process is repeated as the voter, by actuating the scroll mechanism, selects other portions of the ballot sheets. A voter then casts his vote using a separate vote casting switch. A remote judge's control determines whether all portions of the ballot sheets can be presented to a voter, or only selected portions depending, for example, on the voting party declared by the voter. A motor-driven shutter mechanism allows access to a motor-indexed paper tape upon which a voter can "write-in" a vote when appropriate. An audit printer provides hard copy back-up for electronically stored vote tally information.

44 Claims, 35 Drawing Figures

ELECTRONIC VOTING MACHINE

BACKGROUND OF THE INVENTION

The present invention relates in general to voting machines, and more particularly to programmable electronic voting machines of the microprocessor-based type.

To date, only mechanical voting machines, such as the types illustrated in U.S. Pat. Nos. 2,054,102 and 3,054,557, have met with wide commercial success. Such mechanical machines are highly reliable in terms of accurately recording and totalizing valid voter selections. However, these mechanical machines are inherently complex and include large numbers of moving parts requiring frequent maintenance. Also, the prior art mechanical voting machines are large and cumbersome thus requiring great amounts of manpower for delivering the machines to polling locations, setting up the machines, and then returning them to storage subsequent to an election. Further, a trend towards larger numbers of election candidates and issues taxes the limited capacity of many mechanical voting machines.

With the relatively recent advent of microprocessor-based computer systems it is possible from both a functional and an economic standpoint to provide, as replacements for mechanical voting machines and other voting systems such as computer punch card systems, programmable electronic voting machines that can electronically record and store vote tallies at the polling sites. For example, U.S. Pat. No. 4,015,106 represents an early attempt at a programmable electronic voting machine.

While numerous programmable electronic voting machines have been designed and promoted as replacements for mechanical voting machines or other voting systems, to the present inventor's knowledge none of such prior art electronic voting machines have yet met with wide commercial success because they cannot meet all of the numerous unique requirements confronting the electronic voting machine designer.

For example, the ideal electronic voting machine should be simple to program by precinct voting officials who are for the most part not technically oriented, and more importantly should be simple to operate by a technically unsophisticated voter. In other words, the ideal electronic voting machine should be "user friendly". To this extent, the ideal electronic voting machine should present to a voter ballot information and vote selection means in a traditional fashion, i.e. in a fashion with which a voter would be familiar from his past experience with mechanical voting machines or other voting systems. It is traditional to have a unique voting lever or switch means physically associated with each vote selection presented by the ballot. Therefore, a vote selecting, alpha-numeric keyboard unit which is set apart physically from the visually displayed ballot information, while perhaps customary from a computer terminal design standpoint, is undersirable from a voter acceptability standpoint.

As a further example, the ideal electronic voting machine must be highly reliable and accurate in terms of recording and tallying valid vote selections. Because electronic systems are inherently susceptable to electrical and electromagnetic interference, the required reliability and accuracy of the electronic voting machine is much more difficult to achieve than was the case with the prior art mechanical voting machines.

As a further example, the ideal electronic voting machine must be rugged, self-contained, long-lived and readily portable since, like the prior art mechanical voting machines, it will be moved, set up, and broken down for extended periods of storage, many times throughout its useful life.

As a further example, like their earlier mechanical counterparts, the ideal electronic voting machine should, to a reasonable and determinable degree, be tamperproof and should be failsafe in that a power outage, interruption or other electrical failure will not invalidate all vote tally information already accumulated by the electronic voting machine.

It is the above design requirements and others familiar to those skilled in the art that the electronic voting machine of the present invention is intended to fully meet.

SUMMARY OF THE INVENTION

In accordance with the present invention, a portable, self-contained electronic voting machine includes a motor-driven mechanism for carrying printed ballots having voter selections indicated thereon. The motorized mechanism visually presents to a voter only a preselected portion of the printed ballots at any one time. A plurality of switch means is positioned next to all voter selections on the preselected portion of the printed ballots then being viewed by the voter wherein the voter actuates selected ones of the switch means to make vote selections. An interactive programmable electronic control means actuates the motor-driven mechanism carrying the printed ballots, and records and tallies the vote selections indicated by the selected ones of the switch means actuated by the voter. Preferably, the printed ballots are constituted by a plurality of separate, standard sized sheets of paper supported along the length of an elongated movable web forming a part of the motor-driven mechanism.

The electronic control means is both preprogrammed with a suitable interactive or user-friendly operating software program and is real-time programmable in that specific operating parameters of the voting machine can be programmed or inputted to the electronic control means before and during an election. The programming mode which defines the ballot and/or election criteria to the electronic control means prior to the actual election voting process is referred to hereinafter as the "set-up" mode or "setting up" the voting machine. Therefore, prior to setting up the voting machine at a particular precinct, the voting machine is not dedicated to any particular ballot or election format.

Printed set-up programming indicators are carried by the motor-driven mechanism, the indicators being positioned next to a portion of the plurality of switch means only when the voting machine is in a set-up programming mode. This portion of the plurality of switch means next to the programming indicators is viewed by and actuated by a non-voter, such as a precinct official, to program the electronic control means prior to an election. During the election, the set-up programming indicators are not viewable by a voter who uses the plurality of switch means to make vote selections. The plural switch means, therefore, are usable for both vote selections and electronic control means programming.

The motor-driven mechanism is preferably in the form of a scroll mechanism having a pair of spaced apart, juxtaposed rollers rotatable on parallel axes. The earlier noted movable web is flexible and extends between the rollers spaced apart by a distance substantially less than the length of the elongated web. The web is wound onto one roller when both rollers simultaneously rotate at the same general rate in a clockwise direction. The web is wound onto the other roller when both rollers simultaneously rotate at the same general rate in a counterclockwise direction. The plurality of ballot sheets are carried in side by side relation on the web wherein only the portion of the ballot sheets carried on that portion of the web extending between the rollers is viewable by the voter.

Preferably the web is formed of two overlayed transparent plastic sheets that are seam welded together at spaced locations to provide, for example, eight pockets into which standard sized paper having printed ballot selections thereon can be inserted between the sheets. Thus, standard sized printed paper ballots are carried by the scroll mechanism and presented to a voter in a controlled manner by the programmable electronic control means in response to system software instructions and to a degree in response to voter interactive instructions.

Preferably, a voter-accessed control panel includes a transparent rectangular window viewing portion through which the extended portion of the web carrying a selected portion of the ballots is viewable by the voter. Single vertical columns of pushbutton switches located on the control panel extend along opposite sides of the viewing window and align with associated voter selections on that portion of the ballots being presented via the window to the voter. The printed ballots and the scrolling mechanism are completely contained within the housing or case of the voting machine to preclude ballot tampering.

In further accordance with the invention, the electronic voting machine includes a motor-driven shutter that opens and closes an aperture in the control panel which permits voter access to a portion of a continuous paper tape for recording write-in votes. The tape is indexed for each write-in vote and identifying data is Printed thereon by a printer mechanism, the motor-driven shutter and the printer mechanism being regulated by the electronic control means.

Scrolling switches operated by the voter allow viewing of all or only some of the ballot portions carried by the scroll mechanism, as determined by a remote judge's control panel having a plurality of programmable activation control pushbutton switches thereon. Therefore, the judge's panel provides a means for interactive control of the voting machine during an election. For example, in the case of a primary election, a preprogrammed judge's panel switch can be actuated to preclude a voter from scrolling to view the ballot of a voting party which he has not declared. The web carrying the plurality of ballot sheets includes along its edge a plurality of optically detectable indicia which are read by an optical detector which provides a signal to the electronic control means to identify the portion of the web being presented to the voter and to accurately indicate its position for proper viewing.

In addition to the above-noted controlled presentation of the printed ballot sheets as effected by the scrolling mechanism which is regulated by the programmable electronic control means and by the remote judge's control panel, the present invention also includes a unique drive mechanism for effecting simultaneous rotation of the scrolling rollers and for maintaining the web portion extending between them at any one time in tension. In further accordance with another feature of the inyention, a pair of paper roll supply and takeup mechanisms are provided for feeding a continuous paper tape to the write-in mechanism, and for also feeding a separate audit printer with another continuous paper tape that functions in a conventional manner as a hard copy backup for electronically stored vote tally information.

The electronic voting machine as discussed above has been found to be very user friendly and highly adaptable to all voting situations since, by use of the controlled ballot presentation feature, a single interactively programmable voting machine can be used by a plurality of voters who are not permitted to vote on all candidates and issues that the voting machine is capable of presenting for vote selections.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
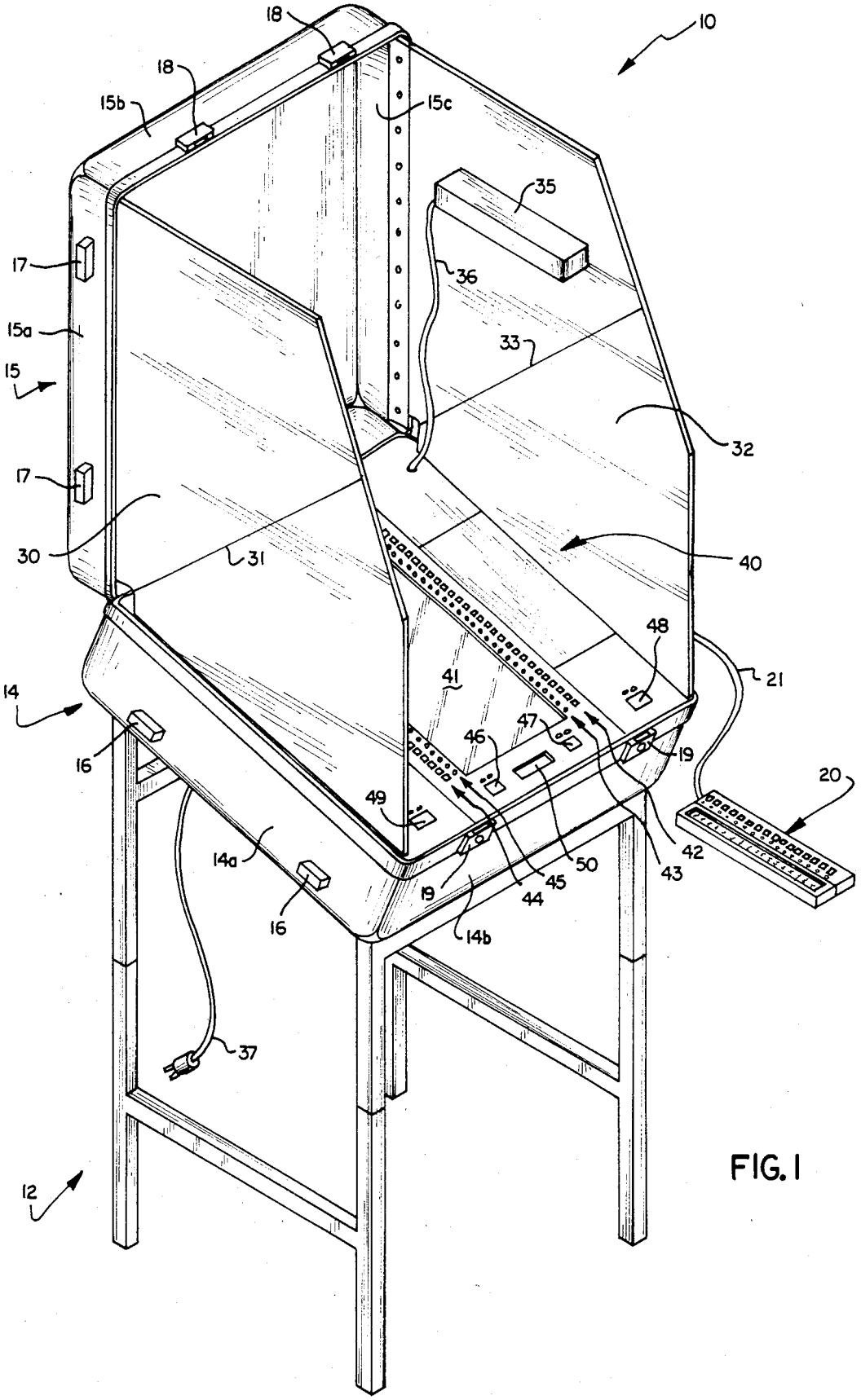
FIG. 1 is a left front perspective view of an electronic voting machine according to the present invention.

With reference to FIG. 1, a left front perspective view of a portable, self-contained electronic voting machine 10 in accordance with the present invention is illustrated in its set up position ready for use by a voter. The machine 10 includes a four section metal support frame or leg assembly 12 formed from rectangular tubular metal or other suitable frame forming material. Supported at the top of the leg assembly 12 in a tilted plane is a main case or boxlike housing 14 of the voting machine 10 having an associated cover 15 shown in a generally vertical or upright position, the cover 15 being hinge-mounted to the back edge of the housing 14. A left sidewall 14*a* of the main housing 14 has mounted to it a pair of spaced support pedestals 16 which are associated with another pair of spaced support pedestals 17 mounted to the left side 15*a* of the cover 15 as illustrated. The function of the pedestals 16, 17 will be explained subsequently with reference to additional drawing figures. A front wall 15*b* of the cover 15 has mounted on it in spaced apart relation a pair of keepers 18 that are engageable in locking fashion with an associated spaced apart pair of latch mechanisms 19 mounted to a front sidewall 14*b* of the main housing 14 when the cover 15 is in a closed condition as opposed to its open condition illustrated in FIG. 1.

Extending in a generally vertical plane and positioned between the main housing 14 and the cover 15 is a left privacy panel 30 foldable along a left panel fold line 31 in a manner subsequently illustrated. The back edge of the panel 30 is hinge mounted to the inner surface of the left side 15*a* of the cover 15, while the lower edge of the panel 30 rests on the upper end of the left sidewall 14*a* of the main housing 14 as illustrated. In a similar manner, a right privacy panel 32, foldable along a right panel fold line 33, is provided with its rear edge being hinge mounted to the right sidewall 15*c* of the cover with the lower edge of the panel 32 resting on the main housing 14 as illustrated.

As shown, the cover 15 is held in its raised position by the panels 30, 32 and cooperates with the panels to form a cubicle or shielding structure allowing a voter to access in privacy a voting and programming control panel 40 which is tilted toward the voter for ease of operation as illustrated. As will be subsequently illustrated in greater detail, the control panel 40 includes a plurality of subpanels which as a group close the open top end of the boxlike housing 14. To aid the voter in viewing the control panel 40, a conventional fluorescent light fixture 35 is mounted to the inner side of the right privacy panel 32 as illustrated. Preferably, the relatively heavy weight ballast (not shown) for powering the fluorescent light fixture 35 is contained within the housing 14 and is electrically connected to the fixture 35 via a power cord 36. It is to be noted that other suitable illuminating means other than the fluorescent light fixture 35 can be provided for the convenience of the voter.

With particular reference to the control panel 40, a major area of the central portion of the panel 40 is occupied by a transparent window portion 41 having a rectangular shape with a vertical length substantially greater than its width as illustrated. In a manner to be subsequently described, a voter can view through the transparent window portion 41 presented portions of printed ballots having voter selections indicated thereon. The printed ballots are carried by a motor-driven mechanism as will be subsequently shown and described. Along one edge such as the right edge of the central portion of the control panel 40 is located a single column or array of a plurality of switch means 42 in the preferred form of membrane-type pushbutton switches providing tactile feedback to the voter. Located between the column of switches 42 and a rightward edge of the window portion 41 is an associated column or array of light emitting enunciators 43 in the preferred form of light emitting diodes wherein each diode is associated with an adjacent one of the pushbutton switches 42 as illustrated. In a similar manner located adjacent the opposite or left edge of the transparent window portion 41 is another single column or array of a plurality of switch means 44 in the preferred form of membrane-type pushbutton switches associated with another column or array of light emitting enunciators 45 in the preferred form of light emitting diodes wherein each diode is associated with an adjacent one of the pushbutton switches 44. As will be subsequently discussed, both the set-up programming of the electronic voting machine 10 and the selection of votes by the voter are accomplished by use of the columns of pushbutton switches 42, 44. The associated enunciating lights 43, 45 provide an immediate visual feedback to the user as to whether or not the voting machine has accepted a switch selection as being valid or permissible. In the discussion of the voting machine electronics hereinafter, the ballot pushbutton switches 42, 44 and the associated lights 43, 45 will be referred to ,as the right and left ballot button switch arrays 42, 44, and the right and left ballot light arrays 43, 45 respectively.

Located below the transparent window portion 41 of the control panel 40 is a voter information and programming information display 50 in the preferred form an eight segment liquid crystal display (LCD) device for providing visual feedback to both a non-voter programming, testing or troubleshooting the machine, and to a voter using the machine during an election. Located to the left of the information display 50 is a ballot review scrolling switch means 46 in the preferred form of a pushbutton type pad. Located to the right of the information display 50 is a ballot advance scrolling switch means 47 also in the preferred form of a pushbutton type pad switch. The advance and review scrolling switch means 46, 47 allow a voter (or a non-voter when setting up the machine 10) to instruct the voting machine 10 to present different ballot portions viewable through the transparent window portion 41 as the voter is making his voting selections. The voting machine electronics, software and ballot format instructions determine which ballot portions the current voter is permitted to see and cast votes on. When the voter ballot transition request is not valid, the scrolling advance and review button switches will not operate accordingly. The different ballot portions as noted earlier are visually presented to the voter or user through the transparent window portion 41 by means of a motor-driven mechanism contained within the housing 14 that will be subsequently illustrated and discussed. After the voter has viewed all of the available ballot portions through the transparent window 41 and has made all of his vote selections using the columns of switch means 42, 44 the voter can then press a vote register or casting switch means 48 in the preferred form of a pushbutton type pad switch located at the lower right corner of the control panel 40 as illustrated, whereby the voter's selections are then electronically stored and tallied.

The electronic voting machine 10 also includes means for providing a write-in voting capability. A write-in vote switch means 49 in the preferred form of a pushbutton type pad switch that is located in the lower left corner of control panel 40 allows access to a paper write-in tape window which will be illustrated and discussed subsequently.

As noted earlier, by use of the review and advance scrolling switch means 46, 47 the voter can view different portions of the available ballots through the transparent window portion 41. In certain cases, such as in the case of a primary election, all of the printed ballots stored in the main housing 14 may not be presented to a voter. For example, a voter declaring himself a Republican cannot view and vote on a Democratic primary ballot. Conversely, a voter declaring himself a Democrat cannot view and vote on ballot portions containing Republican voter selections. Therefore, to preclude a voter, by use of the switches 46, 47, from viewing all of the available ballot portions contained in the housing 14, a judge's panel 20, constituting a remote control means, is provided. The judge's panel 20 contains an array of pushbutton switches which precondition the voting machine 10 in accordance with the voter then using the machine. The judge's panel 20 is connected to the main housing 14 of the voting machine 10 via a relatively long control cable 21 which for example contains four conductors for supplying power to the judge's panel 20 and carrying multiplexed signals to and from the judge's panel 20 and a programmable electronic control means contained within the housing 14. Power for the electronic voting machine 10 is provided by a conventional main power cord 37 that can plug into a commercial power outlet providing, for example, a nominal 115 volts alternating current at 60 hertz.

With such a judge's panel control feature, the voting machine 10, during a single election, can be used to accommodate voters who as individuals may not be able to vote on all candidates or issues on the plurality of ballots stored in the housing 14 and presentable via the transparent window 41. Thus, the electronic voting machine 10 is in effect a universal voting machine providing great flexibility for accommodating almost any conceivable election scenario. It is also to be noted a this time that although the heretofore discussion and subsequent discussions deal primarily with political type voting, it is clearly contemplated that the voting machine of the present invention could be used in other voting type processes such as consumer surveys, opinion polls, and the like.

Figure 2:
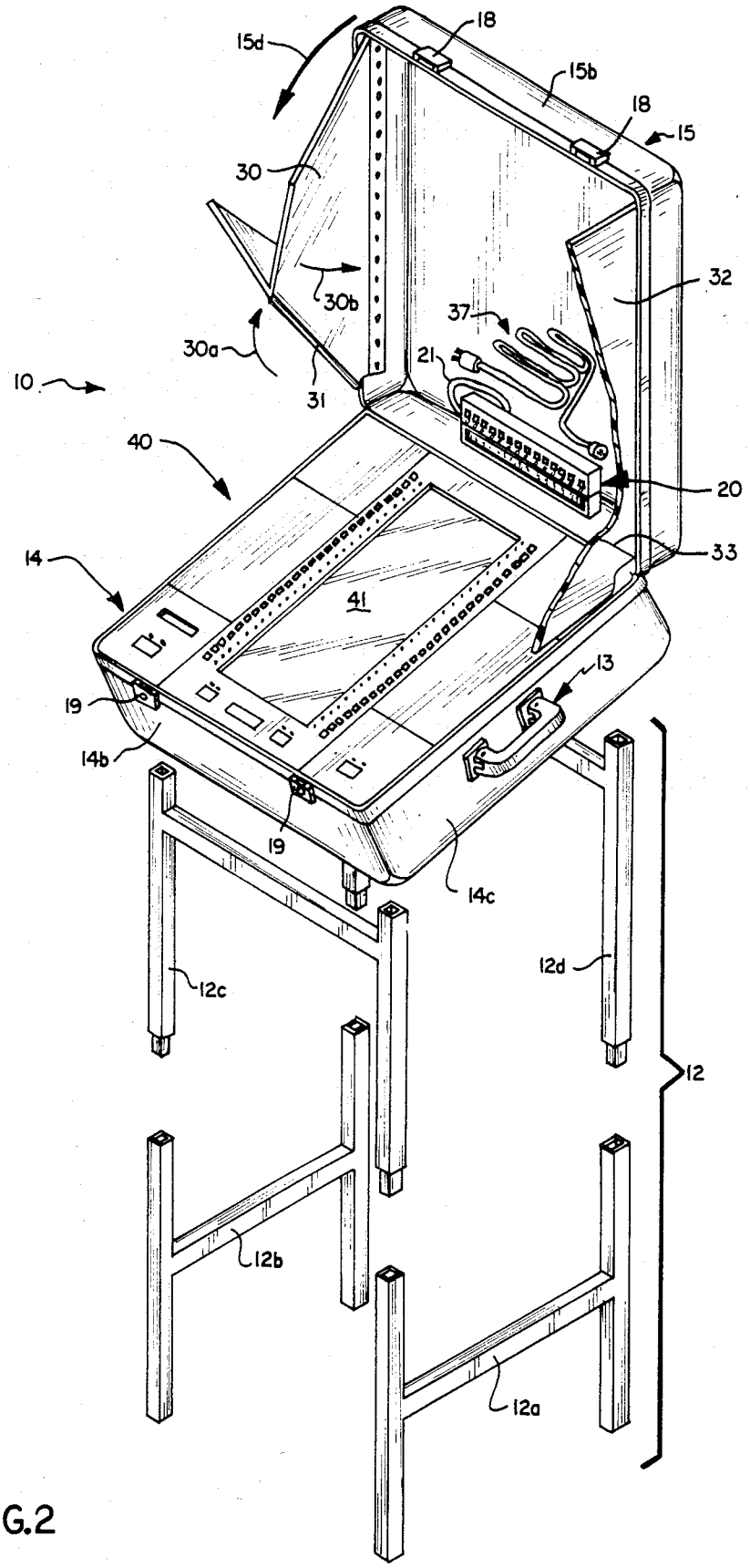
FIG. 2 is a right front perspective view of the electronic voting machine illustrated in a partially broken down or disassembled condition in preparation for storage.

Turning to FIG. 2, a right front perspective view of the electronic voting machine 10 is illustrated in a partially broken down or disassembled condition wherein the voting machine 10 is being prepared for storage subsequent to an election or the like. As shown, the judge's panel 20, with its control cable 21, has been stowed in the lower central portion of the cover 15 along with the main power cord 37. The four section leg assembly 12, illustrated in a disassembled condition, includes an H-shaped right section **12*a* and an identical H-shaped left section 12*b*; the sections 12*a*, 12*b* having lower ends engaging a floor or other horizontal support. The front top ends of the sections 12*a*, 12*b* receive in telescoping fashion the bottom end of a-front cross piece support assembly 12*c* while the rear top ends of the sections 12*a*, 12*b* receive in telescoping fashion the lower end of a rear cross piece support assembly 12*d*. The front support assembly 12*c* extends to a height less than the height of the rear support assembly 12*d* to provide for the described forward tilting of the main housing 14 which rests upon the upper ends of the support assemblies 12*c*, 12*d*. The four sections 12*a*–12*d* are also stowed in nested fashion within the cover 15 of the voting machine 10**.

The left privacy panel 30 has its lower section folded upwardly along fold line 31 as indicated by arrow **30*a* and then the folded panel 30 is swung about its hinged back edge inwardly towards the cover 15 as indicated by arrow 30*b*. This retains the leg assembly sections 12*a*–12*d* in position within the cover 15. The right privacy panel 32 is folded along its fold line 33 in a similar manner to that discussed with regard to privacy panel 30, and then swung into the cover 15. At this point, the cover 15 with the noted voting machine components stored therein can be swung downwardly as indicated by arrow 15*d* wherein the cover mounted keepers 18** can lockably engage the latch mechanisms 19 mounted on the main housing 14.

The voting machine 10, in its knockdown condition, presents the appearance of a conventional suitcase-like structure having mounted on the right sidewall 14*c* of the main housing 14 a suitable handle assembly 13 which can be grasped for easily transporting the voting machine 10. The closed-up voting machine can be set down and rested upon the support pedestals 16, 17 illustrated and discussed earlier with regard to FIG. 1.

Figure 3:
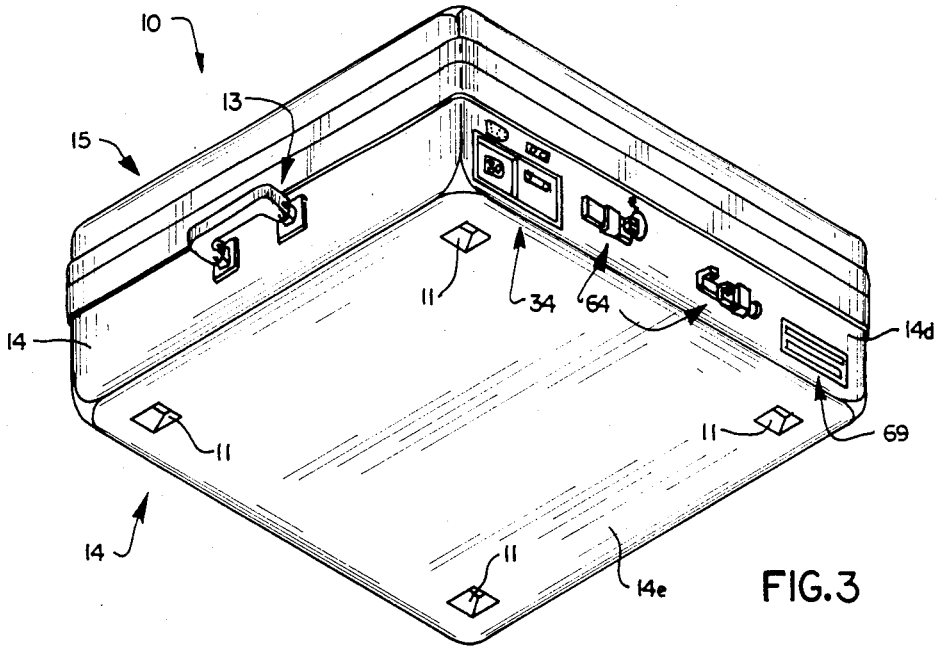
FIG. 3 is a lower left rearward perspective view of the electronic voting machine in a storing or closed condition.

With reference to FIG. 3, a rearward perspective view of the voting machine 10 in its knocked down storing condition is illustrated. A rectangular bottom 14*e* of the main housing 14 includes at each of its corners support frame receiving recesses 11 into which are inserted the top ends of the front and rear leg assembly frame sections 12*c*, 12*d* as illustrated and discussed with regard to FIG. 2. As further shown in FIG. 3, a rear sidewall 14*d* of the main housing 14 provides a power input and control panel 34 at its leftward end as viewed in FIG. 3, and a voting machine identification information plate 69 located at the rightward end thereof. Located in spaced apart relation in the central portion of the rear sidewall 14*d* are a pair of latch release cover assemblies 64 that are generally identical in structure.

Figure 4:
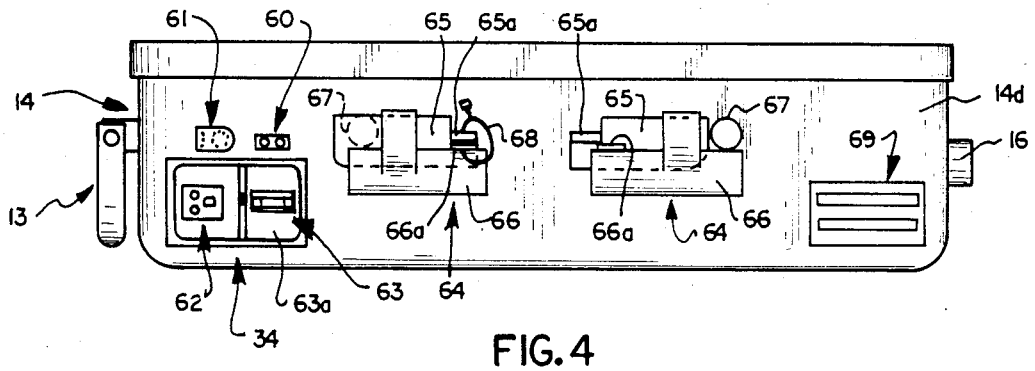
FIG. 4 is a rear elevation of the electronic voting machine with the cover thereof removed.

A better understanding of the structures carried on the back sidewall 14*d* of the main housing 14 can be had by reference to FIG. 4 wherein the cover 15 of the voting machine has been removed. The power input and control section 34 includes a main power cord receptacle 62 having a conventional male type three prong connector that accepts the female connector end of the main power cord 37 shown in FIG. 2. Located to the right of the main power receptacle 62 is a conventional fuse block 63 which functions in a known manner as an electrical overload safety feature. The fuse block 63 is normally covered by a transparent access door 63*a* through which the fuse block 63 can be viewed to determine its status. With the power cord 37 inserted into the main power receptacle 62 the fuse access door 63*a* cannot be slid leftwardly to allow replacement of the fuse portion of the fuse block 63 thus precluding an electrical shock hazard to a user. With the power cord disconnected from the receptacle 62 the access door 63*a* can be slid leftwardly wherein the fuse portion of the fuse block 63 can be replaced if necessary without any shock hazard since no power can be supplied via the receptacle 62 which is now covered by the access door 63*a*.

Located above the main power receptacle 62 is a judge's panel cable connecting socket 61 of a conventional type. It is this socket that the voting machine end of the judge's panel control cable 21 (see FIG. 1) plugs in to for the exchange of multiplexed signals between the programmable electronic controller of the voting machine and the earlier discussed judge's panel 20. Located above the fuse block 63 is an external battery power hook-up receptacle 60 which provides a means to electrically connect the electronic voting machine 10 of the present invention to, for example, a 12 volt direct current battery pack so that the machine 10 can be operated if desired when a commercial power failure occurs.

The machine identification plate 69 contains information for identifying each electronic voting machine 10 as a unique unit. For example the identification plate 69 would contain a unique machine serial number that is used to program the machine in a manner to be subsequently explained thus assuring that the vote tally information provided by the machine can be correlated with the particular machine from which it came.

The rear sidewall 14*d* further includes a pair of spaced apart latch release access apertures 67 into which can be inserted a finger or another suitable implement to engage a latch releasing means allowing portions of the control panel 40 to be raised up (see FIG. 5) to allow access to components of the voting machine 10 contained within the housing 14.

With further reference to FIG. 4, to preclude access to internal components of the voting machine by unauthorized personnel, the latch release cover assemblies 64 are provided to act as movable cover means that can be operated by an authorized voting official for setting up or servicing the voting machine 10. Each of the latch release cover assemblies 64 includes a gate support bracket 66 fixed to the rear sidewall 14*d* in adjacent relationship to the associated latch release access aperture 67. The brackets 66 slideably support movable shutter-like gates 65 that can move back and forth to close and open access to the apertures 67. For purposes of illustration, the leftward (as viewed in FIG. 4) latch release cover assembly 64 is illustrated in a closed "secured" condition, while the rightward latch cover assembly 64 is illustrated in an open "unsecured" condition.

With particular reference to the left latch cover assembly 64 it can be seen that the movable gate 65 is at a far left position whereby it covers its associated access aperture 67 and wherein a movable gate tab portion 65*a* is vertically aligned with an associated support bracket tab portion 66*a*. The tab portions 65*a*, 66*a* have corresponding apertures through which a wire seal assembly 68 or other suitable means can extend to effectively lock the movable gate 65 in position relative to its associated support bracket 66. In a similar fashion the rightward cover assembly 64 can also be positioned so as to preclude access to its associated aperture 67 and locked in such position using another wire seal.

Figure 5:
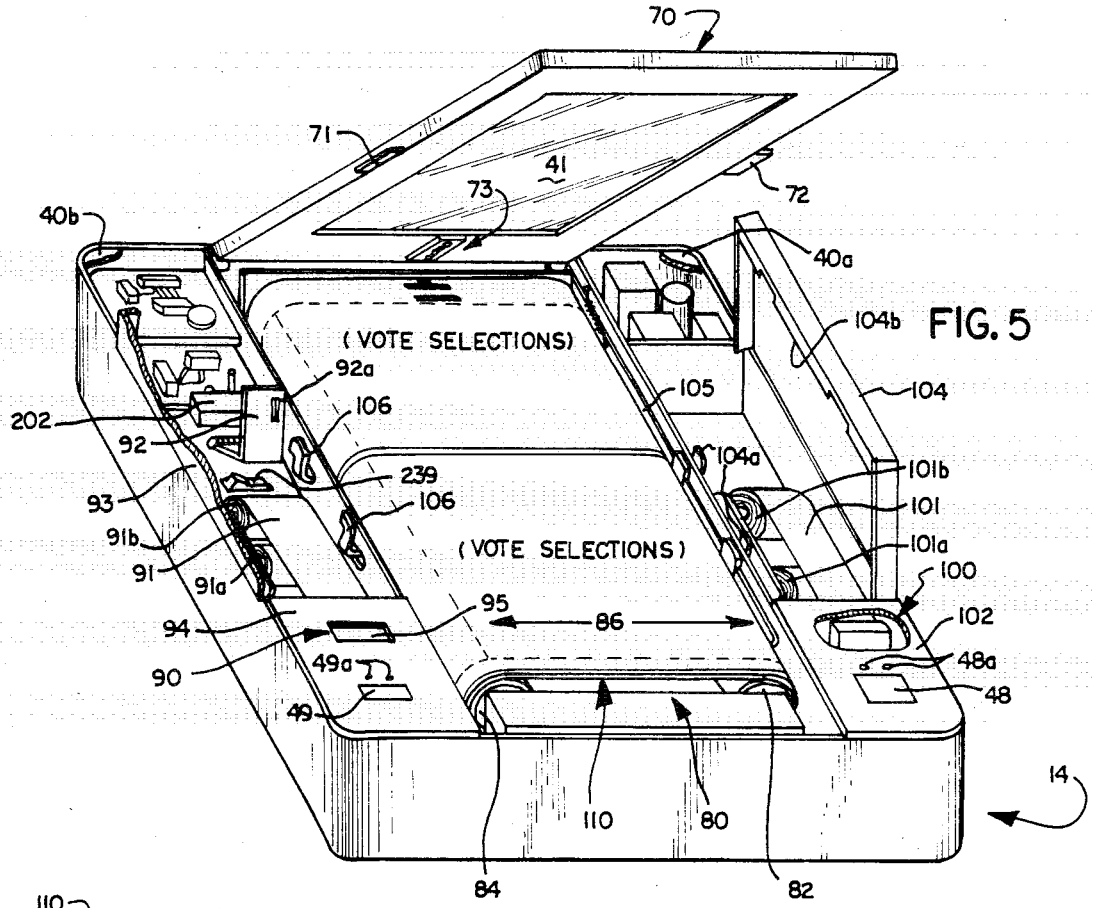
FIG. 5 is a front perspective view of some of the internal components of the voting machine within a main housing of the voting with the housing shown in an open condition.

Thus, the latch release cover assemblies 64 in combination with associated wire seals constitute tamper resistant means to prevent an unauthorized person from releasing control panel latch means via apertures 67 without breaking the wire seal 68. If the seals are broken it indicates to a voting official that the associated voting machine may have been tampered with. During setup and servicing of the machine, the seals 68 are removed by authorized personnel and control panel latching means to be subsequently discussed are released via apertures 67 to open up the voting machine main housing 14 as illustrated in FIG. 5. During an election, the main housing 14 is completely closed up and locked as will be described.

With reference to FIG. 5, internal components within the main housing 14 of the voting machine in accordance with the present invention will now be discussed. For purposes of simplification, portions of the voter control panel 40 (see FIGS. 1 and 2) have been cut away. The central portion of the control panel is constituted by a window panel assembly 70 which carries at a central location the earlier discussed transparent window portion 41 through which ballot information is presented to the voter. The top surface of the window panel assembly 70 also provides the columns of push-button ballot switch means 42, 44, the columns of associated light-emitting diodes 43, 45, the review and advance scrolling switch means 46, 47, and the information display 50 as discussed earlier with regard to FIG.

Figure 10:
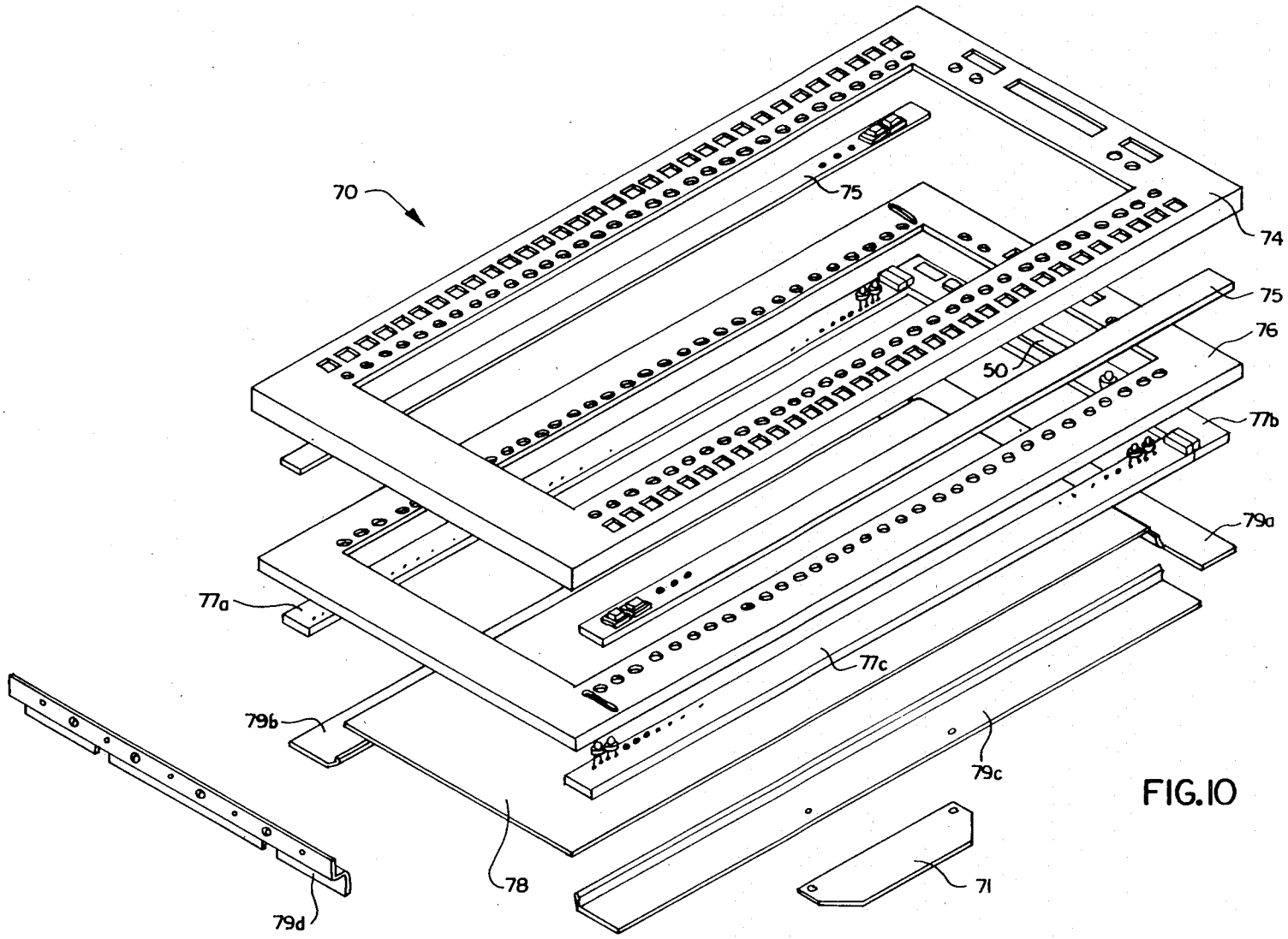
FIG. 10 is an exploded right rear perspective view of structural components of a window panel assembly of the voting machine.

1. A more detailed discussion of the window panel assembly 70 will be undertaken in the forthcoming discussion of FIG. 10 of the drawings.

With further reference to FIG. 5, it can be seen that the rearward edge of the window panel assembly 70 is hinge mounted to a main frame portion of the voting machine to be subsequently discussed with specific reference to FIG. 9. The bottom rearward central portion of the window panel assembly 70 includes part of an optical detector means 73 in the preferred form of four infrared light-emitting diodes that are associated with four infrared light detecting transistors to be subsequently illustrated and discussed. The left underside portion of the window panel assembly 70 has fixed to it a left side locking plate 71 while the opposite right underside of the panel assembly 70 includes a similar right side locking plate 72.

Located below the window panel assembly 70 is a motor-driven, ballot information presenting mechanism in the preferred form of a motor-driven scroll mechanism 80 having a flexible elongated web 110 which can carry a plurality of ballot sheets upon which voter selection information is indicated. The scroll mechanism 80, to be illustrated in greater detail with reference to FIG. 11, includes a pair of spaced apart, juxtaposed rollers 82, 84 rotatable on parallel axes such that the web 110 is wound onto one of the rollers, e.g. roller, 82 when both rollers simultaneously rotate at the same general rate in a clockwise direction, and the web 110 is wound onto the other roller, e.g. roller 84 when both rollers simultaneously rotate at the same general rate in a counterclockwise direction. An extended web portion 86 is held in tension between the rollers 82, 84 and can be viewed by the voter through the transparent window portion 41 of the window panel assembly 70 when in its closed condition. It can be seen that by simultaneous clockwise or counterclockwise rotation of the rollers 82, 84 only a preselected portion of the printed ballots carried by the web 110 are available for viewing by the voter at any one time.

Figure 6:
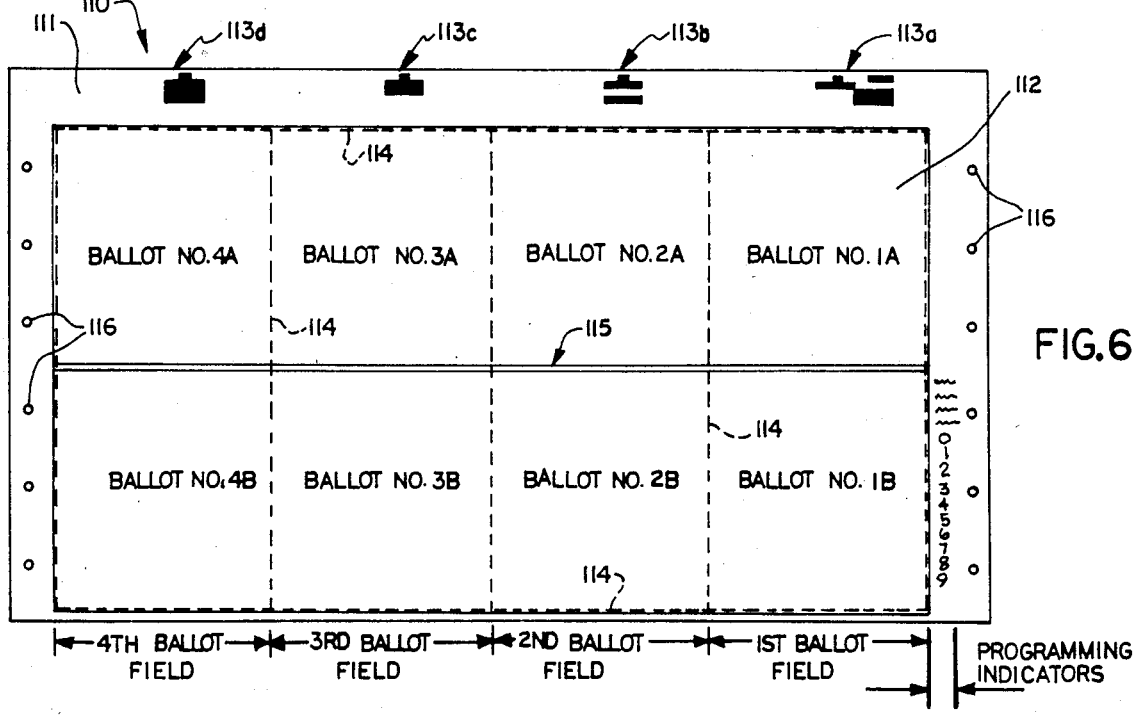
FIG. 6 is a plan view of an elongated flexible ballot carrying web means particularly adapted for use with eight printed ballot sheets.

With reference to FIG. 6, a suitable web 110 for use in the voting machine of the present invention is illustrated apart from the voting machine. Preferably, the flexible elongated web 110 is formed from transparent or nearly transparent polyethylene plastic or other suitable plastic material. The flexible web 110 used successfully in practicing the present invention has a length of 42 inches and a width or height of 24 inches. The web 110 is formed of a web substrate 111 having, as viewed in FIG. 6, along its left edge a plurality of perforations 116 through which suitable fasteners extend to attach it to the scroll mechanism roller 84 in a manner to be subsequently illustrated. The rightward edge of the web substrate 111 in a similar fashion, includes an additional plurality of mounting perforations 116 for fixing the rightward edge to the other roller 82 (see FIG. 5) of the scrolling mechanism 80. The distance between the rollers 82, 84 is approximately 10 inches so that at any given time approximately 32 inches of the length of the flexible web 110 is stored on either or both of the rollers 82, 84.

Located along the top edge of the web substrate 111 are a plurality of spaced optically detectable indicia 113*a*–113*d* each of which are uniquely identified respectively with a first ballot field, a second ballot field, a third ballot field, and a fourth ballot field, as illustrated in FIG. 6. The optically detectable indicia 113*a*–113*d* are detected by the optical detector means 73 (see FIG. 5) which with an associated detector means portion 73*a* (to be illustrated and discussed subsequently with reference to FIG. 11) provides a signal to the programmable electronic control means. This signal identifies the particular portion of the web 110 extending between the rollers 82, 84 at any given time. The optically detectable indicia 113*a*–113*d* also includes information provided with said signal that serves to indicate the position, relative to the detector means 73, of the identified web portion extending between the rollers 82, 84 at any given time. Thus, the optically detectable indicia 113*a*–113*d* and the optical detector means 73 cooperate to provide a signal to the voting machine electronics which can be interpreted for information as to which ballot field is being presented and/or the viewing alignment of the ballot fields with respect to the detector means 73 and thus the transparent window portion 41 of the window assembly 70.

Located at the lower right corner of the web substrate 111 are a column of sixteen set-up programming indicators that are viewable through the window portion 41 of the window panel assembly 70 only when the voting machine is undergoing set-up programming as will be subsequently explained.

Overlying the web substrate 111 is a smaller web overlay 112 also formed of a sheet of flexible plastic transparent or semi-transparent material. The web overlay 112 is seam-welded by the use of conventional heating means. The seams are represented by dotted lines 114 in FIG. 6. A horizontal, vertically centered slit 115 is cut from the left end of the web overlay 112 to its right end so that standard 8½ inch by 11 inch printed paper ballots (designated 1A–4A and 1B–4B) can be slipped via the slit 115 into the eight pockets formed between the web substrate 111 and the web overlay 112 seam-welded to it as indicated. For example, the first ballot field can be constituted by ballot No. 1A slipped upwardly into the upper right pocket of the web 110 via slit 115, while ballot No. 1B can be slipped downwardly into the lower right pocket of the web 110 via slit 115. In a similar fashion the second ballot field contains two standard paper printed ballot Nos. 2A and 2B, while a third ballot field contains ballot Nos. 3A and 3B, with the fourth ballot field containing ballot Nos. 4A and 4B. It is to be recognized that not all of the eight ballot pockets need be utilized and that any combination of filling the various ballot pockets with printed ballots can be utilized. It is also to be recognized that more or less than four ballot fields could be utilized if so desired by providing a longer web. It is also to be recognized that, without departing from the intended scope of this invention, a single, elongated, weblike strip of paper having printed ballots thereon, plus indicia 113*a*–113*d* and the noted programming indicators, could be provided to replace the separate web/ballot structure illustrated in FIG. 6. However, from a convenience standpoint, the plural ballot sheet carrying web structure of FIG. 6 is preferred.

Because the flexible elongated web 110, which carries in its pocket portions the printed ballots containing voter selection information thereon, is mounted on the scroll mechanism 80 of FIG. 5, all of the available ballot fields can be sequentially or non-sequentially presented to a voter. Alternatively, only some preselected ones of the ballot fields can be presented depending upon the preconditioning of the control electronics as determined by the earlier discussed judge's panel 20 (see FIG. 1).

With further reference to FIG. 5, the right rear corner of the main housing 14 contains a power supply circuit for providing electrical power to the control circuitry to be subsequently discussed. The power supply circuitry is normally covered by a power supply cover plate 40*a* which is partially cut away in FIG. 5.

The right front corner of the housing 14 contains a conventional thermal-type audit printer mechanism 100 (partially shown) that is fed with paper tape 101 from a supply roll 101*a*. The tape 101 is collected onto a take-up roll 101*b*. The web handling mechanism for rotatably supporting the supply roll 101*a* and the take-up roll 101*b* will be discussed in greater detail with regard to FIGS. 13, 14, 15 and 16. The audit printer mechanism 100 functions in a conventional manner to provide a printed audit trail of vote tallies and other program information so that the audit trail paper tape 101 constitutes a hard copy back-up for electronically stored vote tally information.

The audit printer mechanism 100 is covered by an audit printer cover panel 102, shown partly cut away, with the panel 102 also serving to support the earlier noted vote registering switch 48. Located above the switch 48 is a pair of series connected enunciator light-emitting diodes 48*a* that illuminate to provide visual feedback to a voter that, for example, the electronic voting machine is in a condition to permit a voter to cast his vote.

The housing portion between the power supply covered by panel 40*a* and the printer mechanism covered by panel 102 constitutes an audit printer paper bin that is closed off from access by a hinge-mounted audit trail paper bin door 104. The paper bin door 104 is shown in its raised position in FIG. 5 and has an underlying lip portion 104*b* with slots cut therein that align with a pair of latches 104*a*. The latches 104*a* are fixed to an elongated, spring biased door release push rod 105 that is longitudinally slideable toward the front of the housing 14 by a forwardly push on its rearward end such as by the finger of an authorized person using the appropriate aperture 67 in the back of the housing 14 as discussed earlier with regard to FIG. 4. The door release push rod 105 is normally spring biased toward the rear of the housing 14 so that the latches 104a carried thereon lockably engage slot adjacent portions of the lip 104*b* of the door 104 when the door is in a lowered or closed condition.

With reference to the left side of the housing 14 shown in FIG. 5, a write-in paper tape bin door 93 (partially shown) is similar in design to the audit trail paper bin door 104 just discussed. Accordingly, the tape bin door 93, when in a lowered condition, is locked by another pair of latches 106 carried on a spring biased push rod similar to earlier discussed push rod 105. Like the push rod 105, the push rod associated with latches 106 is moved forward via access through the appropriate aperture 67 (see FIG. 4) to release the write-in paper tape bin door 93 and allow it to be raised to an open condition.

Thus it can be seen that latch mechanisms accessible by authorized personnel from the rear of the voting machine serve to lock down in a closed position the audit trail paper bin door 104 and its counter part write-in paper tape bin door 93. Prior to closing the doors 93, 104 the window panel assembly 70, which can be raised to allow the insertion of ballot sheets into the pockets of the web 110, is lowered to its closed position. When the write-in paper bin tape door 93 is then lowered it overlaps and engages the left side locking plate 71 to further preclude raising of the window panel assembly 70. In a similar fashion, when the audit trail paper bin door 104 is lowered, it overlaps and engages the right side locking plate 72 to preclude raising of the window panel assembly 70. Thus it can be seen that the window panel assembly 70 and the associated doors 93, 94 are all locked in position by the latches 104*a*, 106 which in turn can only be released by authorized personnel through the tamper resistant rear panel apertures 67.

With further reference to FIG. 5, the left rear corner of the main housing 14 contains three interconnected printed circuit boards (only two illustrated) mounted in a nested, stacked condition. The three printed circuit boards contain the major components of the programmable electronic control means to be subsequently discussed. An electronic control circuitry cover panel 40*b*, illustrated with portions cut away precludes access, to the circuit boards by unauthorized personnel. To facilitate maintenance, the three illustrated circuit boards are removable as a cluster so that they can be replaced during normal maintenance or emergency repair procedures. It is also to be noted that a hinged memory cartridge cover 92, made from metal for electromagnetic interference shielding purposes, shown in a partially raised position, can be lowered to cover a portion of one of the circuit boards supporting a removable memory means in the preferred form of an erasable programmable read only memory cartridge 202. The cover 92 when in its lowered position can include tamper indicating sealing means and/or electrical temper indicating switch means which would indicate to a voting official that the underlying memory cartridge may have been tampered with thus raising the possibility of questionable election results. The three printed circuit boards and other electronic hardware, thus far discussed and to be discussed, are interconnected with multiconductor ribbon cables, board connectors and direct wiring to form circuit modules. The function and configuration of such circuit modules will be more fully described hereinafter.

With the write-in paper tape bin door 93 open, access is also permitted to a plurality of switches used in setting up and initializing the voting machine. For example, an on/off switch 239 is accessible to initially energize the machine as well as a mode switch (not shown in FIG. 5) to cycle the electronic voting machine through its various modes of operation during set-up and final vote recording operations in an election. These control switches and others will be more fully described in the forthcoming electronics discussion of this specification.

Located in the left front corner of the main housing 14 of the voting machine as illustrated in FIG. 5 is a write-in mechanism to be subsequently illustrated in greater detail with regard to FIGS. 17 and 18. The write-in mechanism is provided with a continuous paper write-in tape 91 fed from a supply roll 91*a* and stored by a take-up roll 91*b*, the rolls 91*a*, 91*b* being handled by the mechanism to be subsequently discussed with reference to FIGS. 13–16. The rolls 91*a*, 91*b* are stored in a write-in paper bin which is closed by cover 93 when in its lowered position. A write-in mechanism cover panel 94 includes a write-in window aperture 90 which is opened and closed by a motor-driven shutter 95. When the shutter 95 is in an opened condition this allows a voter to directly write on to the exposed portion of paper tape 91 a write-in vote selection. Opening and closing of the motor-driven shutter 95 is regulated in part by the earlier discussed write-in vote switch pad 49 having located above it a pair of light-emitting diodes 49*a* wired in series and functioning as a light illuminating enunciating means to provide visual feedback to a voter that the write-in mechanism is available for operation.

Figure 7:
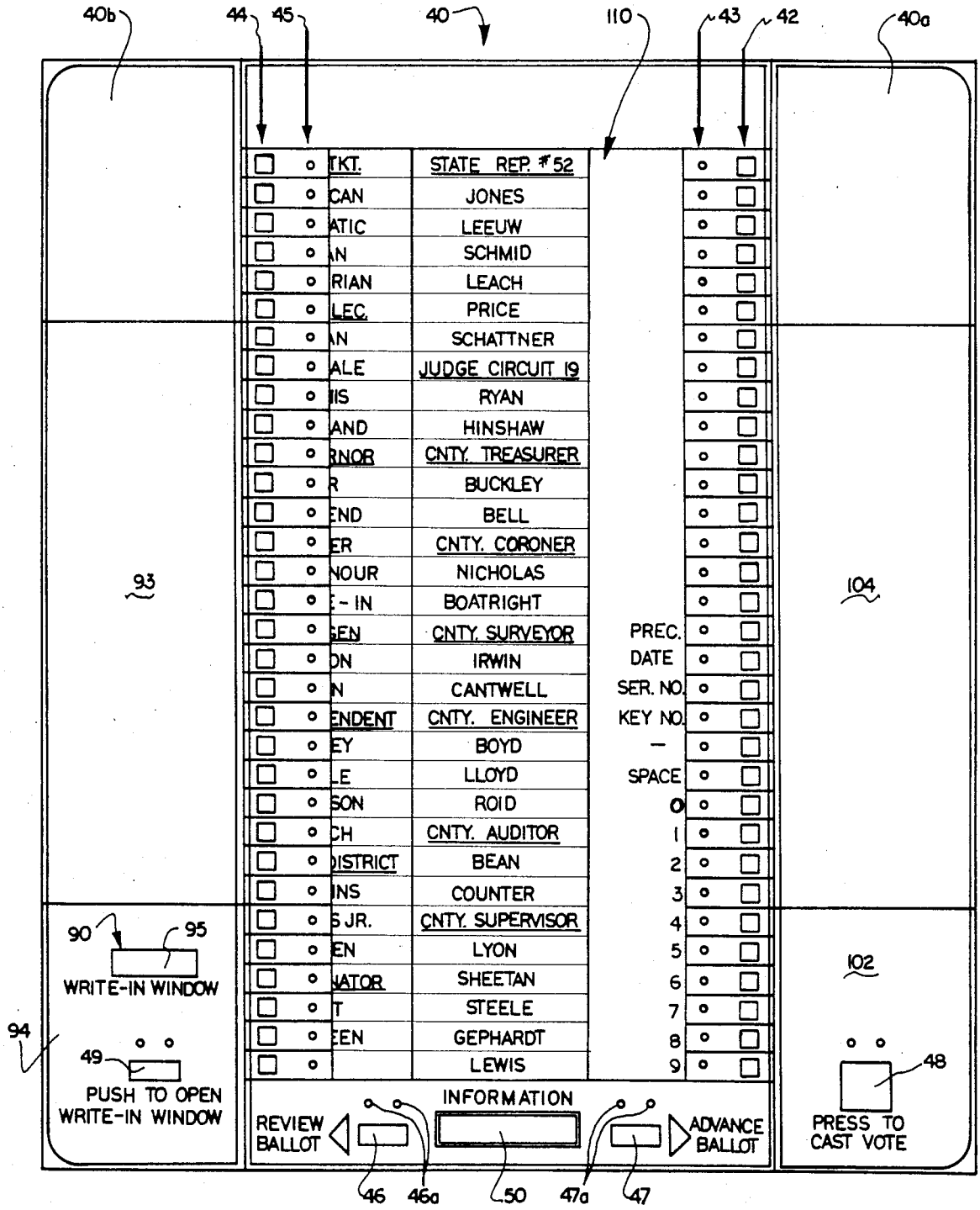
FIG. 7 is a plan view of a voting panel of the voting machine as it would appear during part of a voting machine set-up mode prior to an election.

With reference to FIG. 7, the voter control panel 40, as it would appear during the initial set-up of the voting machine is illustrated. As shown, the flexible elongated web 110 carried by the motor-driven scrolling mechanism discussed earlier has been indexed slightly leftward by the electronic control means so that the programming indicators (see FIG. 6) are aligned in adjacent relationship to the bottom sixteen pushbutton switches of the thirty-two pushbutton switches constituting the right vertical ballot button array 42. It can also be seen that the bottom sixteen light-emitting diodes of the thirty-two light-emitting diodes constituting the array of light indicating means 43 is also adjacent to the programming indicators. With the voting machine in the illustrated set-up programming mode, the bottom right sixteen pushbutton switches are used to enter the precinct number of the voting district, the date, the serial number of the particular voting machine, and other identifying or programming information. The bottom ten of the sixteen set-up function switches are used in effect as a numeric keyboard to program the electronic voting machine. It should be noted that, while in FIG. 7, cover panels 40*a*, 40*b*, 93, 104, 94, 102 are shown in their closed positions, during such set-up programming mode the covers 93 and 104 would be raised to allow access to other programming switch means of various types.

With further reference to FIG. 7, it also can be seen that the control panel 40 has printed upon it appropriate wording to prompt a voter and assist him in operating the voting machine. For example a "press to cast vote" indication is associated with the register switch 48 while a "push to open write-in window" indication is associated with switch 49 for controlling the write-in window. Also, an "advance ballot" indicator is associated with switch 47 for rightward scrolling of the ballot carrying web 110 while a "review ballot" indicator is associated with switch 46 to indicate leftward scrolling of the web 110. A "information" indicator associated with the liquid crystal display 50 indicates to the voter useful information such as for example the page number or field number of the ballot portion being presented or why a particular button or switch is not operating as expected by the voter. The LCD display 50 is also used to convey programming instructions during the set-up mode as well as diagnostics for troubleshooting.

Figure 8:
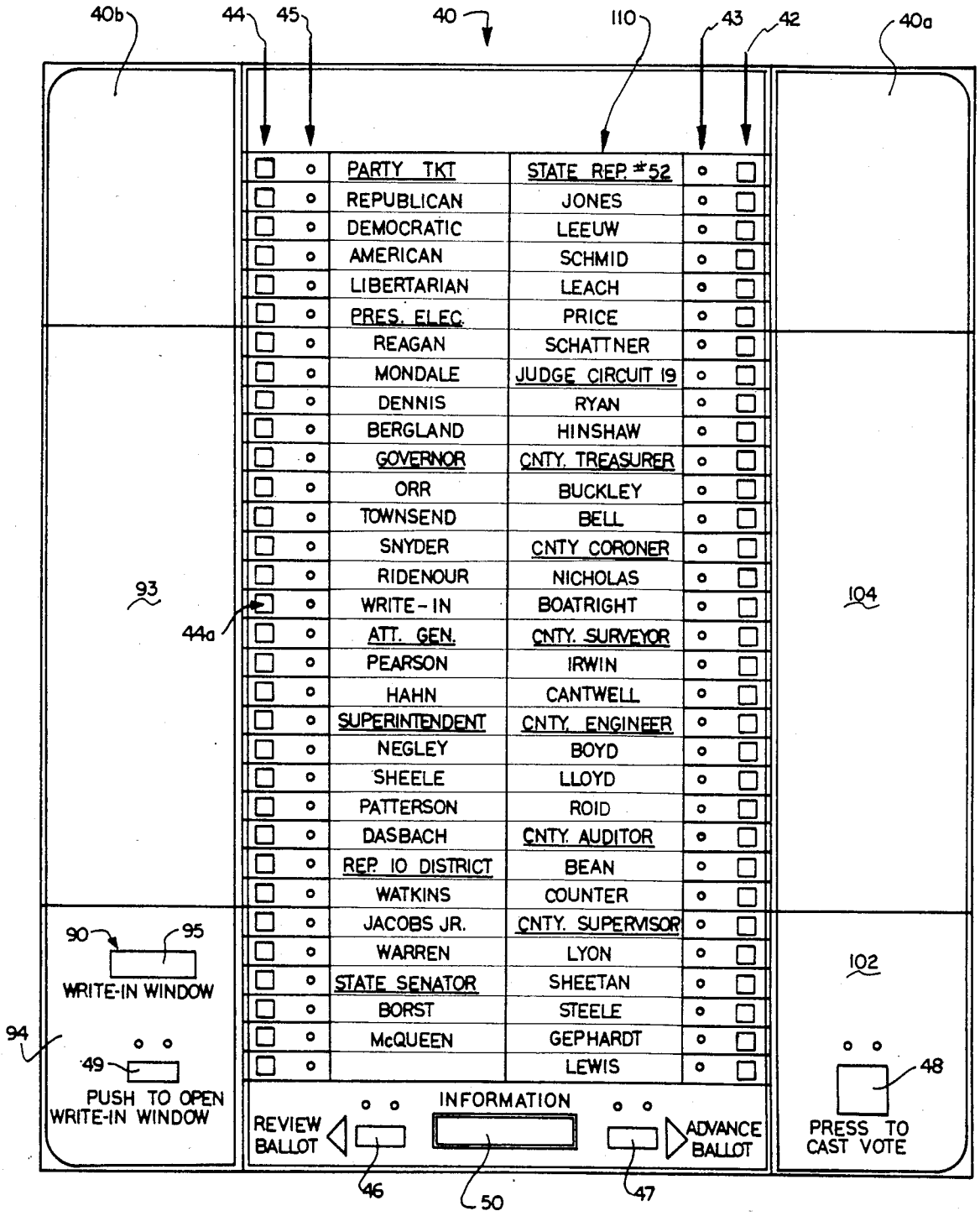
FIG. 8 is another plan view of the voting control panel as it would appear during part of the election vote casting mode.

Turning to FIG. 8, the web 110 has been indexed or scrolled slightly to the right so that, for example, the fourth ballot field comprising ballot sheets 1A and 1B (see FIG. 6), is presented. Further rightward scrolling, by use of advance scrolling switch 47, would display the other three ballot fields. It can be seen that one of the switches of either ballot button array switch columns 42 or 44 are each aligned with corresponding ballot selections or voter selections indicated on the viewable portion or field of the ballots. As will be apparent to those in the art, up to sixty-four voter selections can be made for each of the four ballot fields presentable by the scrolling mechanism so that a total of two hundred and fifty six voter selection indications can be presented to a voter. Thus, the voting machine in accordance with the present invention has a very high capacity for handling a plethora of selections relating to numerous candidates or voting issues. It can also be seen that by use of the earlier discussed judge's panel, a voter can be limited as to whether he can view all or only a selected number of the four ballot fields available. It can also be seen that a voter functionally interacts with the voting machine of the present invention in a traditional manner in that conventional paper ballots can be utilized with vote indicating means in the form of pushbutton switches and enunciators associated with each voter selection indicated on the ballot.

With further reference to FIG. 8, the voter makes his selections using the switches in ballot button arrays 42 and 44. When the voter depresses a switch in column 42 or 44 associated with a write-in selection (such as switch 44*a*) he then pushes switch 49 to open the shutter 95 and then writes in his vote selection. The voter would then continue to make vote selections using the switches of columns 42, 44 with the write-in shutter 95 automatically closing until the voter for example would choose to write-in another vote wherein the opening and closing of the write-in window would be repeated. After the voter has effected all of his selections in connection with the ballot field then being presented he depresses the advance ballot scrolling switch 47 wherein the scrolling mechanism would present another requested ballot field to the voter (presuming the request was valid) who would repeat the vote selection and possibly the vote write-in process as discussed above. After the voter has made all of his vote selections available to him he may, for example, depress the scrolling switch 46 to review his selections. In doing so, the light-emitting diodes of columns 43, 45 will light up in a pattern to indicate the votes already selected by the voter for that ballot. If the voter is satisfied in reviewing his vote selections for the various ballot fields presented by the scrolling mechanism to the voter he will then depress the vote casting switch 48 wherein the voting process for that voter will be completed and the voting machine will be readied for selections by a subsequent voter.

It is to be recognized that the above description of the voting process is generalized in nature and that one skilled in the art will readily recognize that various voting scenarios can be effected with the electronic voting machine as thus far disclosed. For example, in the case of a primary election each of the four fields may be dedicated to one voting party. For example, the first ballot field may contain only Democratic candidates while the second ballot field may contain Republican candidates, the third ballot field containing Libertarian candidates and the fourth ballot field containing other political party candidates. Thus, by use of the judge's panel 20, as discussed earlier with regard to FIG. 1, a non-voter such as a voting official can precondition the voting machine 10 so that the scrolling switches 46, 47 will be predeterminably ineffective thus precluding the voter from viewing those ballots on which he is not entitled to vote. Further detail with regard to the functional operation the vote selection and recordation process will be discussed subsequently with regard to FIGS. 22 through 34.

Figure 9:
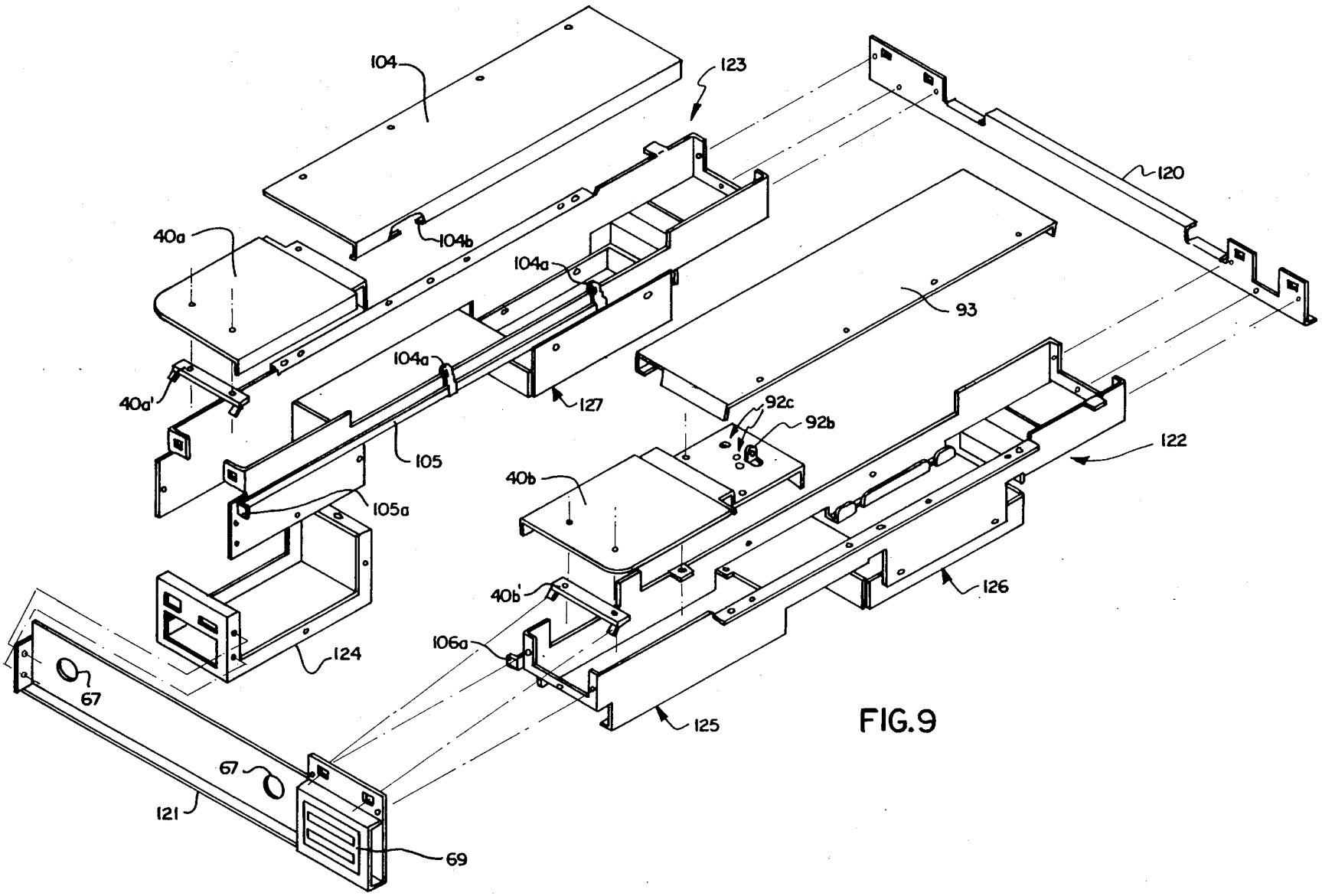
FIG. 9 is an exploded right rear perspective view of structural components of a main frame of the voting machine.

Turning to FIG. 9, primary structural components of the main frame of the electronic voting machine are illustrated in exploded form from a right rearward perspective view. A main frame front cross piece 120 is connected as illustrated to one end of a left main frame chassis 122 and to a corresponding one end of a right main frame chassis 123. A main frame rear cross piece is connected to the rearward end of the left main frame chassis, 122 while the right end of the main rear cross piece 121 is connected to the left rear corner of the rearward end of the right main frame chassis 123 which in turn is connected to a power supply chassis 124. The left main frame 122 contains an electronic control board bin 125 and a write-in paper bin 126. In a similar manner the right main frame chassis 123 contains an audit printer paper tape bin 127. The power supply cover plate 40*a* has mounted to its rear portion a locking tab support member 40*a'* having a pair of spaced apart tabs that are received into apertures at the rear end of the right main frame chassis 123 as illustrated. The tabs extending from member 40*a'* lock into the associated apertures to hold down the cover 40*a* at its rear end. The cover 40*a* has its front end locat.de beneath an overhanging portion of the hinged paper bin door 104 mounted by appropriate hinge means to the outside edge of the right main frame chassis 123 as illustrated.

The earlier discussed door release push rod 105 is more clearly illustrated in FIG. 9 and includes a release tab 105*a* that is engaged by an implement such as the finger of a voting official inserted via the left access aperture 67 wherein the rod 105 is pushed towards the main front cross piece 120. This forward movement causes the latches 104*a* to disengage from the keeperlike lip 104*b* of the audit paper bin door 104 to allow it to open as discussed earlier. In a similar manner a door release tab 106*a*, associated with the write-in paper tape bin door 93, is also engageable via the right aperture 67 in crosspiece 121 so that the associated push rod (not illustrated) carrying paper bin door latches 106 (see FIG. 5) can be slid forward to release the cover 93. This permits the cover 93 to be pivoted about its outer edge which is hinge connected to the left main frame chassis 122 so as to open to the position shown in FIG. 5.

FIG. 9 also illustrates the electronic control circuitry cover panel 40*b* discussed previously. The panel 40*b* has connected to it at its rearward end a locking tab member 40*b'* having a pair of locking tabs that are inserted into the apertures illustrated at the top right end of the main rear cross piece 121. Thus, the electronic control circuitry cover panel 40*b* has its rear end held in position via the tabs of member 40*b'*. The front end of the cover 40*b* is located beneath an overlapping portion of the bin access door 93 locked in its closed position by the spring biased push rod mechanism described earlier herein. It should be noted that the forward end of the electronic control circuitry cover panel 40*b* as illustrated in FIG. 9 includes an aperture forming a vertically extending punched out tab 92*b* that can extend through a slot 92*a* (see FIG. 5) in the memory cartridge cover 92. With the cover 92 in its lowered position, and with the tab 92*b* (see FIG. 9) extending through the slot 92*a* of the cover 92, a wire type tamper indicating seal can be inserted through the aperture of tab 92*b* to in effect lock the metal cover 92, down in a position to retain the memory cartridge in proper position and protect it from physical tampering. The forward end of the cover panel 40*b* can also provide mounting apertures 92*c* means for a plurality of electronic control switches which can be actuated by a programmer when the cover 93 (see FIG. 5) is in a raised condition during set-up programming of the voting machine prior to an election.

It is to be noted that with regard to FIG. 9 the write-in mechanism cover panel 94 and its associated underlying write-in printer mechanism, as well as the audit printer cover panel 102 and its underlying audit printer mechanism 100, have not been illustrated since they constitute modular plug-in type units. These units, like the cover panels 40*a*, 40*b* illustrated in FIG. 9, are held in position by use of extending tabs that fit into the illustrated slots at the upper ends of member 120 and by other suitable releasable fastening type means.

A clearer understanding of the structural components of the window panel assembly 70 discussed earlier can be had by reference to FIG. 10. The uppermost portion of the window panel assembly 70 is constituted by a rectangular ballot bezel 74 which has as indicated a plurality of apertures for receiving the various pushbutton switch components, light-emitting diode components, and other voting machine control panel components. Underlying the longitudinal sides of the ballot bezel 74 are a pair of membrane switch circuit boards 75 of a conventional type, the circuit boards each supporting thirty-two elastomeric buttonlike members, providing tactile feedback, that extends through the corresponding switch apertures in the ballot bezel 74. The pair of membrane switch boards 75 are sandwiched between the ballot bezel 74 and an underlying ballot frame 76 that only contains apertures for the information display 50 and for the light-emitting diodes associated with each of the switches carried by the pair of membrane switch circuit boards 75 and for the scrolling switches 46, 47 discussed earlier but not illustrated in FIG. 10. Underlying the ballot frame 76 is a first elongated circuit board 77*a* having its upper end as viewed, in FIG. 10, electrically connected to the left end of a second elongated circuit board assembly 77*b* which in turn is electrically connected at its right end to the upper end of a third elongated circuit board assembly 77*c*. Each of these boards 77*a*, 77*b*, 77*c* carry the required light-emitting diodes and a plurality of multiplex input and discrete drive circuitry in the form of conventional integrated circuit "chips" (not illustrated) for providing to and receiving from the programmable electronic control means, vote selection information. The circuit board assembly 77*b* also supports the liquid crystal display information panel 50. A bottom frame cover 79*a*, a right side frame cover 79*b* (supporting earlier discussed locking plate 72—see FIG. 5), a left side frame cover 79*c* (supporting earlier discussed locking plate 71) and a ballot frame hinge bracket 79*d*, are connected together using conventional means to constitute a rectangular frame for supporting a ballot display glass panel 78 and the other components illustrated in FIG. 10. It is to be noted that the elongated membrane switch panels 75 and the three modular circuit board assemblies 77*a*, 77*b*, 77*c* are interconnected together by appropriate multiconductor ribbonlike cables, as are various electronic components of the voting machine of the present invention, such conventional wiring cables not being illustrated in detail to simplify the drawings. It is also to be noted again that the various integrated circuit packages and other discrete electronic components carried on the circuit boards 77*a*, 77*b*, 77*c* have not been illustrated in detail since they are conventional in nature for providing multiplexed signals indicative of switch actuation information, and diode illumination signals, such multiplexing techniques and associated discrete drive circuitry being well within the knowledge of one skilled in the art.

Figure 11:
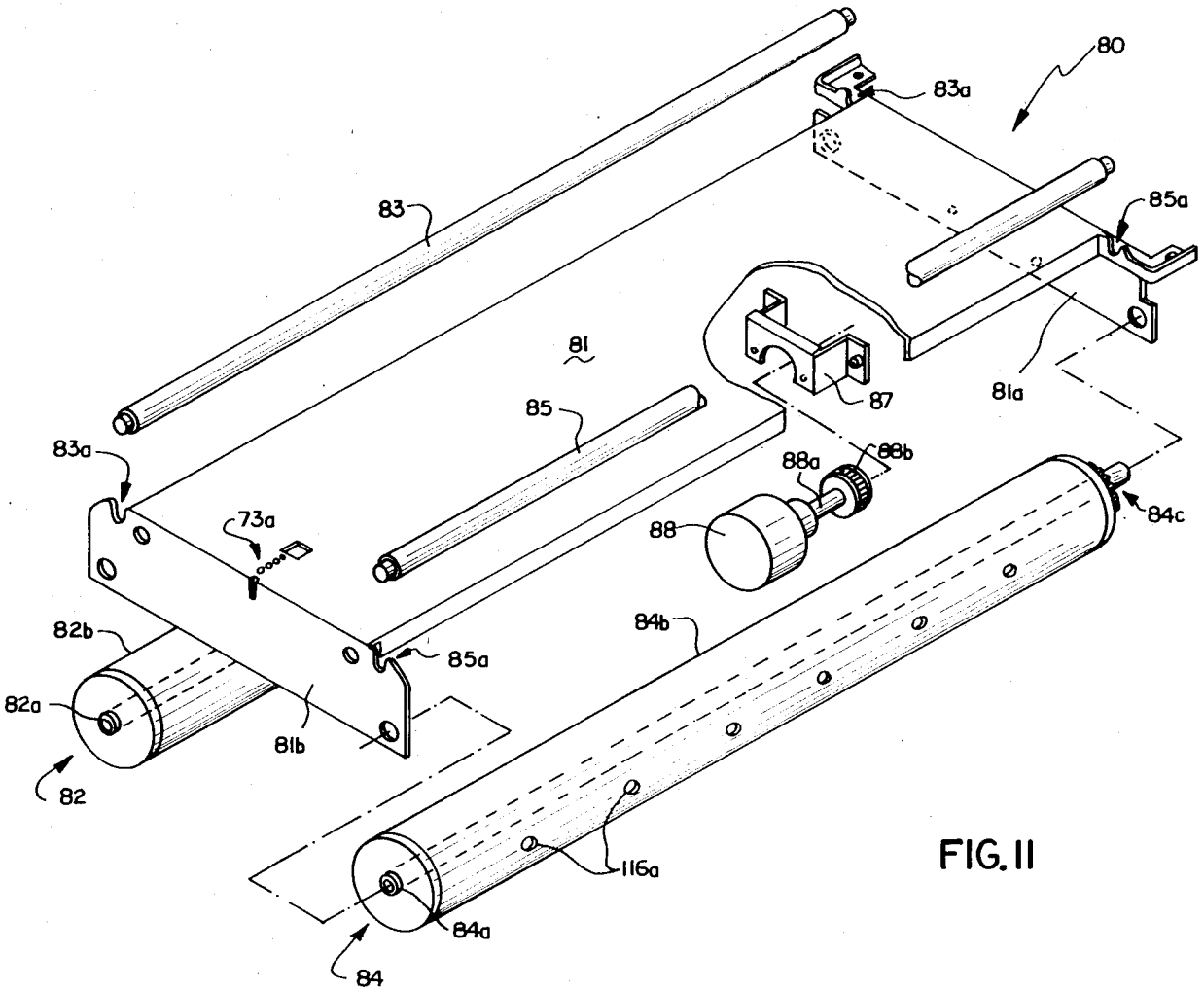
FIG. 11 is an exploded right rear perspective view of structural components of a motor-driven scroll mechanism of the voting machine.

Turning to FIG. 11, the earlier discussed motor-driven scrolling mechanism 80 can be seen to include a scroll support frame 81 in the form of an elongated, web supporting, rectangular tray or plate having at its front end (top end, as illustrated in FIG. 11) a downwardly extending front support bracket 81*a*, and at its other end a downwardly extending rear support bracket 81*b*. At the rear end of the scroll support frame 81 there is illustrated the other portion 73*a* of the optical detector means 73 discussed earlier in connection with FIG. 5. The infrared light-emitting diodes of detector portion 73 (see FIG. 5) shine infrared radiation through the transparent top edge portion of the web 101 (see FIG. 6) toward four infrared detecting transistors or the like (not illustrated) which are positioned in aligned relation below the four light receiving apertures in frame 81 shown at 73*a* as illustrated in FIG. 11. As the optically detectable indicia 113*a*–113*d* (see FIG. 6) interrupt the transmission of light from detector portion 73 (see FIG. 5) to detector portion 73*a*, as shown in FIG. 11, a web identification and position indication signal is provided by associated photo transistors to the electronic control means as will be subsequently discussed.

With further reference to FIG. 11, the scroll mechanism 80 also includes a first web guide rod 83 rotatably supported at its ends by a pair of rounded bottom slots 83*a* in which the reduced diameter end portions of the first web guide rod 83 rotatably ride. In a similar fashion, a second web guide rod 85 (with portions cut away) has reduced diameter ends that rotatably ride in a pair of rounded bottom slots 85*a* provided by the top edges of the front and rear end frame portions 81*a*, 81*b*. The rods 83, 85 supports the flexible web as it rides back and forth across the scroll support frame 81, the rods 83, 85, acting as idler rollers, minimize frictional drag, caused by its engagement with the frame 81, on the web as it is transferred between the rollers 82, 84. With reference to roller 84, it includes an elongated spindle 84*a* on which is fixed a scroll drum 84*b* having a plurality of apertures or perforations 116*a* along its length which are alignable with the perforations 116 at the left end of the web substrate 111 illustrated in FIG. 6. Suitable buttonlike fastening means are inserted through the perforations 116 of the web substrate 111 of FIG. 6, and the perforations 116*a* in the scroll drum 84*b* so that one end of the web 110 is fixed to the scroll drum 84*b*. A toothed pulley 84*c* is connected and fixed to the rightward or front end of the roller 84 as illustrated so that the spindle 84*a* the scroll drum 84*b* and the pulley 84*c* rotate as a unit with the ends of the spindles being rotatably received in axially aligned bushing type apertures provided by the frame portions 81*a*, 81*b* as illustrated.

In a similar manner, the first roller 82 includes an elongated central spindle 82*a* upon which is coaxially mounted a scroll drum 82*b*. At that end of the roller 82 not illustrated in FIG. 11, there is another toothed driven pulley similar to pulley 84*c* discussed with regard to the second roller 84. The interconnection of the spindle 82*a*, the scroll drum 82*b* and the associated toothed driven pulley constituting components of the first roller 82 will be discussed in greater detail with regard to FIG. 12.

With further reference to FIG. 11, an electric motor support bracket 87 is mounted to the central portion of the front support bracket 81*a* of the scroll support frame 81. A bidirectionally rotational electric motor 88 having a drive shaft 88*a* on the distal end of which is fixed a toothed drive pulley 88*b* is mounted as a unit to the bracket so that the drive pulley 88*b* and the driven pulleys carried on the ends of the rollers 82, 84 lie in a generally common plane.

Figure 12:
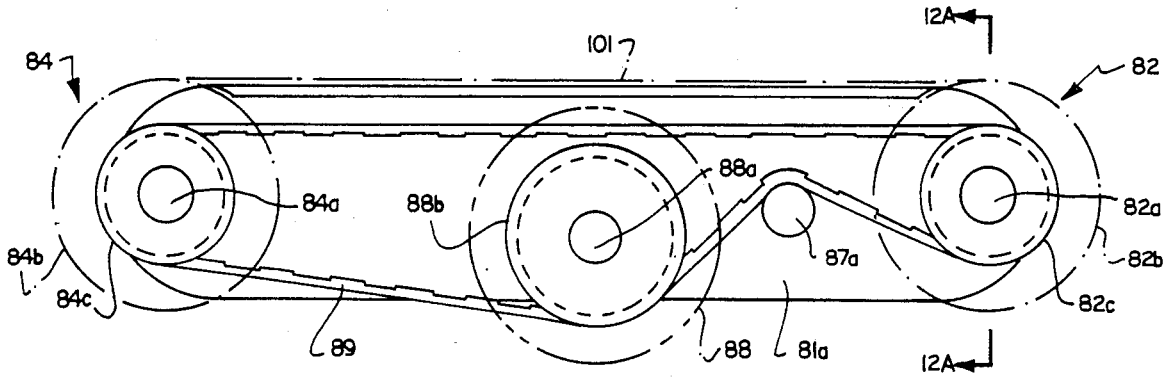
FIG. 12 is a schematic fron elevation view of the scroll mechanism of FIG. 11.

With reference to FIG. 12, an endless belt means in the preferred form of a toothed timing type belt 89 is looped over the ends of the rollers 82, 84 as illustrated, i.e. the timing belt engages a toothed driven pulley 82*c* fixed to the end of the spindle 82*a*, while in a similar manner the belt 89 engages the toothed driven pulley 84*c* fixed to the spindle 84*a* and/or the scroll drum 84*b* as illustrated. A mid-portion of the belt 89 also drivingly engages the toothed drive pulley 88*b* which can be rotated in either a clockwise or counterclockwise direction by the motor 88 in accordance with the demands of the electronic control means to be discussed. To place the belt 89 in tension so as to ensure its continuous engagement with the pulleys 82*c*, 84*c*, 88*b*, and to allow for the use of different length timing belts, an idler roller 87*a* is appropriately positioned and rotatably mounted to the front frame support 81*a* as illustrated.

With reference to FIGS. 11 and 12, it can be seen that the scroll mechanism has a pair of spaced apart juxtaposed rollers 82, 84 that are rotatable on parallel axes. The flexible elongated web 110 (carrying printed ballot material) has a tension portion 86 (see FIG. 5) extending between the rollers, the means for providing such tension force to be illustrated with reference to FIG. 12A. The web 110 is wound onto one roller when both rollers 82, 84 simultaneously rotate at the same general rate in a clockwise direction, the web being wound onto the other roller when both of the rollers 82, 84, by means of the bidirectional electric motor 88, simultaneously rotate at the same general rate in a counterclockwise direction. It can be seen that the scroll drive means, in the form of the electric motor 88, is mechanically connected to both of the rollers via a suitable belt means in the preferred form of toothed timing belt 89 wherein the motor means, when energized simultaneously rotates both rollers. To maintain that section of the flexible web extending between the rollers 82, 84 in tension at any given time, a spring means is mounted on at least one of the rollers and is rotatable with it, the spring means being prewound to a predetermined fixed degree to apply to a portion of said one roller, a generally constant torsion force tending to rotate said one roller portion on its axis of rotation in a direction that will apply a generally constant tension force to said extended web portion, as both of said rollers simultaneously rotate in clockwise or counterclockwise directions, the tension force being generally independent of the force required to simultaneously rotate the rollers by means of the electric motor means.

Figure 12A:
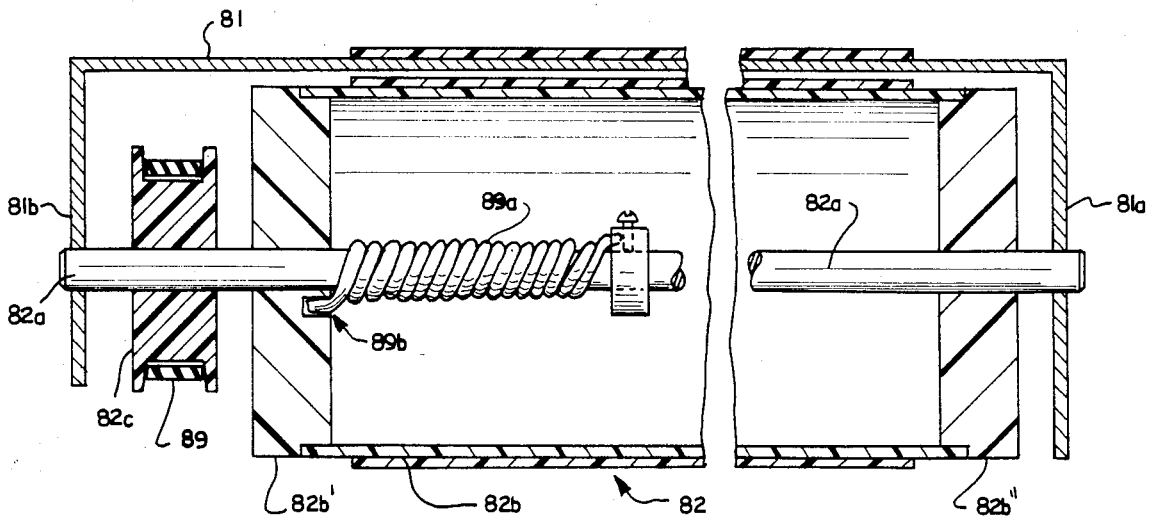
FIG. 12A is a cross-section view along line A—A of FIG. 12 illustrating one of the rollers forming a unique web-tensioning part of the scroll mechanism illustrated in FIGS. 11 and 12.

A preferred tensioning mechanism is illustrated with particular reference to FIG. 12A. It can be seen that the downwardly extending front end and rear end frame portions 81*a*, 81*b* act as bushing support means for the ends of the spindle 82*a*, the spindle 82*a* rotatably carrying the scroll drum 82*b* having end cap portions 82*b*′ and 82*b*″ as illustrated. It is to be noted that the scroll drum 82*b* with its end cap portions 82*b*′ and 82*b*″ is freely rotatable on spindle 82*a* but for a torsional biasing force provided by an elongated torsion spring 82*a* having, as illustrated in FIG. 12A, its right end fixed to the spindle 82*a* with its left end being fixed to the left scroll drum end cap 82*b*′ by means of inserting a projecting end 89*b* into a blind bore in end cap 82*b*′ as illustrated. Preferably, the torsion spring 89 is formed of wire helically wound about a length of the spindle as illustrated to provide equal diameter turns adjacent to each other.

As will be recognized by those skilled in the art, with the spindle 82a held in a fixed position, the scroll drum 82b can be manually rotated in a counterclockwise direction (see FIG. 12) to in effect wind up the spring 89a so that a torsion force or biasing force will be provided tending to rotate the scroll drum 82b in a clockwise direction. With the scroll drum 82b in such a prewound condition, the other end i.e. the right end of the web 110 (see FIG. 6) having its associated perforations 116 is attached to the scroll drum 82b which includes perforations similar to the perforations 116a discussed earlier with regard to FIG. 11. Thus, due to the torsional force provided by the spring 89a, the scroll drum 82b as viewed in FIG. 12 will tend to rotate clockwise to apply a tension force to that portion of the web 101 extending between the rollers 82, 84. This tension force will remain relatively constant since as the motor 88 rotates the drive pulley 82c in either direction the spring 89a, as a unit, will rotate with roller 82. In other words, the spindle 82a, the drum 82b, the driven pulley 82c, and the prewound torsional spring 89a rotate as a unit, since the spring means 89a is mechanicallly connected between the spindle 82a and the scroll drum 82b wherein any rotational force supplied to the spindle by the motor means is applied to rotatably drive the scroll drum primarily via the spring means 89a. It can also be recognized that the tension force provided on the web by spring 89a is generally independent of the force required to simultaneously rotate both of the rollers 82, 84 by means of the electric motor means 88. It is to be recognized that nontoothed pulleys and a nontoothed belt could be used to drive the rollers 82, 84 however it is preferable to use tooth pulleys and a toothed timing belt to provide a positive driving action. It is also to be noted that the idler roller 87a could be eliminated if a timing belt of the exact size needed was provided. However, it is preferable to provide the idler roller 87a so that it provides a force tending to positively hold the belt against the driven pulleys 82c, 84c and the drive pulley 88b to ensure positive driving of the scrolling rollers 82, 84.

With reference to FIGS. 13 through 16, a web handling mechanism 130 for feeding to a device, such as a printer, and then taking up from it a web material, such as a paper tape, transferred via the device from a supply roll rotatably supported by the mechanism to a take-up roll also rotatably supported by the mechanism will now be discussed. With reference to FIG. 5, a first web handling mechanism to be discussed is used to carry the supply roll 91a and take-up roll 91b associated with the earlier discussed write-in mechanism. A second web used to carry a supply roll 101a and a take-up roll 101b for ptoviding the audit trail paper tape 101 to printer mechanism 100. With further reference to FIG. 9, the web handling mechanisms (right and left hand versions that will now be discussed) are provided as a pair one of which is mounted within the write-in printer paper bin 126, the other being mounted in the audit printer paper bin 127. The web handling mechanism is movable in an articulated manner so that it can be manually lifted up out of the bins 126, 127 to facilitate the insertion and removal of the write-in printer tape 91 and the audit trail paper tape 101 into the electronic voting machine as thus far discussed.

Figure 13:
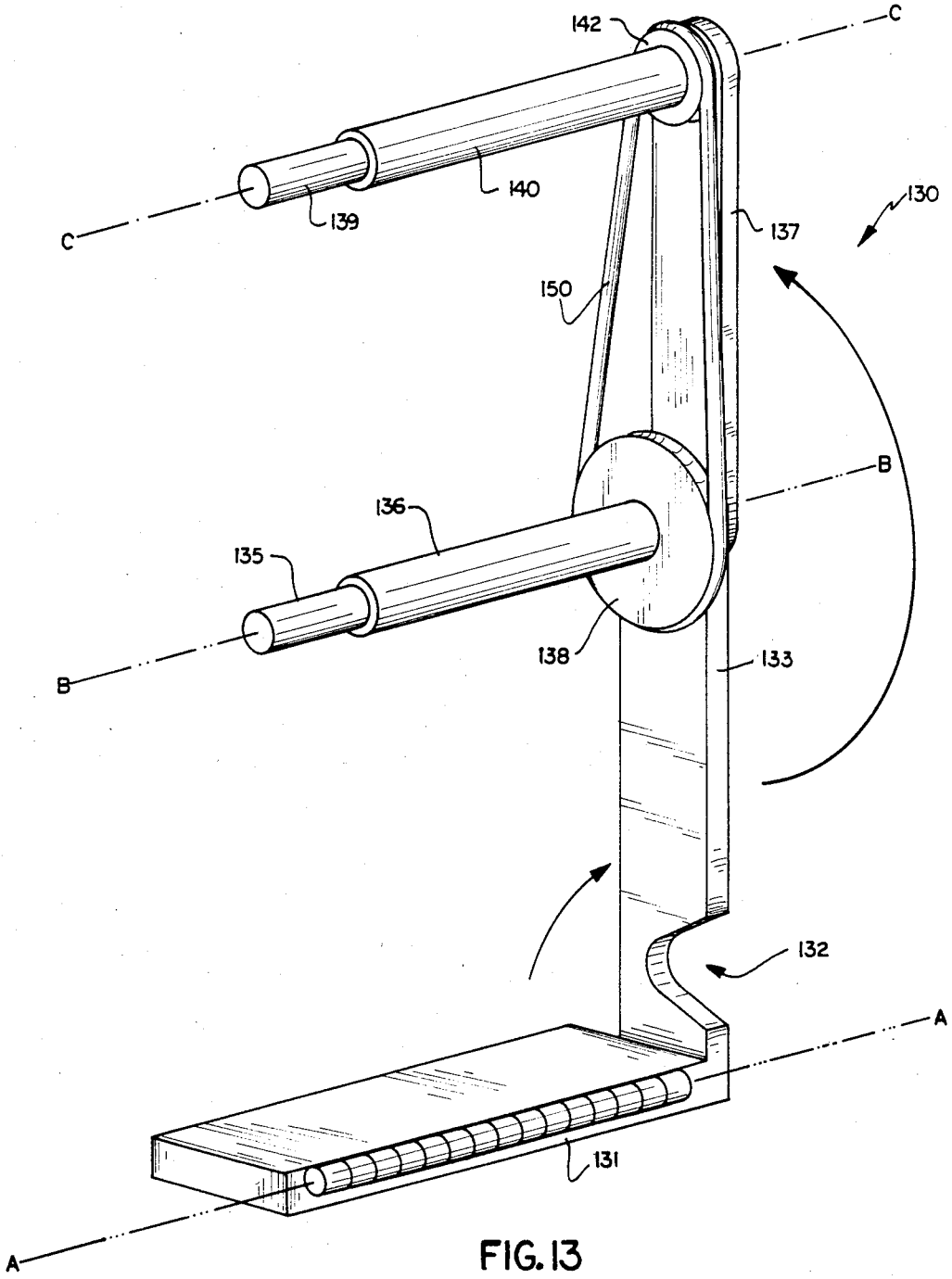
FIG. 13 is a perspective view of a web handling mechanism useful for supplying and taking-up paper tapes to a pair of printers forming a part of the voting machine.

With particular reference to FIG. 13, the web handling mechanism 130 is shown, in its left handed version for use in bin 126 (see FIG. 11) in perspective view apart from the voting machine thus far described. The web handling mechanism 130 can be seen to include a hinge mounted flange end 131 that can rotate about axis AA. Extending perpendicularly upwardly or away from the right end of the hinge mounted end 131 is a supply roll support means in the form of a first elongated bracket 133 having in its lower portion a recess 132, the function of which will be subsequently discussed. At the distal or upward end of the first elongated bracket 133 there is fixed to and extends perpendicularly leftwardly or away from the bracket 133 a first elongated spindle 135, the rightward end of the spindle 135 extending through the top end of the first elongated bracket 133 to provide a hinge pin that pivotally receives the lower end of a take-up roll support means in the form of a second elongated bracket 137 wherein the bracket 137 can pivotally rotate on and revolve about axis BB along which the first elongated spindle 135 lies the pivotal connection between the brackets 133, 137 constituting a pin joint. Extending leftwardly or away from the top end of the second elongated bracket 137, in perpendicular fashion, is a second elongated spindle 139 having its right end fixed to the top end of the second elongated bracket 137 as illustrated. Preferably, the right end of the spindle 139 is welded to the top end of the bracket 137 while the spindle 135 is welded to the top end of the bracket 133, the rightward end of the spindle 133 as noted earlier extending through an aperture in the bottom end of bracket 135 to provide for a pin joint connection between brackets 133 and 137. It can be seen that axis AA is parallel to axis BB along which spindle 135 lies, and is parallel to axis CC along which spindle 139 lies.

A supply roll support spool 136, in the form of a tube, having fixed to its right end (as viewed in FIG. 13) a supply spool pulley 138 is slid over the distal end of the spindle 135 to the position shown. In a similar manner, a tubular elongated take-up spool 140 having fixed to its right end a take-up spool pulley 142 is slid over the distal end of the spindle 139 to the position illustrated. It can be seen that the diameter of the supply spool pulley 138 is greater than the diameter of the take-up spool pulley 142, preferably the ratio of the diameter of the supply spool pulley 138 to the take-up spool 142 being approximately 2:1. An endless drive belt of the elastomeric type extends between, and loops over or rides, the pulleys 138, 142 so that rotation of spool 136 at a first rate will cause rotation of spool 140 at a greater rate due to the differential diameters of the pulleys 138, 142. More specifically, for the noted preferred ratio, a rate of rotation of the take-up spool 140 will be approximately twice as great as the rate of rotation of the supply spool 136. The belt 150 is tensioned to a predetermined degree so that drag forces placed on either spool by for example a paper tape web being wrapped onto or pulled off of the respective spools 140, 136 will cause the belt 150 to slip in a desired manner on either or both of pulleys 138, 142.

The web handling mechanism 130 as illustrated in FIG. 13 is shown in its expanded condition or in a condition wherein the standard rolls of paper tape can be placed onto the supply spool 136 or can be taken off of the take-up spool 140. In its normal paper feeding and taking up condition the second elongated bracket 137 is pivoted about axis BB such that its distal end portion carrying take-up pulley 142 is received into the recess 132 as will become apparent with regard to FIGS. 14, 15 and 16.

Figure 14:
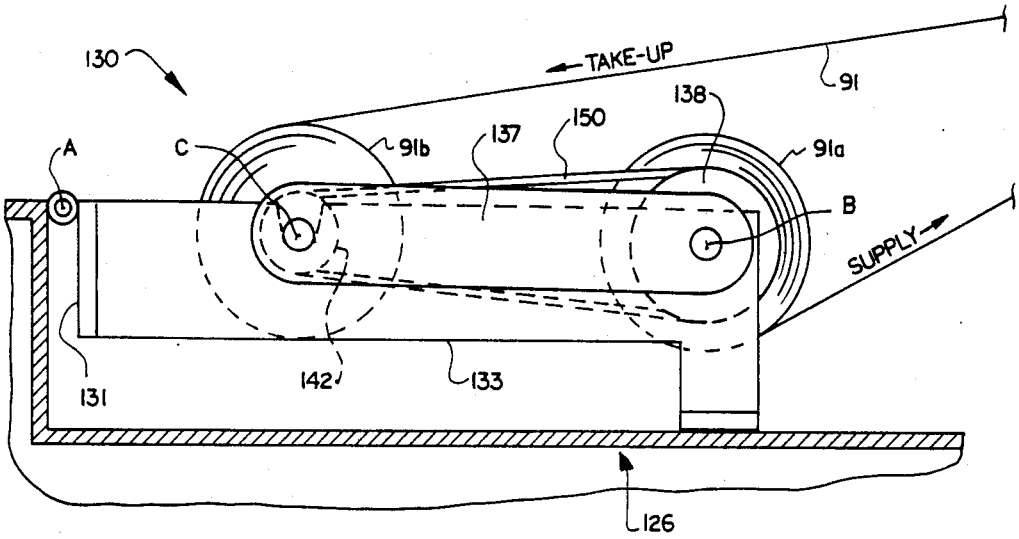
FIGS. 14–16 illustrate various positions of the web handling mechanism of FIG. 13 when forming a part of the voting machine.
Figure 15:
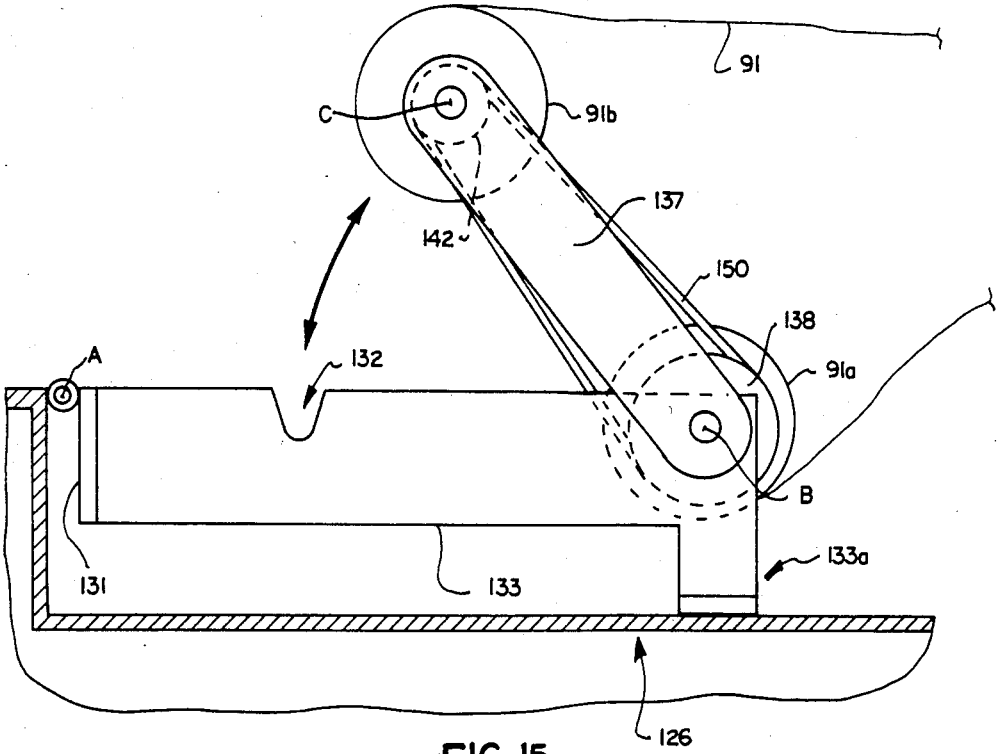
Figure 16:
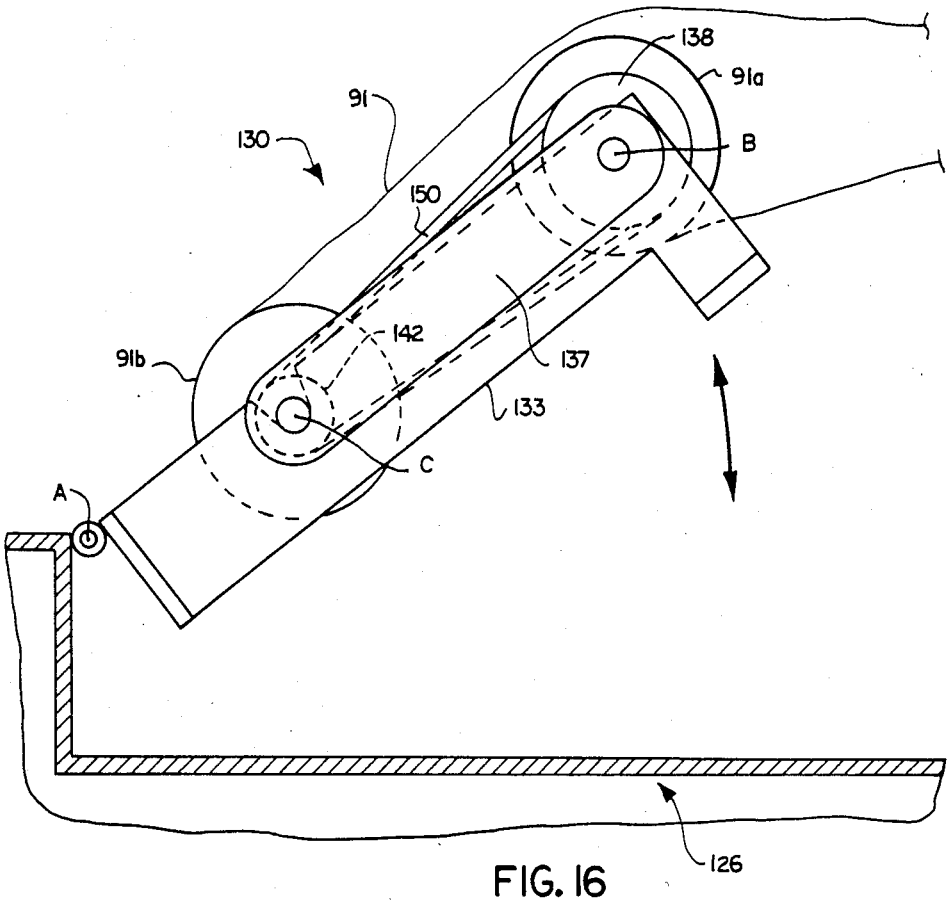

With reference to FIGS. 14–16, the web handling mechanism 130 is shown in a mounted position in relation to the earlier discussed write-in printer paper bin 126 (see FIG. 9) it being recognized that the mechanism 130 would also be used in the audit printer paper bin 127 (see FIG. 9) it being further recognized that left hand and right hand versions of the mechanism 130 would be provided respectively for the left side and right side main frame chassis 122, 123 as discussed earlier with reference to FIG. 9.

With specific reference to FIG. 14, it can be seen that the web handling mechanism 130 is positioned within the bin 126 in its normal paper feeding and taking up position. Axes AA, BB and CC are shown respectively at indicated points A, B, and C. It can be seen that the take-up roll 91b is in position between axis point A constituting the hinge axis about which the web handling mechanism 130 as a whole can pivotally move upwardly as will be illustrated. As the motor driven write-in printer mechanism pulls paper from the supply roll 91*a* the supply spool pulley 138 will rotate thus driving belt 150 which will in turn rotate the take-up roll 91*b* wherein it will collect write-in paper 91 from the write-in window mechanism with its printer as will be subsequently illustrated with regard to FIGS. 17 and 18. It will be recognized that initially the diameter of the supply roll 91*a* will be substantially greater than the diameter of the take-up roll 91*b* as is the case at the beginning of an election wherein only a few inches of write-in paper have been wound onto the take-up spool 140 (see FIG. 13). Due to the large diameter of the supply pulley 138, the take-up spool 142 will rotate at a faster rate necessary to take-up the write-in paper tape 91. As the diameter of the supply roll 91*a* decreases and the diameter of the take-up roll 91*b* increases, the rate of rotation between the pulleys 138, 142 and their respective spools 136, 140 will vary due to the varying slippage of the belt 150 on the pulleys as discussed earlier with regard to FIG. 13. Thus, the different diameter pulleys 138, 142 and the slipping endless drive belt 150 comprise a differential drive which will in general maintain the paper extending between the roll 91*a* and the take-up roll 91*b* in tension. It can be seen that the degree of slippage is determined by the drag forces applied to either of the spools 136, 140 (see FIG. 13) by the paper tape rolls which they are handling.

With reference to FIG. 15, it can be seen that bracket 133, supported at its distal end by, for example, a pedestal 133*a*, can be maintained in position within bin 126 while bracket 137 can be pivotted upwardly about axis point B so that the take-up roll 91*b* of the write-in paper 91 can be slipped off the distal end of the spool 140 (see FIG. 13). In such a position, that end of the bracket 137 supporting the take-up spool 142 is manually lifted up out of the recess 132 it being noted that the distance between axis point B and axis point C remains constant so that the tension on the belt 150 remains the same i.e. the belt 150 will not disengage from either of the pulleys 138, 142. After the take-up roll 91*b*, carrying election information, is removed, the take-up end of the paper tape 91 can be wrapped around and fixed to spool 140 and bracket 137 is returned to its position shown in FIG. 14 wherein another take-up roll 91*b* can be created as paper is drawn from the supply roll 91*a*.

Turning to FIG. 16, it can now be seen that the web handling mechanism 130 as a whole has been pivotally moved upwardly about axis point A out of bin 126 to permit access to the supply roll 91*a* so that it can be replaced if all of the paper thereon has been exhausted. It is also to be noted that the mechanism 130 could be moved to its fully extended condition as illustrated in FIG. 13 so that both the supply roll 91*a* and the take-up roll 91*b* could be removed and replaced with different rolls of paper or the like if desired. From the foregoing, it can be seen that a simple mechanism for supplying and taking up paper tape has been provided such mechanism being easily storable in a bin and then pivotally movable in articulated fashion, upwardly out of the bin so that changing of the paper spools handled by such mechanism is facilitated.

Figure 17:
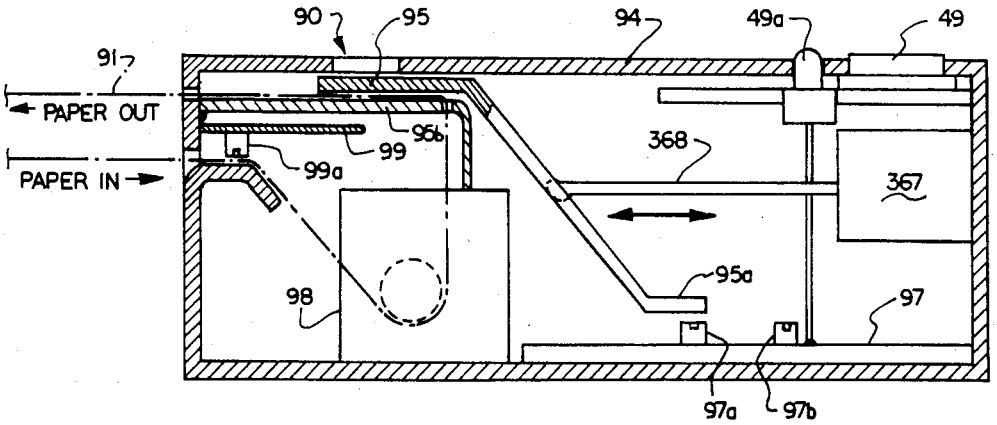
FIG. 17 is a schematic cross section view of a write-in window mechanism forming a part of the voting machine.

As noted earlier with regard to FIGS. 13 through 16 the web handling mechanism specifically illustrated was used to supply paper tape to a write-in printer mechanism schematically illustrated in FIG. 17, and previously d:scussed in general with regard to other drawing figures With specific reference to FIG. 17, the write-in mechanism cover panel 94 includes a write-in window aperture 90 through which a voter can access a portion of the write-in paper tape 91 to record thereon a voter's write-in vote selection. Located in the upper left corner of the mechanism as viewed in FIG. 17, there is positioned a conventional optical detector device of for example, the infrared retroreflective type that contains both a light transmitting portion and a light receiving portion, the optical detector 99*a* being mounted on a printed circuit board 99, the detector 99*a* providing to the programmable electronic control means a signal that is indicative of a condition wherein the write-in paper tape is no longer present, i.e. a "paper-out condition". That is, the detector 99*a* having the paper 91 sliding under its detector face will provide a signal when such paper is nonexistant, i.e. when for example the paper on the supply roll discussed earlier has been exhausted. A conventional thermal printer mechanism 98 is schematically illustrated and includes a paper drive means for pulling the write-in paper tape 91 into the write-in mechanism, the earlier noted belt driven take-up spool pulling the paper out from the write-in mechanism illustrated in FIG. 17. As also discussed earlier, the printer mechanism 98 also prints on to the tape 91 identifying data for the write-in votes contained thereon, and other programming data if desired. It can be seen that access to the paper 91 via the aperture 90 is controlled by a motor-driven shutter means in the preferred form of a linearly movable, gate type shutter 95 that is connected to a linear stepper motor 367 via a screw type linear drive shaft 368 the motor being regulated by the electronic control means as will be discussed. It can also be seen that another circuit board 97 supports on it a "closed shutter" optical detector 97*a* and an "open shutter" optical detector 97*b* along with the pair of diodes 49*a* (only one shown) discussed earlier which are positioned in relation to the write-in window control switch 49 also discussed earlier. The optical detectors 97*a*, 97*b* are also of the conventional infrared retroreflective type in that each detector includes a light transmitting portion and a light detecting portion. It can be seen that an integral flaglike projection 95*a* is provided at the right lower end (as viewed in FIG. 17) of the shutter 95 so that it can move back and forth i.e. it can move from its closed position shown to a rightward open position wherein it is above detector 97*b* and then it can move leftwardly back to its illustrated position wherein it is above detector 97*a*. The optical detector 97*a* provides a signal that indicates when the flaglike projection 95*a* is above it so that the electronic control circuitry knows that the shutter 95 has closed off the aperture 90 to preclude access to the write-in paper tape 91. Conversely, the flaglike projection 95*a*, when at its far right position, causes the detector 97*b* to provide a signal indicating such condition i.e. that the shutter 95 has been retracted or moved to its far right position as illustrated in FIG. 17 so that a voter can write onto the exposed portion of the paper tape 91. Thus, the detector 99*a* provides a signal indicative of a "paper out" condition, while the detectors 97*a*, 97*b* provides signals indicative of the position of the shutter 95 relative to the aperture 90. Thus, a relatively simple motor-controlled shutter mechanism is provided so that write-in votes are sequentially recorded by voters in a controlled manner on the continuous paper tape 91, all write-in votes thus being stored on the take-up roll 91*b* discussed earlier with regard to FIGS. 13 through 16.

Figure 18:
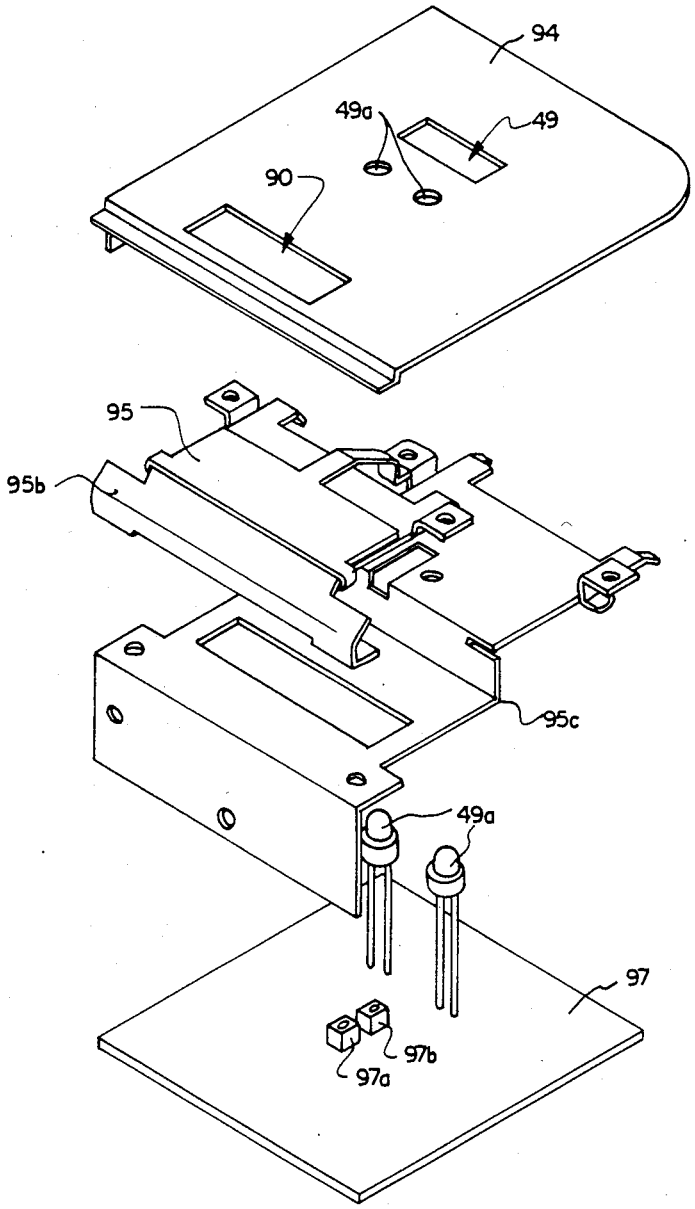
FIG. 18 is an exploded right rear perspective view of structural components of the write-in window mechanism of FIG. 17.

With reference to FIG. 18, the write-in mechanism cover panel 94 can be seen to include the write-in window aperture 90 and an aperture for receiving the earlier discussed write-in activation switch 49 and write-in indicating light emitting diodes 49*a*. Underlying the write-in mechanism cover panel 94 is the earlier discussed motor-driven shutter 95 which slidably rides back and forth on a shutter guide or write-in paper support 95b that in turn is fixed to a shutter support 95*c* having mounted to it the thermal printer mechanism 98 and other related components such as the detectors 97*a*, 97*b* carried by the circuit board 97. It is to be noted that the shutter guide 95*b* includes a paper feed slot hidden by the shutter 95 illustated in its closed position in FIG. 18.

Thus, as can be seen with reference to FIGS. 17 and 18, the voting machine in accordance with the present invention includes a write-in window mechanism fixed in position relative to the earlier discussed scroll means carrying the plurality of ballots portions of which are selectively viewed by the voter. The write-in window mechanism includes the write-in paper tape that is unwound from a feed roll onto a take-up roll with only a portion of the paper tape extending between the feed roll and the take-up roll at any given time being exposable and accessible to the voter via the aperture 90 wherein the voter can write on the said portion of the paper tape a write-in vote selection. Such controlled write-in vote access is provided by the movable motor driven shutter 95 for opening and closing the aperture, the shutter being regulated solely by the electronic control means as will be hence forth discussed. The optical detector means in the preferred form of the infrared detectors 97*a*, 97*b* provide a feedback indication to the voting machine as to the status of the shutter mechanism so that, for example, a voter tampering with the window mechanism, by inserting an object to preclude closing of the shutter, would be detected so that corrective action could be taken.

Figure 19:
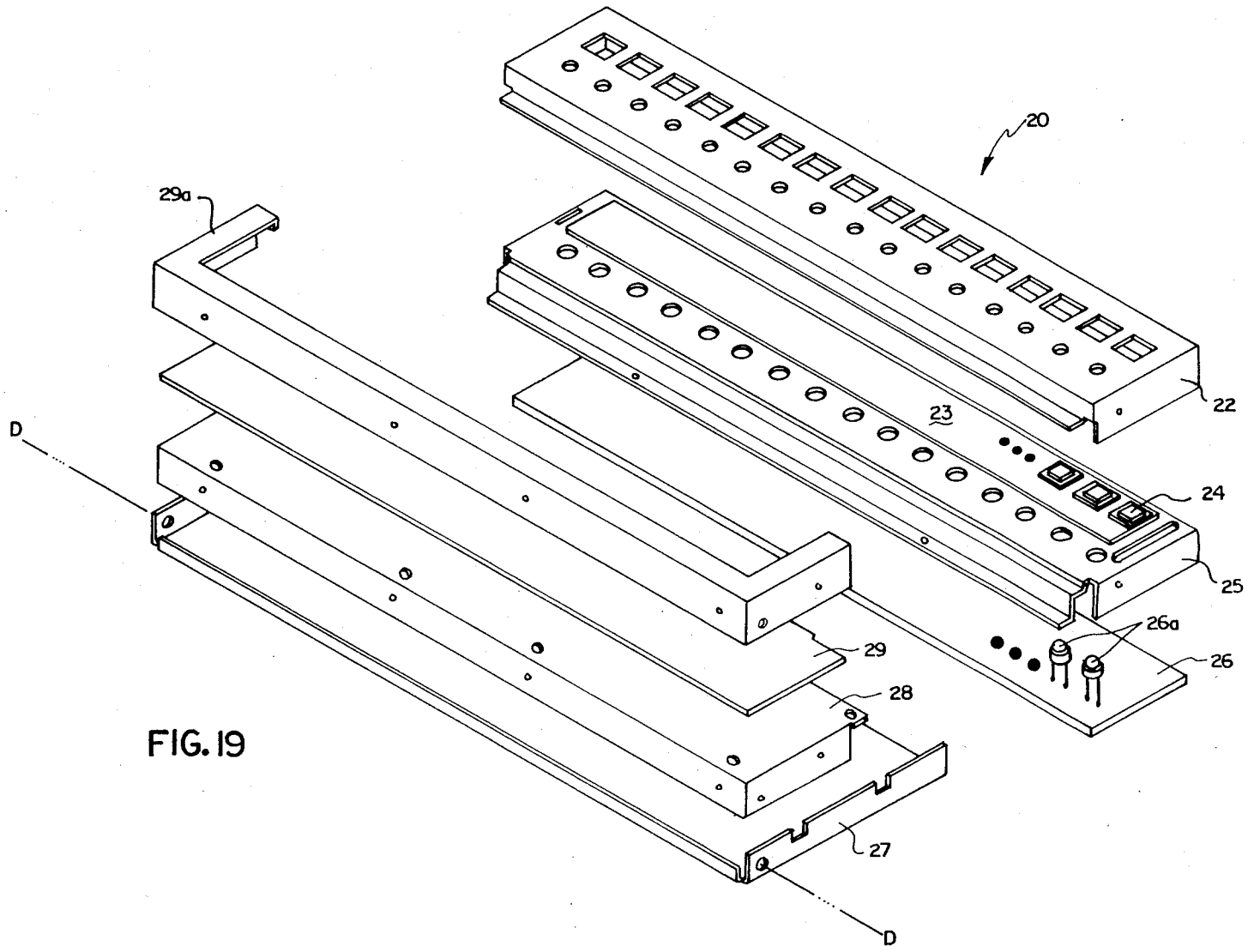
FIG. 19 is an exploded left front perspective view of structural components of a judge's control panel in accordance with the present invention.
Figure 20:
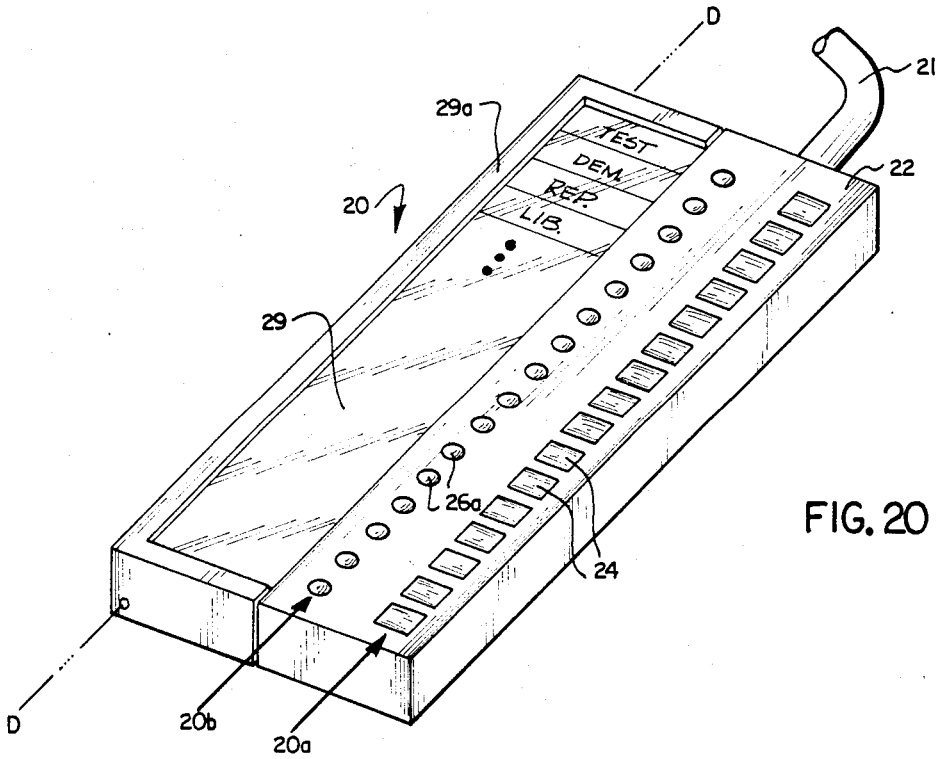
FIGS. 20 and 20A are right front perspective views of the judge's control panel shown respectively in a closed and opened condition.
Figure 20A:
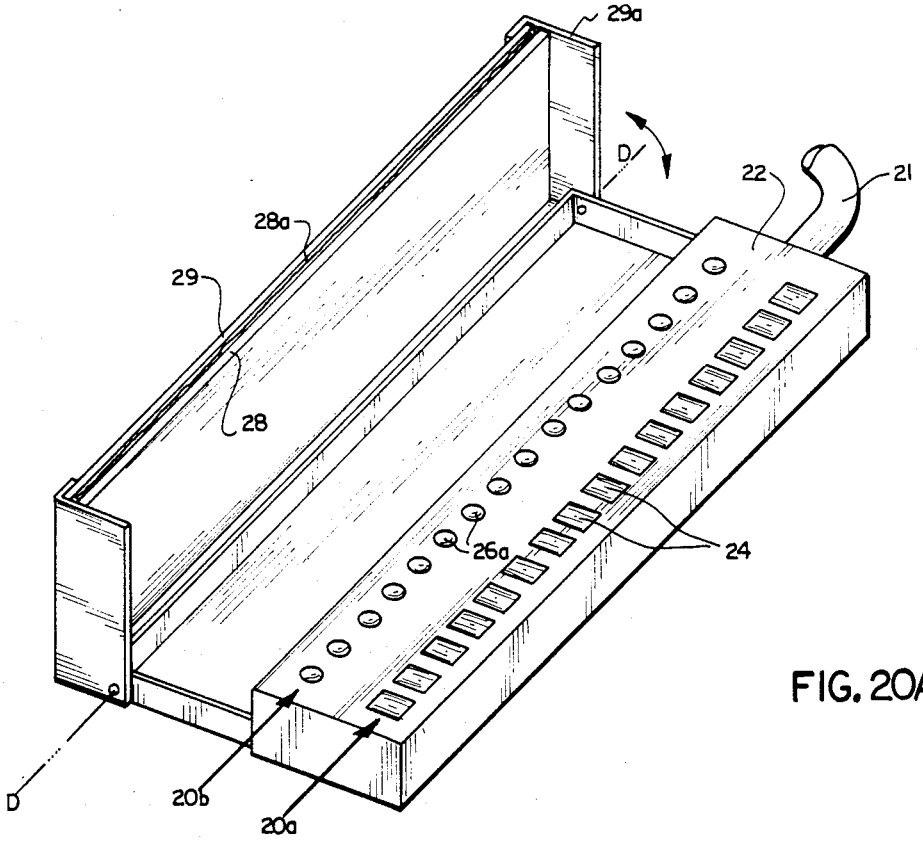

With reference to FIGS. 19, 20 and 20A, the earlier discussed judge's control panel 20, constituting a remote control means, as discussed earlier with regard to FIG. 1 will now be illustrated in greater detail. The judge's panel 20 is constructed in a manner similar to that of the window panel assembly 70 illustrated and discussed in connection with FIG. 10 of the drawings. As noted earlier, the judge's panel is used by a nonvoter, such as a voting precinct official, to regulate the operation of the voting machine 10 by the voter. For example, the judge's panel can be used to test the operation of the machine should a voter assert that the machine is not operating properly. The judge's panel can also be used to precondition the machine so that only selected portions of the ballots available can be viewed by any one voter depending upon his eligibility either in terms of the party that he has declared during a primary election, or in terms of residency requirements. For example, residency requirements could preclude such a voter from voting on some local issues but not preclude the voter from voting on other non-local or non-residency related issues.

With specific reference to FIG. 19, the judge's panel 20 is shown in an exploded form as including a bezel 22 having a plurality of apertures. The bezel 22 has positioned underneath it an elongated membrane switch circuit board 23 which supports a plurality of resilient elastomeric type pushbutton switches 24 similar to those discussed earlier with regard to FIG. 10. The membrane switchboard 23 with its pushbuttons 24 rests upon a switch support panel 25 over which the bezel 22 is fitted so that the membrane switchboard 23 and its pushbuttons 24 are sandwiched between the bezel 22 and the support plate 25. Located beneath the support plate 25 is a multiplexing and drive circuitry board 26 that carries upon it a plurality of light emitting diodes 26*a* as illustrated that project up through the circular apertures in the bezel 22 and the plate 25. As illustrated, there are sixteen rectangular apertures in the bezel 22 for a receiving sixteen pushbuttons 24 and adjacent to each of the pushbuttons are a respective one of sixteen light emitting diodes 26*a* that serve as visual indicators in connection with their associated pushbuttons 24. Elements 23 through 26 thus far discussed with regard to FIG. 19 form a unit which is mounted on a base member 27 which has hinge mounted to it along its left side, as viewed in FIG. 19, a judge's panel information block constituted by a judge's information sheet support member 28 which is overlaid with a transparent glass sheet or plate 29 which is held in position relative to the support member 28 by a flange 29*a*, wherein elements 28, 29 and 29*a* form a unit mounted on base member 27 for pivotal movement about axis DD as will be subsequently illustrated.

Turning to FIGS. 20 and 20*a*, the judge's panel in its assembled condition can be seen. When in an operating condition, the judge's panel, having the pushbuttons 24 constituting a judge's panel control button array 20*a* with an associated array 20*b* of light emitting diodes 26*a*, in turn associated with voting machine control information displayed through the transparent glass sheet 28 is indicated in FIG. 20. For example, the uppermost or top button 24 of the array 20*a* can be depressed to initiate a test mode sequence for the voting machine as will be discussed subsequently. It can also be seen that, for example, the second from the top button in the array 20*a* can be depressed where a voter has declared himself a Democrat (in the case of a primary election) wherein the voting machine will be conditioned to provide to the voter only ballot information pertinent to a Democratic primary vote selection. In a similar manner, the third from the top button could be depressed to precondition the case for a Republican declared voter and so forth, etc. It is also contemplated that others of the buttons 24 array 20*a* could be actuated to precondition or preset the voting machine so that the ballot information is presented in the controlled manner as determined by the button or buttons depressed by the nonvoting judge using the panel 20.

Finally, it can be seen that the left half of the judge's panel 20 can pivot upwardly as shown in FIG. 20A so that a slip of paper 28*a* containing the judge's panel control information can be removed and replaced with a different paper slip of judge's control panel information when necessary. For example, at each election the buttons on the judge's control panel 20 will be related to perform different functions as determined by the printed matter on the slip of paper 28*a* inserted between the glass panel 29 and the underlying sheet support member 28.

The general operation and structural features of the electronic voting machine in accordance with the present invention having been discussed, attention will now be turned to the programmable electronic control means successfully used in practicing the present invention.

The electronic hardware and software aspects of the voting machine 10 will now be described by taking into consideration both function and configuration.

Figure 21:
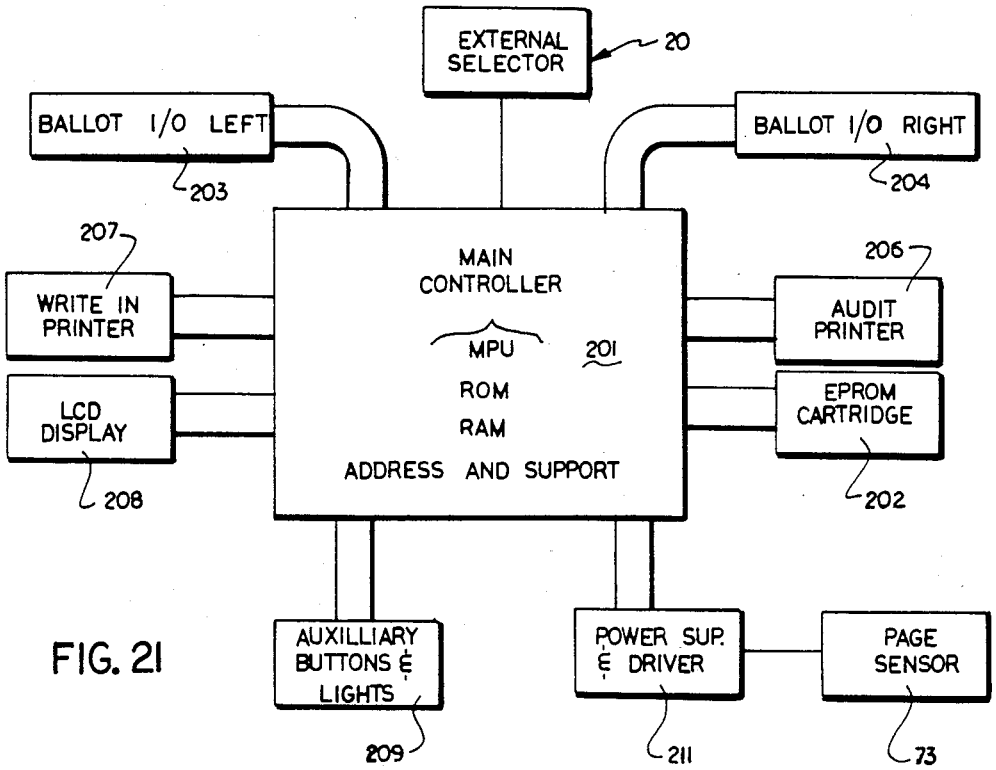
FIG. 21 is a general system block diagram of the functional electronic hardware system embodied in a voting machine according to the present invention.
Figure 22:
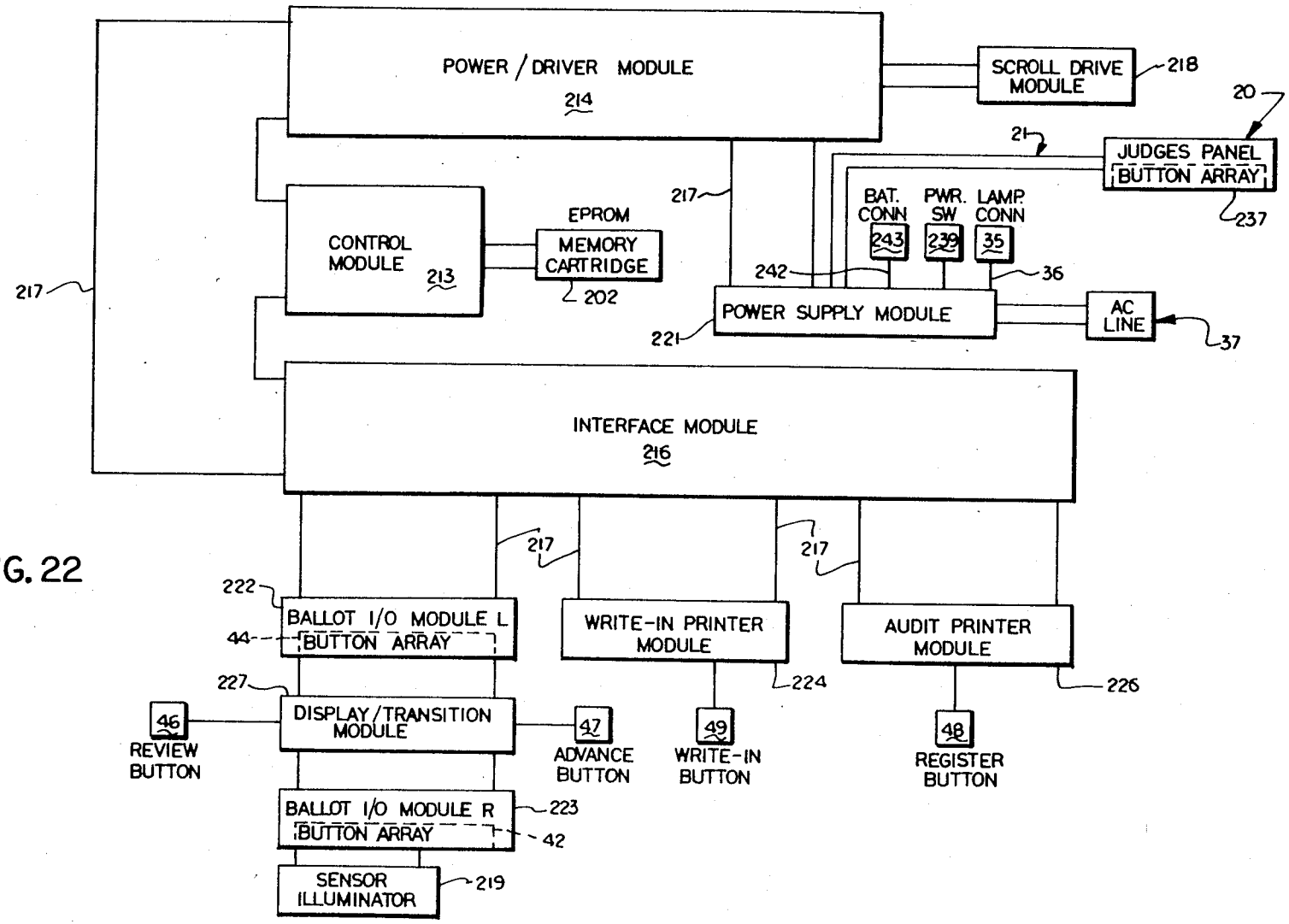
FIG. 22 is a more detailed functional block diagram of a voting machine according to the present invention showing main controller and peripheral hardware interconnects.

Referring to FIGS. 21 and 22, functional block diagrams are shown of an electronic control means used with the voting machine 10. A more detailed understanding of the electronic control means will follow from a discussion of FIGS. 23 through 33.

The primary electronic data collection and processing center of the voting machine is a microprocessor-based main controller circuit generally indicated by the numeral 201. The main controller 201 includes an 8-bit microprocessor unit (hereinafter designated as the MPU) and associated address decoders and general support circuitry. The main controller further includes system ROM hardware used to store the base system software for the MPU and two sets of memory RAM hardware. The first RAM set is used in part to temporarily store system set-up information which permits a pre-election checkout of the voting machine to verify proper machine operation. The second RAM set is used primarily for compiling the vote tally information processed by the MPU.

Directly connected to the main controller 201 is an EPROM cartridge circuit 202 used to permanently store the set-up information and final tally results calculated after the voting polls have closed at the end of election day.

The main controller 201 also interfaces with, monitors and controls several peripheral circuits which enhance the operational performance of the voting machine 10. Actual electrical connections between the main controller and the peripheral hardware can be made by any convenient means such as ribbon cable and mateable connectors or direct wiring.

The peripheral support hardware includes left and right ballot I/O (Input/Output) circuits indicated by the numerals 203 and 204 respectively. These circuits include connections to the pushbutton switch contacts associated with the ballot button switch arrays 42, 44 and light arrays 43, 45 on the voting control panel 40 which are operated during the actual voting process as described. The ballot I/O circuits connect the ballot switches to the main controller 201 and interface therewith in such a manner that anytime a ballot button in one of the arrays 42, 44 is pushed or actuated the corresponding ballot I/O 203 or 204 sends a unique electrical signal to the main controller 201. This permits the main controller 201 to determine, via software, whether or not the actuated ballot button is a valid selection. A valid ballot button selection is one which is available for selection on a particular ballot being used at the time as defined by system software. If the selection is validated the main controller 201 sends back a signal which lights the appropriate ballot light associated with the actuated ballot button. Thus, the system is fully discrete in that actuation of a ballot button only lights its associated ballot light after the main controller 201 has verified the actuated button is a valid selection. The "left/right" designation for the ballot I/O circuits 203, 204 is merely to group the two sets of the ballot buttons and lights on the central viewing panel 40 of the voting machine as illustrated in FIG. 7.

Still referring to FIG. 21, the peripheral support circuitry further includes an audit printer circuit 206 and a write-in printer circuit 207. The audit printer circuit 206 provides a hard copy backup or audit trail of the voting process should a hardware or software failure render the electronic tally unreliable or subject to confirmation (such as a recount). The audit trail function is implemented in such a manner that voter privacy and voting secrecy is assured so that no vote printed on the audit tape can be related back to the voter who cast it.

The write-in printer circuit 207 permits writein voting capability. This circuit 207 also provides an electronic control circuit for operating the write-in window mechanism which utilizes the motor-driven shutter 95 (FIG. 7). The write-in printer is used to print identifying data on the write-in tape for tallying the writein votes made by the voters.

The printer circuits 206, 207 each include a modular printer assembly having its own microprocessor and support circuitry as well as the printer tape supply mechanisms previously described herein. Means are also provided for sending a signal indication to the main controller 201 when either the audit printer or the write-in printer run out of paper tape.

The peripheral circuitry further includes a liquid crystal display (LCD) circuit 208. The circuit 208 includes an eight character, 16-18 segment alphanumeric display, plus associated support circuitry. The main controller 201 transmits predetermined character codes to the LCD support circuitry which in turn displays the information on the LCD device 50 (FIG. 7). Such information is determined by the system software and may include instructions used during the machine set-up, voting and verification operating modes as well as diagnostics for helping to identify system malfunctions.

A plurality of auxilary buttons and lights are generally indicated by the numeral 209. These auxilary devices are discretely controlled and monitored by the main controller 201 for specific functions. For example, included in this group are the vote register or cast button 48, the scroll advance and review buttons 47, 46, write-in control button 49 a reset button (not shown) which is inaccessible to the voters and used by a precinct official during machine set-up. These buttons, when actuated, can be lit up by the main controller 201 by related interface circuitry.

Also included in the peripheral circuitry is a power supply and scroll mechanism driver circuit section 211. The power/driver circuit 211 is a discrete circuit that includes filter capacitors, bridge rectifiers and voltage regulators to step down standard 110 VAC commercial line voltage to 12 VDC and 5 VDC operating voltages. The power/driver section 211 also includes a 25 volt DC inverter type power supply used in association with the EPROM cartridge 202. A scroll mechanism drive circuit is provided for controlling operation of the scroll mechanism 80 described previously herein.

The power/driver section 211 further includes an audible beeper circuit and interface circuits for the scroll page sensor means 73 used to optically detect the position of the printed ballot pages carried by the flexible web 110. Also included are monitoring circuits used to provide multiplexed information to the main controller 201 for verifying proper operation of the various power supplies and battery circuits.

The remaining major functional section of the voting machine electronic control means is the external selector or judge's panel 20. The judge's panel is used to control testing and operation of the voting machine for an election day voting process. The judge's panel 20 provides a remote control means for determining the operating parameters of the voting machine.

Turning now to FIG. 22, the configuration of the electronic control means circuitry, which is functionally grouped and represented in FIG. 21, is shown in greater detail. Specifically, each module is a printed circuit board with associated cables and connectors and which carries or is connected to the designated circuitry. The modules are interconnected primarily through ribbon cables and multipin connectors though straight hard-wired connections can be used when convenient. The ribbon cables and connectors are only shown schematically in FIG. 22 and are designated by the numeral 217, such hardware being well known to those skilled in the art. The specific signals transmitted between the modules are labelled on the more detailed circuit schematics in FIGS. 23 through 33. The various switches, buttons and lights are mounted in a known manner in the voting machine chassis or on circuit boards as required. The ballot lights and button switch arrays 42, 43, 44 and 45, of course, are positioned with respect to the corresponding printed ballots indicia as described hereinbefore. The physical layout of the electronics within the voting machine chassis is preferably done in a manner to minimize space and cable length requirements as well as enhancing convenience when performing assembly maintenance and repair. The general chassis layout is illustrated in FIG. 5.

As illustrated in FIG. 22, the electronic hardware is configured on three main modules: a control module 213, a power/driver module 214 and an interface module 216. The control module 213 includes the main controller circuitry 201 and interface logic and controls for the EPROM cartridge 202. That is, the MPU, the software program ROM, the two sets of RAM and the associated address and support circuitry are located on the control module 213.

The EPROM cartridge 202 consists of a printed circuit board which carries a conventional EPROM (erasable programmable read only memory) device. The circuit board is mounted to a multipin connector and the whole assembly is encased for shielding purposes as described to prevent inadvertent erasing of the EPROM. The cartridge 202 plugs into a mating connector which is connected directly to the control module 213.

The EPROM device is used to permanently store the election set-up information inputted by the precinct custodian prior to the election voting process and also stores the final tally results after the voting polls are closed. Consequently, the control module 213 includes the necessary interface logic circuitry for both reading the EPROM memory contents and also writing information into the device. This self-contained programmable election feature of the voting machine 10 permits total flexibility since each voting machine can be individually programmed for the particular precinct (i.e. ballot) for which it will be used. The voting machine need not be dedicated to a particular ballot configuration until such time that it is readied for use at a particular precinct. The EPROM cartridge 202 is essentially blank prior to setting up the voting machine for a particular ballot with which it will be used. Once the ballot information has been inputted to the machine by the custodian and verified as accurate, the set-up information is permanently transferred (burned) into the EPROM cartridge to provide a permanent record of how the machine was formatted and the election was conducted.

Other information stored in the EPROM cartridge 202 includes the precinct number, the date and the serial number of the voting machine 10. Thus, each individual voting machine is specifically identifiable with the EPROM cartridge used with it. The precinct number, date and serial number are also recorded by the audit printer 206 and the write-in printer 207 so that all of the vote tallying mechanisms are uniquely identified together with one voting machine after the machine has been set-up by the election custodian.

Another security feature incorporated into the voting machine is an electronic lock which makes it difficult for anyone to defraud an election by switching EPROM cartridges. As soon as the voting machine is set to its voting mode, the main controller 201 initializes and stores a randomly selected number in the EPROM cartridge 202 and also in three different memory locations in the internal memories of the voting machine. If at any time all four memory locations do not match, the machine automatically shuts down. When the machine generates the number randomly, it also prints it out on both the audit trail and write-in tapes. Selection of the number and storing is carried out by suitable system software.

The power/driver module 214 includes some of the DC operating power supplies, a scroll motor power drive circuit and various sensing circuits for monitoring the power supplies. The module 214 also has circuitry for interfacing a scroll drive module 218 with the control module 213.

The scroll drive module 218 includes the plurality of optical sensors or detector means 73 used by the main controller 201 to determine and control which of the four ballot page fields is being visually presented at a given point in time and also for properly aligning a given ballot page field within the viewing window 41 as described. The optical detectors 73 generate electrical signals in response to the optically detectable indicia **113*a*–113*d* on the ballot-carrying web 111. The optical light sources 73*a* which cooperate with the detectors 73 are located on a sensor illuminator board 219. The detector output signals are processed on the power/driver module 214 to interface with and be interpreted by the main controller 201 according to predetermined criteria in the system software. The illuminators 73*a* on module 219 and detectors 73 on the scroll drive modlue 218 are mounted to provide a slotlike space such that the edge of the ballot web with the positional indicia thereon rides between the illuminators and optical sensors. The scroll drive module 218 further includes circuitry for interfacing a power drive signal from the power/driver module 214 to the scroll drive motor 88**.

A power supply module 221 includes circuitry for stepping down standard commercial line voltage to 12 VAC and converting the latter to a main operational 12 VDC power supply. The power supply module 221 also provides connection means 242 for an auxilary operating power source such as a conventional 12 VDC battery 243 and a memory backup power supply for maintaining holding power to the main controller 201 memories when main operational power is lost or interrupted.

The interface module 216 includes circuitry for interfacing the control module 213 with left and right ballot I/O modules 222 and 223 respectively, a write-in printer module 224, an audit printer module 226, a display/transition module 227 and the external selector or judge's panel 20. It will be noted that FIG. 22 illustrates the judge's panel 20 as being connected to the power supply module 221 which is electrically and schematically accurate. The four conductor cable 21 plugs into the power supply module since two of the four conductors are used for +12 VDC and ground. The data transmission lines, however, are routed via cabling to the interface module 216 for further processing and multiplexing.

The left and right ballot I/O modules 222, 223 include the respective I/O circuits 203, 204 for multiplexing the ballot button and light signals to the main controller 201. The I/O modules connect to the switch contacts which are operably associated with the ballot button arrays 44 and 42 respectively mounted on the voting machine ballot panel 40 as described.

The display/transition module 227 includes the LCD display circuitry 208 and the advance button switch 47 and the review button switch 46. The latter two switches are used by a voter to selectively request the main controller 201 to move the ballot web 110 via the scroll drive mechanism 80 so as to present a particular ballot page to the voter. The system software determines whether the voter request is valid i.e. there may be situations when a voter is not eligible to view all of the ballot pages. Restrictions on ballot page presentment are controlled via the system software and keyed input from the election officials authorized to control the judge's panel 20.

The write-in printer module 224 includes the write-in printer circuitry 207 and control circuitry for the write-in window shutter 95 control motor. The write-in pushbutton switch 49 is connected to the write-in module 224 and permits a voter to instruct the main controller 201 to accept a write-in vote. System software causes the write-in printer to record on the printer tape which ballot button the write-in vote corresponds to and then actuates the control circuit to open and subsequently close the write-in window 90.

The audit printer module 226 includes the audit printer circuitry 206 which can be substantially the same as the write-in printer circuitry 207. Appropriate decode logic for selecting the correct printer at the appropriate time is on an interface module 216 (see FIG. 22). The vote register button switch 48 is mounted on the audit printer module 226 and is actuated by the voter to register and store the selections the voter made via the ballot button arrays 44, 42.

The audit printer provides a hard copy tally of all the votes cast during the election day voting process. However, election secrecy must be maintained so that sequential recordation of the votes is not permissible. To overcome this problem, after a voter casts his or her ballot, the votes are collectively stored in one of four system memory banks in the main controller 201. That is, the selections of each voter are initially stored in a memory location and not yet printed out. After the first four voters have cast their ballots, the four memory banks are filled and the system software randomly selects one set of ballot data and prints out the selections on the audit printer tape. That is, it prints out each vote selected. The randomly selected memory bank is then used to store the fifth voter's ballot results and so on for all voters. Because the ballot data is randomly selected from the four memory banks, there is no way to relate the audit tape record to the voter who cast those votes. Of course, at any given time this means that the results of the last four voters are in system memory and not on the hard copy audit tape. But at most only data on four ballots would be lost if there were a total system failure. Thus, the audit trail provides a reliable backup for the electronic tallying system.

Another software-controlled security feature utilized in the electronic control means is tallying the votes by the following technique. Tally information is stored in three system memory locations in the main controller 201. For instance, there can be a binary tally representation, an inverted binary tally representation and a shifted or multiplication of two tally representation, each stored in a different memory location. These tally compilations are compared with each other upon trying to update the respective total vote tally by an increment of one vote. If the three memories do not match the software attempts to take a best two out of three readings. If valid, the bad memory location is corrected. The bad location may have been caused by a power glitch, electromagnetic radiation or other anomaly. In any event, an error counter in the main conroller 201 is incremented to indicate a tally error was found. Should the error counter reach a total number of 255 errors, the voting machine shuts down since the electronic tally is then considered to be too unreliable. If at any time no two of the three tally memories agree then the machine shuts down completely.

The audit and write-in printers also record on the printer tapes the precinct number, date and serial number of the voting machine. This ties together all the tallying mechanisms of a single voting machine since the EPROM also has the same information stored therein.

Still referring to FIG. 22, the judge's panel 20 includes circuitry for interfacing the panel with the control module 213. The four wire cable 21 permits a remote operation of the panel 20 away from the voting machine 10 itself. The judge's panel is used for verifying proper machine operation both before and during the voting process and also for instructing the main controller 201 as to which ballot seletions are valid for the next voter. Accordingly, the judge's panel 20 includes a pushbutton array 237 which indicates to the main controller 201 the desired ballot format.

A standard three wire cable and plug 37 provides a power input means to the voting machine electronics from a commercial power outlet (110 VAC). A main power on/off switch 239 is also provided in a known manner. The flourescent lamp 35 is connected to the power supply module 221 by a power cord 36. An auxilary battery power connection 242 is provided for externally connecting a conventional 12 VDC power supply 243 such as an automotive battery in lieu of commercial line power. Such is desirable as an emergency operational power backup in case of an electric utility failure or for operating the voting machine 10 remote from a commercial power outlet.

Turning now to FIGS. 23–33 a more detailed understanding of the electronic hardware will now be described.

Figure 23:
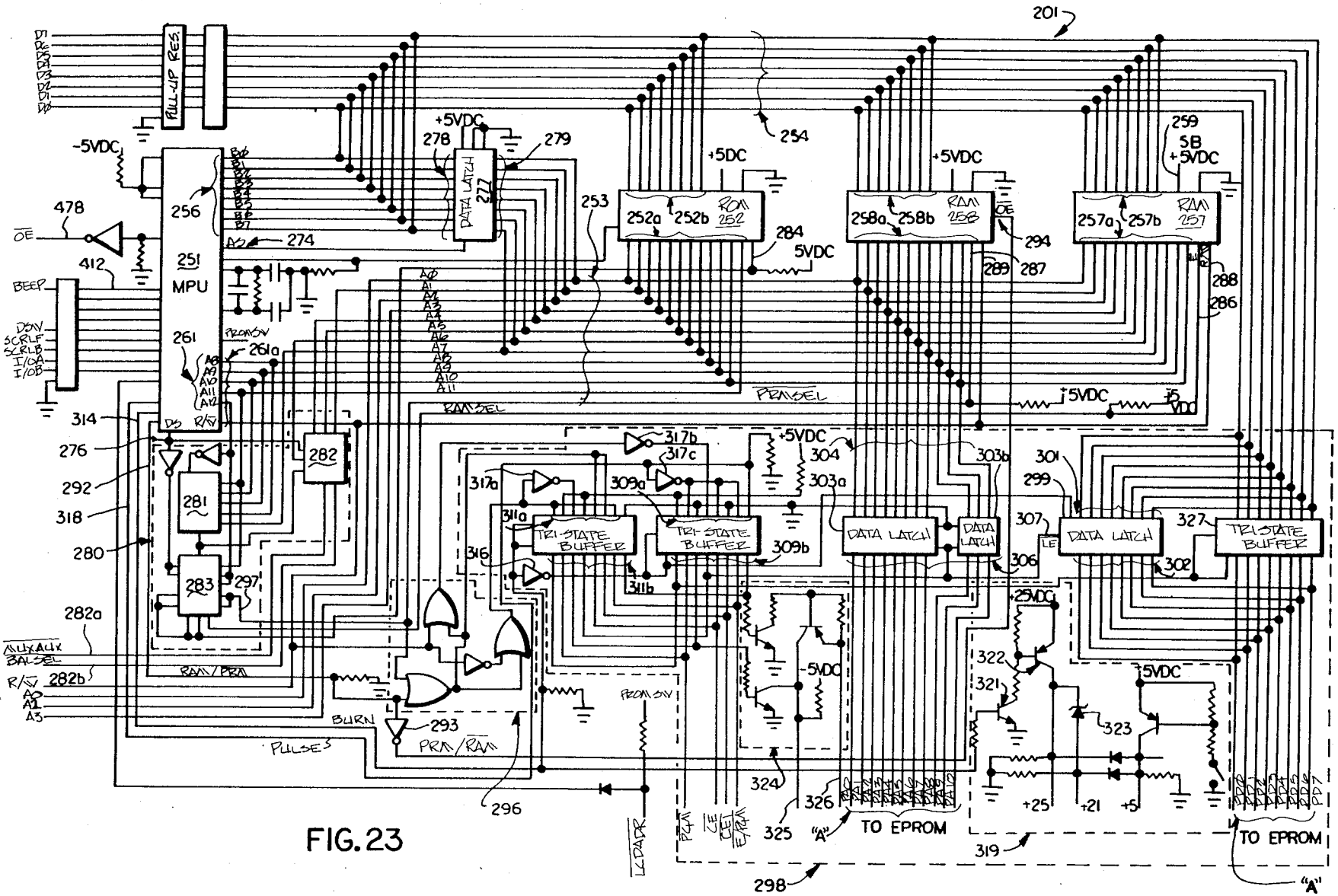
FIG. 23 is a schematic diagram of control module used in the electronic control system shown in FIGS. 21 and 22.

With particular reference to FIG. 23, the main controller 201 circuitry is located on the control module 213 (FIG. 22) and is a microprocessor-based, software driven computer which interfaces with and controls the voting machine peripheral hardware used in an election voting process. The main controller includes a microprocessor unit (MPU) 251. An 8-bit MPU is illustrated though other MPUs can be used as required. The illustrated MPU is a lower power consumption device which contains a CPU, on-chip RAM, I/O and timer. One such device particularly suited for use with the present invention is part number MC146805E2 manufactured by Motorola Incorporated, Austin, Tex. The manufacturer's technical brochures and specifications give the necessary detailed information to interface and internally program the microprocessor 251, as is well known by those skilled in the art.

As with all microprocessors, the MPU 251 functionally operates from or is driven by system software which is a programmed set of instructions and data processed and stored in binary representation. Because of the limited amount of internal memory available in any MPU, the system software is permanently stored in a conventional read only memory (ROM). The master ROM used to store the basic operational program of the main controller 201 is indicated by the numeral 252 in FIG. 23.

The master ROM 252 includes thirteen address inputs 252*a* and eight data outputs 252*b*. The MPU 251 addresses the ROM 252 via an address buss 253 connected to the inputs 252*a* in parallel on the ROM 252 device. The ROM data outputs 252*b* are connected in parallel to a main 8-bit data buss 254 connected to the eight data inputs on the MPU, namely inputs B0–B7 indicated by the numeral 256. Thus, the MPU 251 receives its instructions from the master ROM 252 in relation to the address input appearing on the address buss 253. The MPU, of course, then carries out the ROM instructions, in accordance with its own internal software instructions.

In addition to the master ROM 252, the main controller 201 also utilizes two sets of random access memory (RAM) 257 and 258 respectively. The RAMs are conventional volatile memories meaning that when power is turned off the contents stored in memory are lost. Data, course, can be written into and read from the RAM devices 257, 258. The RAM sets 257, 258 have 12-bit address inputs 257*a*, 258*a* respectively which are parallel addressed from the address buss 253. Likewise, the RAMs have 8-bit data outputs 257*b* and 258*b* respectively connected to the same main data buss 254. That is, the master ROM 252 and RAMs 257, 258 share common address and data busses.

The first RAM set 257 is primarily used for storing the electronic vote tally information and the second RAM set 258 is primarily used for temporarily storing the voting machine set-up information. Hereinafter the first RAM 257 will be referred to as the TALLY RAM 257 and the second RAM 258 will be referred to as the SET-UP RAM.

It should be noted at this time that both RAM sets operate off of +5 VDC supplies connected to the (+) power terminals on the ICs as illustrated. The TALLY RAM, however, has available to it a backup voltage supply in the form of two AA cell batteries each of about three volts DC serially connected. Thus, the +5 VDC input 259 to the TALLY RAM is designated +5B since it can be supplied either from the main +5 VDC supply or the backup AA batteries. These voltage sources are physically located on the power/driver module 214 (FIG. 29) and the power supply module 221 (FIG. 28) respectively. The backup AA batteries are provided to maintain the stored vote tally contents of the volatile TALLY RAM memory in the event of a main operating power failure during an election.

Figure 24:
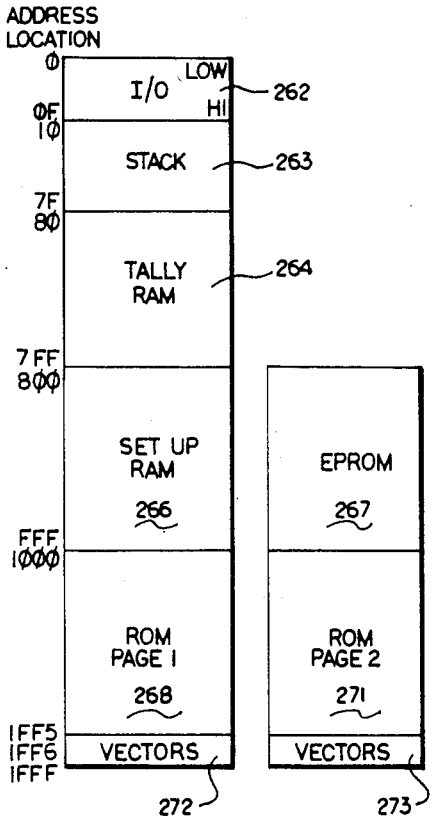
FIG. 24 is a general map of the memory allocations for a main controller on the control module shown in FIG. 23.

At this point an understanding of the memory allocation for the main controller 201 is useful. Referring to FIG. 24, since an MPU is a general purpose device it can only communicate with peripheral hardware (such as ROM and RAM memories) by defined memory locations or addresses. The MPU 251 particularly used with the present invention has eight bidirectional I/O lines which means eight data bits are available for communicating with peripheral hardware. For simplicity the address locations are by convention defined in hexadecimal notation.

Of the available I/O lines, the illustrated main controller 201 (FIG. 23) utilizes 13 (B0–B7, A8–A12) of the I/O lines for addressing the ROM and RAM memories. The I/O lines B0–B7 are identified by the numeral 256 and the A8–A12 lines are identified by the numeral 261. B0 is the lowest order bit and A12 is the highest order bit. It will be recalled that the B0–B7 I/O lines also function as the 8-bit data input lines to the MPU.

Using 13 I/O lines, or in other words 13-bits of information, results in a total address range of 0000 to 1FFF in hexadecimal notation. This range comprises roughly 8,000 memory locations. Again referring to FIG. 24, and in particular the left side stack, the uppermost block 262 is labelled I/O and comprises address locations 0000 through 000F or 16 locations. The I/O block 262 is used in part for addressing the ballot button and light arrays 44, 42 via the left and right ballot I/O modules 222, 223.

The next block 263 comprises address locations 0010 to 007F and is an on-chip RAM area in the MPU 251 itself. This on-chip RAM contains certain memory locations available in the MPU to temporarily store data during MPU instruction and manipulation operations. Certain of these RAM memory locations also are used for special purposes by the system software. For example, they may be used to indicate how many total votes have been recorded, how many errors detected, what operating mode the voting machine is in (i.e. set-up, verify, voting), status of the ballot lights and so on. These memory locations are only used as temporary storage locations essentially acting as a scratch pad memory.

The next block 264 comprises address locations 0080 to 07FF and is defined as the TALLY RAM memory addresses. Thus, anytime these addresses are used the MPU is communicating with the TALLY RAM 257 (FIG. 23).

The next block 266 comprises address locations 0800 to 0FFF and is defined as the SET-UP RAM memory addresses. Thus, anytime these addresses are used the MPU is communicating with the SET-UP RAM 258 (FIG. 23). As stated, the SET-UP RAM 258 is used to temporarily store ballot format information inputted by the custodian, for example, which ballot buttons are to be active for the election. During the set-up mode the system software will instruct the custodian to input the set-up information which the MPU stores in the SET-UP RAM 258. Eventually this information will be permanently transferred to and stored in the EPROM cartridge 202 (FIG. 22). The temporary use of a read/write RAM memory, however, permits the set-up information to be verified and corrected as required.

Because the SET-UP RAM 258 information is eventually transferred in toto to the non-volatile EPROM cartridge 202, the information stored in the EPROM can be addressed with the same address locations used for the SET-UP RAM. This is represented on the right side of FIG. 24 by the EPROM block 267. In effect, after the SET-UP RAM 258 information is transferred to the EPROM, the EPROM memory locations are superimposed on the SET-UP RAM address locations. Thus, even though the address locations for the SET-UP RAM and EPROM are the same, during an election voting process these address locations 0800 to 0FFF cause the MPU to communicate with the EPROM cartridge, not the SET-UP RAM. This is important during voting because if main power is lost the SET-UP RAM 258 contents are lost but the EPROM contents are saved since the data therein is permanently burned into the EPROM IC during transfer from the SET-UP RAM.

The next block 268 comprises address locations 1000 to 1FFF and is designated ROM Page 1. When these addresses are being used the MPU is communicating with the master ROM 252 (FIG. 23). The ROM 252 is actually two devices piggybacked together. One is literally physically positioned on top of the other. The corresponding pins are connected together except the CS line. The $\overline{CS}$ line on ROM 252 is the chip select and is logic true when low. The chip select line is used to selectively access one of the two particular ROM devices and have its data appear on the microprocessor main data buss 254. Since the two ROMs are piggybacked they are not represented on the schematic FIG. 23 individually. Thus there are actually two ROMs at address locations 1000 to 1FFF. The MPU 251 can read instructions from the first ROM block 268, defined as ROM Page 1, for a certain part of its instructions. For another part of its instructions, by changing the logic state of the chip select line it can then start reading from block 271 designated as ROM Page 2, which is the piggybacked ROM device. This is required in the illustrated embodiment from the standpoint that the MPU 251 itself is limited to 8K of memory addressing ability. Since 4K of memory, from address locations 0000 to 0FFF, is already strictly defined as the I/O, the stack, the TALLY RAM and the SET-UP RAM or EPROM, there would otherwise only be roughly 4,000 locations available for system software storage. The software used in the illustrated machine requires more than 4,000 locations. So the additional ROM device was added and the MPU can simply flip-flop back and forth between ROM Page 1 and ROM Page 2.

At the very bottom of ROM Page 1 and Page 2 respectively, there is an area or block 272, 273 indicated from address locations 1FF6 to 1FFF that is identified as vectors. These vectors are actually defined in the manufacturer's literature and are called interrupt vectors and are well known in the art. These are particular memory locations that the MPU 251 will access to determine where in memory it will go to get its next instruction upon some type of an interrupt. For instance, a reset function is used upon power-up. When the voting machine is first turned on, and is first initiated, the first thing the MPU does is look at memory locations 1FFE and 1FFF to find out what address it must go to to get its next instruction. The vectors are repeated on both ROM page 1 and page 2 because upon power-up or initial power application, the system software will not know which ROM page the MPU is accessing. Therefore, these vectors 272, 273 should be identical.

Referring back again to FIG. 23, as was stated the MPU 251 is an 8-bit device with 13 I/O lines being used for addressing peripheral hardware. The lowest order data bits 256 (B0–B7) are used both for data input to the MPU as well as address outputs by a technique commonly known as multiplexing. That is, data and address information are multiplexed on the same MPU pins. An address strobe (AS) signal 274 pulses high whenever address information is output on MPU lines 256 and a data strobe (DS) signal 276 pulses high whenever data information appears on the MPU lines 256.

Since many of the devices which the MPU 251 communicates with, such as the master ROM, RAMS, and ballot I/O modules, are not multiplexed devices, the address information given by the MPU 251 must be latched so as to provide a static address that can be distributed throughout the electronic control system while permitting the buss 256 to be used for data input to the MPU. This is accomplished with an 8-bit or octal data latch 277. The data latch 277 parallel receives the address information (B0–B7) given by the MPU during the address strobe interval into inputs 278. Upon the occurrence of the address strobe 274 pulse which is connected to the latch enable input of latch 277 the information on lines 256 is latched into the device 277. Latch 277 functions from the standpoint that whenever the latch enable input is at the logic one level there is in effect a direct connection between the inputs 278 and outputs 279. Whenever the latch enable input of latch 277 is then brought back to a logic zero level, the device 277 will latch on to and hold the last data prior to that transition at the outputs 279 thus presenting static address information. Then after the proper peripheral device is addressed, the MPU can either read or write data via the data buss 254 because the latch 277 isolates it from the address buss 253. This data buss 254 is actually transferred throughout the entire system as will be apparent from the other drawings. As with any electrical schematic, continuity of signal lines is illustrated by using signal acronyms for lines which interconnect between the modules.

The MPU 251 will only read data during the data strobe 276 interval, not during the address strobe. The octal latch 277 provides eight (B0–B7) of the thirteen address bits for identifying which peripheral hardware is to be selectively addressed by the MPU at any given time. The other five address bits 261 (A8–A12) do not require latching since their corresponding signal lines **261*a* are only used to carry address information i.e. they are not multiplexed with data signals. However, since the peripheral devices share common data and address busses, one or more decoder circuits, such as circuit 280, are used to decode the MPU address outputs (B0–B7 and A8–A11) to determine which peripheral device is being selected, as is well known in the art. In the illustrated embodiment a pair of one of eight decoders 281, 282 and a dual 1 of 4 decoders 283 are used. The actual design of each decoder circuit, of course, depends on which peripheral device is to be selected as dictated by the memory map in FIG. 24. In the illustated embodiment for example, decoders 281 and 282** generate two principal address output signals 282*a*, 282*b* labelled $\overline{\text{MUXAUX}}$ and $\overline{\text{BALSEL}}$ used when selectively addressing the judge's panel 20, and the ballot I/O modules 222, 223, etc. as explained in greater detail hereinafter. The decoder 282 outputs 282*a*, 282*b* are determined as illustrated by the MPU data strobe signal 276 and MPU address bits A8–A12, A1 and A4–A6.

The master ROM 252 is selected by a logic low being applied to the enable line 284 of the master ROM 252. The signal on line 284 is generated by the decoder 283 and is a function of the MPU data strobe signal 276 and MPU address bits A11 and A12. As described before, ROM Page 1 and ROM Page 2 (see FIG. 24) are differentiated by the state of the chip select input. When the ROM 252 is addressed by a logic low at line 284 whatever data is stored corresponding to the address inputs 252*a* will appear at the outputs 252*b* and thus on the main data buss 254 and be inputted to or read by the MPU 251.

The RAM sets 257, 258 are likewise selected when a logic low is applied respectively to their enable lines 86 and 287. These signals 286, 287 are generated by the decoder 283 and also are a function of the MPU data strobe signal 276 and MPU address bits All and A12. When one of the RAM sets is being selected by the MPU, whatever data is stored in that particular RAM device (be it the TALLY RAM or the SET-UP RAM) corresponding to the address inputs (257*a* and 258*a* respectively) appears on the main data buss 254 via the respective outputs 257*b* or 258*b* and is read by the MPU 251.

It should, of course, be clear that the actual function of addressing the peripheral hardware is dictated by the system software stored on the master ROM 252 and the MPU 251 internal programming.

Unlike the master ROM 252 which can only be read by the MPU 251, the TALLY RAM 257 and SET-UP RAM 258 can have data written in them and stored as long as power is applied. The memory location where the data will be stored of course is a function of the binary logic states of the address inputs 257*a* and 258*a* respectively when the MPU sends out the data to be stored on the main data buss 254. Also, selection of the TALLY or SET-UP RAM is controlled by the MPU by which enable line 286 or 287 is active low. Each RAM 257, 258 has a corresponding Read/$\overline{\text{Write}}$ (designated R/$\overline{\text{W}}$) input designated 288 and 289 respectively. These inputs are directly connected to the Read/$\overline{\text{Write}}$ output 291 on the MPU which decides whether data is to be read from or written into the selected RAM memory. A logic high at output 291 indicates a read operation and a logic low indicates a write operation.

As stated above, during the voting machine set-up mode the SET-UP RAM 258 is used to temporarily store the ballot and election format information. After verification that the data is correct, the SET-UP RAM information is permanently stored (burned) in the EPROM cartridge 202. As indicated on FIG. 24, the EPROM is superimposed on the SET-UP RAM in that they share common address locations. The MPU 251, however, must be able to select one or the other device. This is accomplished with a dedicated output 292 of the MPU 251 designated RAM/$\overline{\text{PRM}}$. This signal is inverted by a conventional logic inverter 293 and then fed to an output enable ($\overline{\text{OE}}$) input 294 on the SET-UP RAM 258. When a logic high appears on line 292 from the dedicated MPU output it is inverted to a logic low which activates (enables) the SET-UP RAM 258 (input 294 is active low). When a logic low appears on line 292 it is inverted to a logic high and deactivates the SET-UP RAM.

An EPROM select circuit 296 also receives the RAM/$\overline{\text{PRM}}$ signal 292 from the MPU 251 and enables the EPROM cartridge whenever the SET-UP RAM is disabled. Conversely, whenever the SET-UP RAM is enabled the circuit 296 disables the EPROM cartridge.

In addition to selectively enabling the EPROM cartridge 202 as opposed to the SET-UP RAM 258, the select circuit 296 is also used to determine when the EPROM will be read or written. The circuit 296 bases these decisions on the status of the MPU Read/$\overline{\text{Write}}$ output 291, the output 297 of the address decoder 283 and the status of the MPU RAM/$\overline{\text{PRM}}$ output 292.

Writing data into an EPROM, of course, is not the same as writing data into a static RAM device. For example, the data must be present for a relatively much greater time and a high burn voltage is required. In addition, different manufacturers' EPROM devices may require different burn-in voltages. The illustrated voting machine was designed to accommodate the possibility of using different EPROM devices.

An EPROM/MPU interface circuit is generally indicated by 298 in FIG. 23. This circuit is capable of both reading the EPROM device data and burning or storing data into the EPROM device.

An octal data latch 299 is used to latch data being written in to the EPROM device. Inputs 301 of the latch 299 are connected to the main data buss 254. Outputs 302 of the data latch 299 are routed through a control module multipin connector "A" to data input pins on the EPROM cartridge 202 (see FIG. 22). The actual EPROM details are not shown as it is a standard off-the-shelf item.

A pair of octal data latches 303*a*, 303*b* are used to latch the address information for the EPROM. Inputs 304 are connected to the main address buss 253 and outputs 306 are routed through the control module connector "A" to the address input pins of the EPROM cartridge 202.

The actual latching function is performed by a latch enable signal to inputs of the three latching devices 299, 303*a* and 303*b*. The latch enable ($\overline{\text{LE}}$) signal 307 is determined by a multiplexing circuit. The multiplexing is handled in a very discrete way consisting of a pair of three-state buffers 309, 311. What is meant by multiplexing discretely is the fact that the devices 309, 311 are not multiplexure devices per se. Instead they are three-state buffers. The respective outputs of the buffers 309, 311 are connectable to control circuitry which generate specific control signals for the operation and function of the MPU 251 in either the EPROM store or read data modes.

The first buffer 309 is activated only during a read mode operation and the other buffer 311 is activated only during a write mode operation. The device selection is controlled by a dedicated output signal 314 from the MPU designated "Burn". This output 314 is connected to the enable input on IC 311. Burn signal 314 is also inverted by an inverter 316 and then connected to the enable input on IC 309. The three-state buffer ICs 309, 311 can be thought of in terms of an array of eight single-pole, single throw switches which either allow signals to pass from respective inputs 309*a*, 311*a* to the outputs 309*b*, 311*b* or otherwise are open circuited. Thus, the outputs 309*b*, 311*b* can be tied together in a multiplexed wired-OR configuration as illustrated.

A set of three logic inverters 317*a, b, c* are used in combination with the EPROM select circuit 296 to appropriately control the logic outputs of the buffers 309, 311 for the read or write EPROM modes. This requires the use of another dedicated MPU output signal 318 designated "Pulse" which, for example, is a 50 millisecond EPROM burn duration pulse. The function of this pulse signal 318 is to provide under software control from the MPU 251 a 50 millisecond burn pulse to the EPROM. All the EPROM ICs that this circuity was designed to support will use in the storage mode a 50 millisecond wide stable burn pulse. During this time all data and address information to the EPROM must be latched. This pulse then must be very closely controlled in amplitude and duration to keep from damaging the EPROM IC. Specifically about plus or minus 10%. 50 milliseconds of course corresponds roughly to 20 hertz operation. The MPU 251 clock circuitry however is running at about two and one-half megahertz. The 50 millisecond timing is accomplished by an internal timer in the MPU and also by software timing loops that constantly go through and decrement a number in an internal register each time it goes through a particular software routine. This continues until the necessary time duration is achieved at which time the MPU will output the next address location and stores the next set of data into that EPROM address location. With this in mind it should be apparent that by latching onto this data, and providing the 50 millisecond burn pulse, the MPU can scan the rest of the electronic control circuitry, perform numerous system checks, get the data available for the next burn pulse and carry out many other instructions while the MPU is waiting for the EPROM to burn.

So therefore, the software provides a pulse signal on line 318, by means of a binary data bit, controlled through software that will go to a logic one level for the 50 millisecond period and then be turned back down to a logic level low. In other words, operated as a switch through software. This is controlled by software in the MPU 251. The control circuits 296 and 308 determine the appropriate times the "Pulse" signal is used to actuate pulse circuit 324.

To briefly summarize then, the EPROM select circuit 296 and inverters 317*a, b, c* process signals from the MPU 251 so as to activate the buffers 309, 311 in a multiplexed manner when reading or writing the EPROM. The primary MPU signals used are the "Burn" 314, "Pulse" 318, "RAM/$\overline{\text{PRM}}$" 292, "$\overline{\text{PRMSEL}}$" 297 (a function of the MPU address locations), and "Read/$\overline{\text{Write}}$" 291. The multiplexing approach is utilized to minimize circuitry yet accommodate the EPROM operational characteristics which require a number of different voltages to fully operate the EPROM device.

The operating voltage requirements of a typical EPROM device include a 25 VDC or 21 VDC (depending on the manufacturer) supply to burn or store data into the EPROM. A burn voltage switching circuit 319 provides this capability. The MPU "Burn" signal 314 controls a transistor switch 321 which in turn actuates another transistor switch 322. The emitter of the switch 322 is tied to a +25 VDC supply generated on the power/driver module 214 (see FIG. 29). When the switch 322 is on (i.e. MPU "Burn" signal 314 is logic high) a +25 VDC supply is passed to the EPROM. The +21 volt supply is generated by simply placing a 4 volt zener diode 323 in series with the collector of switch 322.

Certain EPROM devices require a pulsed +25 or 21 volt supply. A pulse switch circuit 324 provides this function and is controlled by the multiplexing circuit 308. Supply power is delivered to the circuit 324 by means of a jumper wire (not shown) between the signal line 326 and either the +25 VDC or +21 VDC line in the circuit 319 when a pulse operated EPROM device is used. The output line 325 of the circuit 324 connects the pulsed signal to the EPROM device.

A switch controlled circuit 319 can be used to provide a +5 volt operating supply for EPROMs which require such a supply.

It will be recalled that IC 299 is an octal data latch which is used to hold data information as it is being burned into the EPROM cartridge 202. This IC is only active during a write or burn mode. In order to read data from the EPROM, another three-state buffer 327 is used essentially in parallel with the latch 299. IC 327 is activated only during a read operation and connects the EPROM output data at connector "A" to the main data buss 254. The logic in circuits 296 and 308 ensure that ICs 299 and 327 are not actuated at the same time. The tri-state buffer 327 prevents the latched data appearing at outputs 302 from interfering with the main data buss 254 while the EPROM is being burned.

The remaining discussion of the electronic control system for the voting machine will concentrate on the peripheral circuits located on the various modules which interface and communicate with the main controller 201 as highlighted in the dicussion of FIGS. 21 and 22. It should be understood that the signal acronyms indicated on the schematics are provided for ease of reference between drawings for determining the source or termination of a particular signal line. The routing is generally shown in FIG. 22 but whether a particular signal line is direct wired or alternatively connected through one or more printed circuit boards, cables or connectors is a matter of design choice and is well known in the art.

Figure 25:
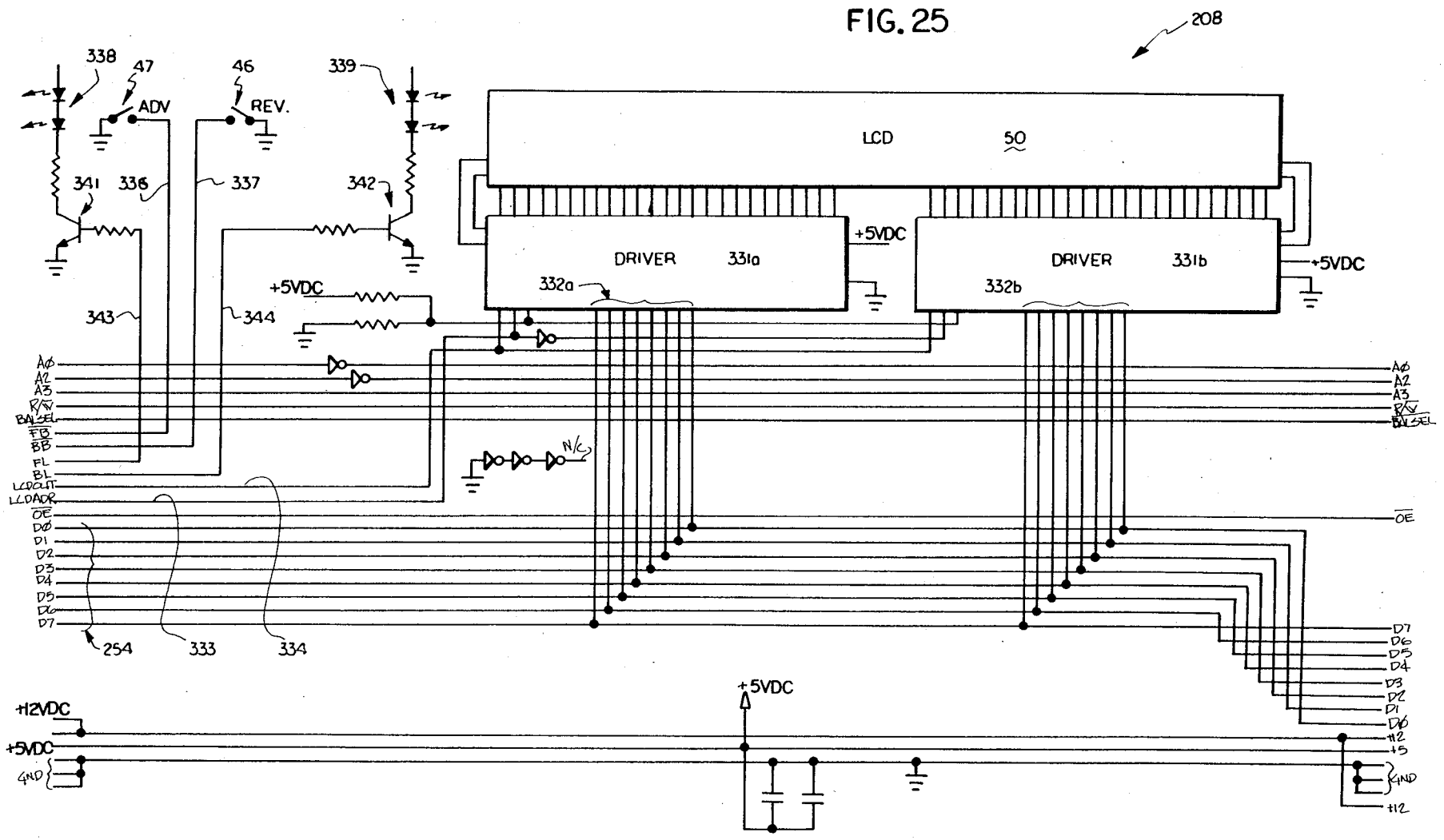
FIG. 25 is a schematic diagram of an LCD display module used in the electronic control system shown in FIGS. 21 and 22.

Turning now to FIG. 25 (the display/transistion module 227) there is shown a conventional LCD (Liquid Crystal Display) display and drive circuit 208. The circuit 208 includes an 8 character LCD device 50 such as model 76D8R09 manufactered by LXD, Inc. of Beachwood, Ohio. The LCD 50 is driven by two identical display decoder drivers 331*a* and 331*b*.

Display information is transmitted from the MPU 251 (FIG. 23) to the LCD decoders 331*a, b* in parallel format on the main data buss 254. Decoder inputs 332*a* and 332*b* respectively accept and latch the data transmission from the MPU at the appropriate time as determined by system software and interpret the information to cause the LCD 50 to display the message or instruction. The MPU selects the LCD 50 for data transmission by a dedicated output 334 designated $\overline{\text{LCDOUT}}$. A second control signal 333 designated $\overline{\text{LCDADR}}$ enables selectively one or the other of the LCD drivers 331*a, b*.

The LCD display is used primarily for instructions during the set-up and voting modes and diagnostics during the verification and test modes.

Unrelated to the LCD circuit 208 but located on the display/transition module 227 is the scroll advance pushbutton switch 47 and the review pushbutton switch 46. These switches are actuated by a voter when he wants to view a portion of the ballot not currently being presented. These switches provide signals 336 and 337, respectively designated $\overline{FB}$ and $\overline{BB}$, to the MPU 251. The MPU, according to software, then determines whether the voter request is valid before actuating the scroll drive mechanism for advancing or reversing the ballot. Operably associated with the switches 47, 46 are switch lights 338, 339 which provide a visual indication to the voter that the corresponding switch has been actuated. The lights 338, 339 are controlled by driver circuits 341, 342 actuated by the MPU via signal lines 343 and 344 designated FL and BL. The MPU actuates the lights 338, 339 when voter actuation of the switches 47, 46 is permissible. Also, during the set-up mode, the MPU actuates the lights as an instruction to the operator to activate the corresponding switch 47, 46 as part of the set-up procedure.

Figure 26:
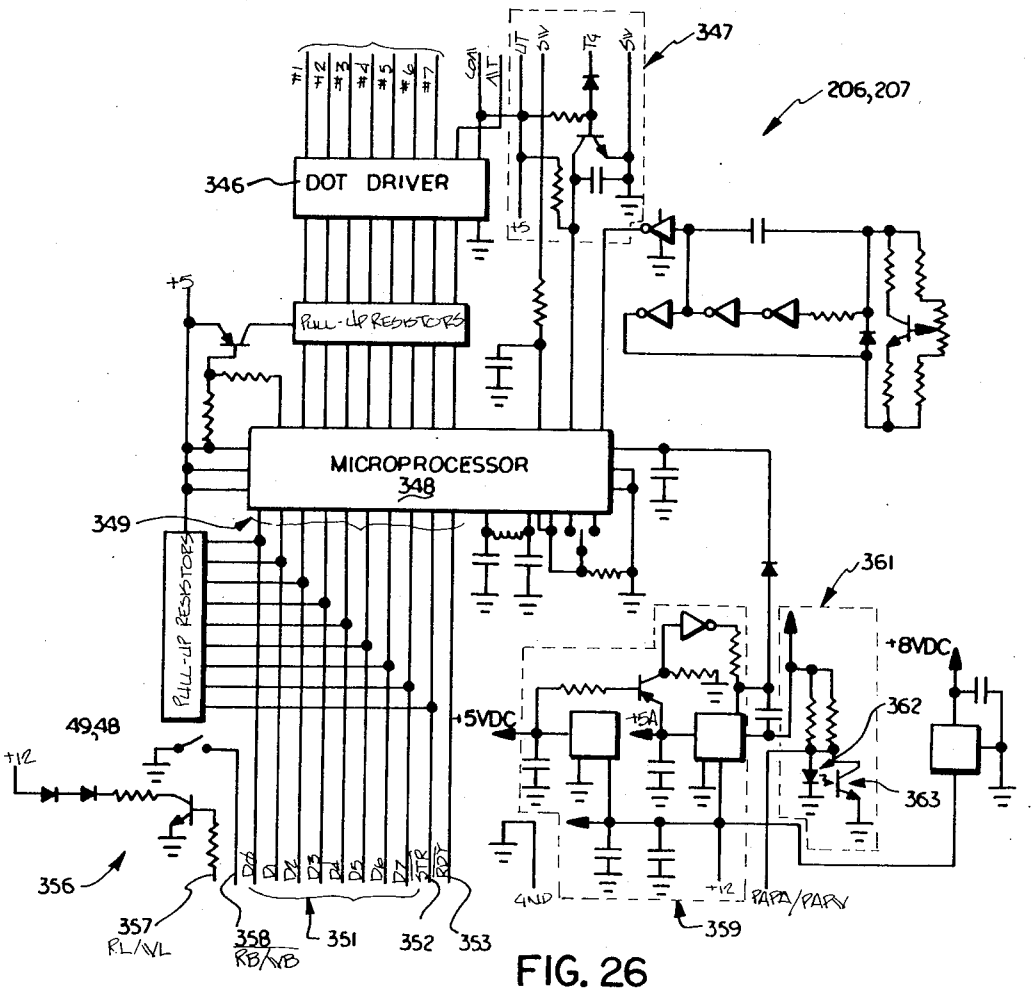
FIG. 26 is a schematic diagram of a printer module used in the control system shown in FIGS. 21 and 22.

Turning now to FIG. 26, a printer drive circuit is shown which is located on each of the printer modules 224, 226. The audit printer drive circuit 206 on the module 226 and the write-in printer circuit 207 on the write-in printer module 224 are identical, therefore, the circuit will be described in general terms.

The drive circuit 206, 207 is specifically designed to work with a thermal printer (not shown) model MTP201 manufactured by Seiko Instruments, Inc., Torrence, Calif. The drive circuit 206, 207 is fully detailed in the manufacturer's specifications. Generally, the circuit includes a thermal head dot terminal drive 346, a thermal head and paper feed drive circuit 347 and a microprocessor 348 which controls the operation of the printer in response to information transmitted to the microprocessor inputs 349 from the MPU 251. In particular, eight inputs 351 to the printer microprocessor 348 are connected to the main data buss 254 via latching circuits to be discussed with regard to FIG. 33. The remaining two inputs 352, 353 designated $\overline{STR}$ (strobe bar) and $\overline{RDY}$ (ready bar) are used for controlling the printer operations. The "strobe" signal 352 provides an indication to the processor 348 that the buss data 351 is valid and should be accepted. The "ready" signal 353 is used to indicate to the main controller 201 that the printer circuit 206, 207 is ready to accept data.

Of course, both the write-in printer 207 and the audit printer 206 will have their own individually controlled strobe and ready signals since their timing is basically independendent. The audit printer timing signals are designated $\overline{ASTR}$ and $\overline{ARDY}$ respectively and the write-in printer timing signals are called $\overline{WSTR}$ and $\overline{WRDY}$ respectively.

Each printer module 224, 226 has a pushbutton switch 49, 48 respectively and an associated lamp and driver circuit 356. On the write-in module 224, the switch 49 is the write-in button switch actuated by the voter when he wants to write-in a vote. On the audit printer module 226 the switch 48 is the vote register switch activated by the voter when the ballot is cast for tallying. The switches 49, 48 and their associated light driver circuits 356 have corresponding signal lines 357 (designated RL for the audit module 226 and WL for the write-in module 224) and 358 (designated $\overline{RB}$ on the audit module 226 and $\overline{WB}$ on the write-in module 224) which are monitored by the MPU 251 to determine whether voter actuation of the switches 49, 48 is valid. The signal designations RL, $\overline{RB}$, WL, $\overline{WB}$ stand for register lamp, register button, write-in lamp and write-in button respectively.

Each printer module 224, 226 also has power supply regulator circuits 359 for generating +5 VDC operating power for the printer circuit. Each printer module further includes an end-of-paper sensing circuit 361 comprising a light-emitting diode 362 and an optical sensor 363. The circuit 361 produces a logic low signal on line 364 (designated PAPW for the write-in printer and PAPA for the audit printer) when the corresponding printer is out of paper. The MPU 251, of course, periodically scans the PAPA and PAPW signals to ensure that paper is available and the printer data is being recorded.

Figure 27:
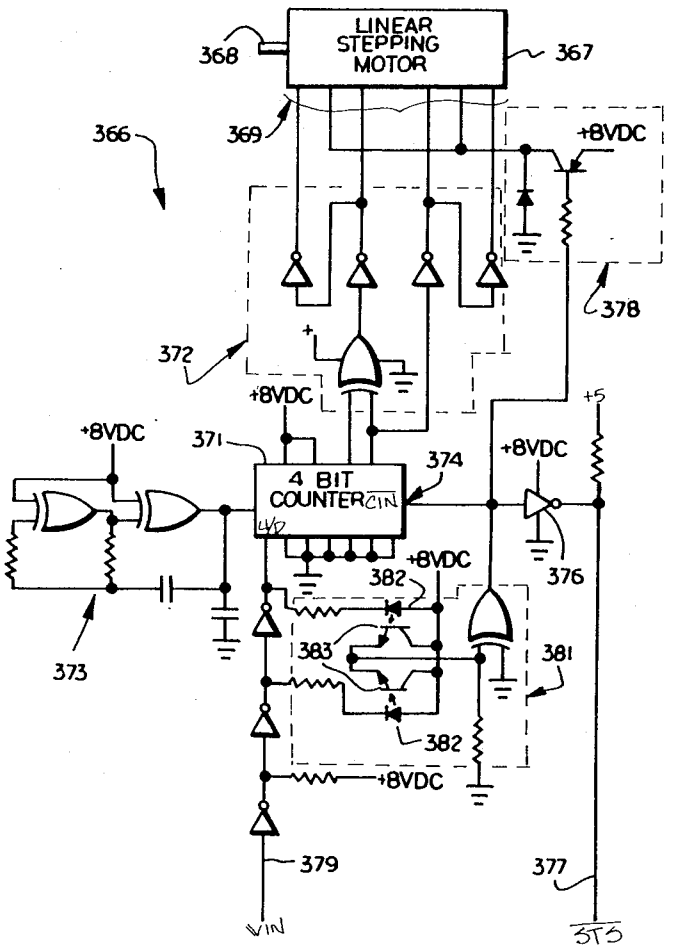
FIG. 27 is a schematic diagram of a write-in window control circuit.

The write-in printer module 224, in addition to the printer circuit 207, also includes a write-in window shutter drive control circuit 366 shown in FIG. 27. This circuit controls opening and closing of the write-in window shutter 95 as instructed by the MPU 251.

The control circuit 366 includes a bidirectional stepper motor 367 such as model K92100 manufactured by Airpax Manufacturing, Cheshire, Conn. The stepper motor 367 includes a drive shaft 368 connected to the write-in window shutter 95 (not shown on FIG. 27). The shaft 368 is axially and incrementally extended from or retracted into the motor in response to signals applied to the stepper motor inputs 369.

The stepper motor 367 operates from a 4-bit counter 371 and associated control and drive logic 372. The counter 371 is driven by a conventional low frequency astable multivibrator 373. The counter 371 and control logic 372 are designed so that as the counter 371 counts up the window shutter is opened and as the counter counts down the window is closed. A counter control signal 374 (designated "CIN") is a logic zero when the counter 371 is generating pulses to open or close the shutter and is a logic one when the shutter is either fully opened or closed.

The CIN signal 374 is used for two purposes. First, it is inverted by an inverter 376 to provide a window status signal "$\overline{STS}$" 377 to the MPU 251. This status signal indicates to the MPU either that the window is at an end of travel (i.e. either fully open or fully closed) or is somewhere in between (partially stuck open or closed). The CIN 374 signal is also used to isolate +8 VDC operating power from the stepper motor 367 when window shutter actuation is not being instructed. This is accomplished by a transistor switching circuit 378. By removing operating power from the stepper motor 367 when shutter actuation is not instructed, a substantial power consumption reduction is achieved.

Control of the counter 371 up count or down count cycle is controlled by the MPU 251 via a signal 379 designated WIN. The MPU controlled WIN signal is combined with a window sensor circuit 381 in a wired-OR configuration. The circuit 381 includes a plurality of light-emitting diodes 382 and optical sensors 383 which detect the position of the shutter 95 as described previously herein. As illustrated, the window sensor circuit 381 is operably associated with both the UP/-DOWN logic control for the counter 371, the power isolation circuit 378 and the $\overline{STS}$ signal 377 to the MPU. The function of the sensor circuit 381 is to ensure continued actuation of the counter 371 should the window shutter 95 be stuck partially open or closed and to provide an indication that the window is fully opened or closed. This indication is controlled by the fact that when the window shutter 95 is either fully open or closed only a corresponding one of the sensors 383 is activated.

The stepper motor 367 is a low torque device which will "slip" without being damaged by excessive current when the window shutter is stuck such as could occur if an object or finger were obstructing the shutter. The window sensor circuit 381 provides an indication to the MPU via the $\overline{STS}$ signal that the window shutter is either stuck or in the instructed position.

Figure 28:
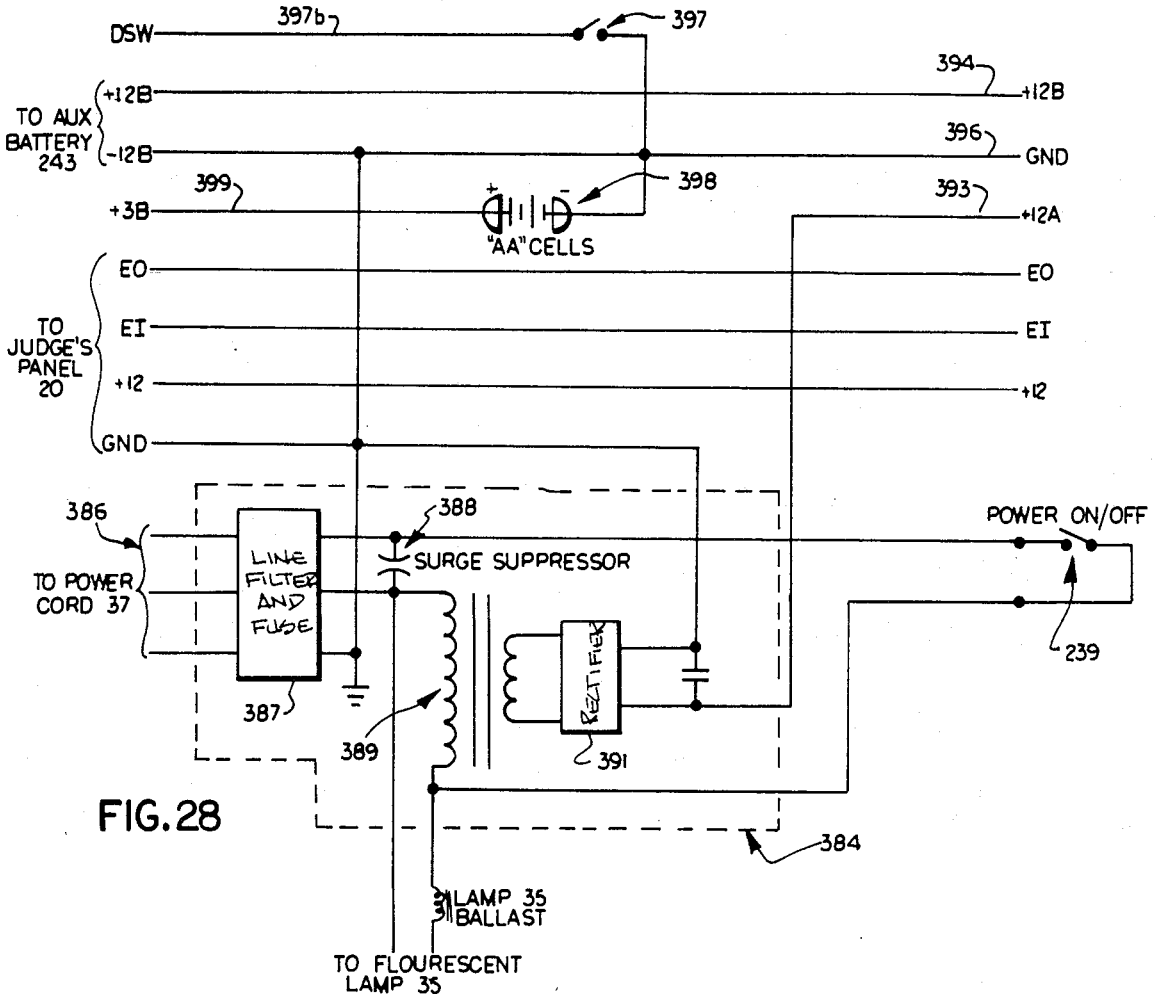
FIG. 28 is a schematic diagram of a power supply module particularly adapted for use with the present invention.

Turning now to FIG. 28, the power supply module 221 includes a circuit 384 for providing main operating power as shown. The power circuit 384 receives standard commercial power at inputs 386 such as from a commercial power wall outlet cord 37 (see FIG. 22). The circuit 384 includes a line filter and fuse element 387, a surge suppressor 388, a step down transformer 389, a full wave rectifier 391 and the series power ON/-OFF switch 239. The transformer 389 steps down the 110 VAC line power to 12 VAC and the rectifier 391 converts this 12 VAC to a 9–16 VDC main operating power supply on line 393 designated "12A". A second +12 VDC line 394 designated "12B" is provided for connection to the (+) terminal of the conventional D.C. battery 243 (see FIG. 22), such as an automobile battery, when commercial power is either unavailable or the voting machine is to be operated remote from a commercial power outlet. The common or ground line 396 is connected to the rectifier 391 low side or the battery (−) terminal (designated '12B). That is, when a battery is used for main operating power it is essentially connected in parallel with the rectifier 391.

A door actuated switch 397 is provided to indicate to a dedicated input 397*a* on the MPU (via line 397*b* designated DSW on the power supply module 221) that the voting machine has been tampered with. When the MPU receives this DSW signal the selected lock number must be re-entered by the custodian to re-energize the voting machine.

A pair of "AA" +3 VDC batteries 398 are connected in series and provide a power source designated "+3B" on line 399. The AA batteries are used to provide a backup +5 volt supply to the TALLY RAM memory chip 257 (FIG. 23) in the event that main operating power is lost.

Figure 29:
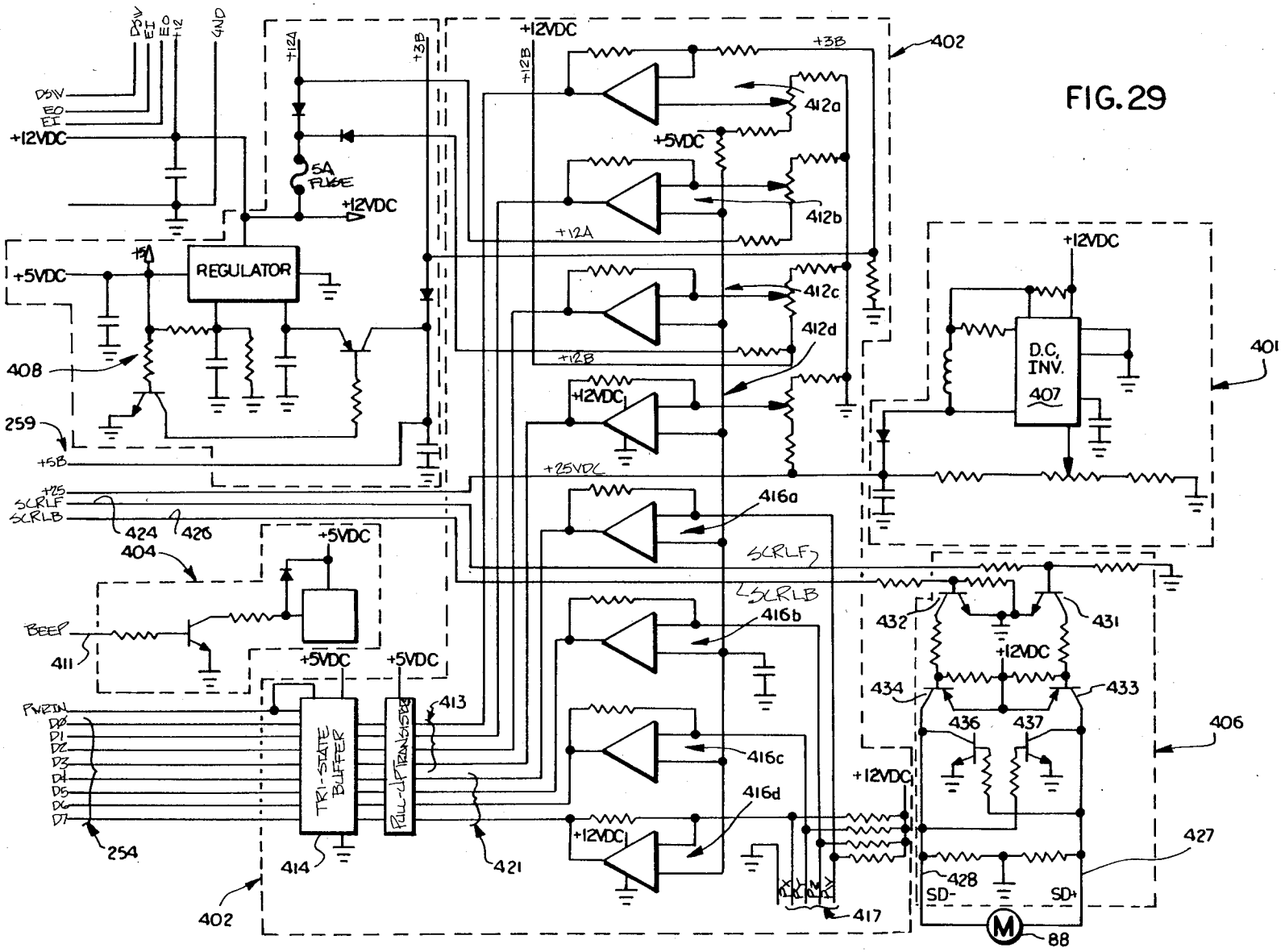
FIG. 29 is a schematic diagram of a power/driver module used in the electronic control system shown in FIGS. 21 and 22.

Turning now to FIG. 29, the power/driver module 214 includes a +25 VDC inverter power supply 401, a monitoring circuit 402, a voltage regulator circuit 403, a beeper circuit 404 and a scroll motor drive control circuit 406.

The +25 volt inverter supply 401 provides the +25 VDC power needed for the writing operation of the EPROM as decribed hereinbefore. The circuit 401 includes an inverting IC 407 and support circuitry which converts the +12 VDC supply from the power supply module 221 (+12A or +12B) to +25 VDC. The IC 407 is preferably model number MC34063 manufactured by Motorola, Semiconductor Products Sector, Pheonix, Ariz. and design of the support circuitry is fully set forth in the manufacturer's specifications.

The regulator circuit 403 includes a +5 V regulator circuit 408 which generates the +5 VDC supply used by the digital logic hardware throughout the electronic control system. Note that the +5B signal 259 (see FIG. 23 also) is supplied either by the regulator circuit 408 or the series connected "AA" batteries (indicated by the signal +3B on line 409) on the power supply module 221.

The audible beeper circuit 404 is of conventional design and is controlled or actuated by a "BEEP" signal on line 411. The "BEEP" signal is controlled by a dedicated output 412 on the MPU 251 (see FIG. 23) according to system software instructions. The "BEEP" circuit is used primarily during the set-up mode but can also be used to alert a voter than an improper selection or request has been made.

The monitoring circuit 402 includes a plurality of op-amp hysteresis-type comparator circuits 412*a, b, c, d* used to monitor the +3B, +12A, +12B and +25 volt power supplies respectively. These comparator circuits generate digital outputs (logic 1 or 0) depending on whether the corresponding power supply is above acceptable low limits. The comparator outputs 413 are parallel connected to the main data buss 254 by a tri-state buffer 414 for scanning by the MPU 251.

Figure 30:
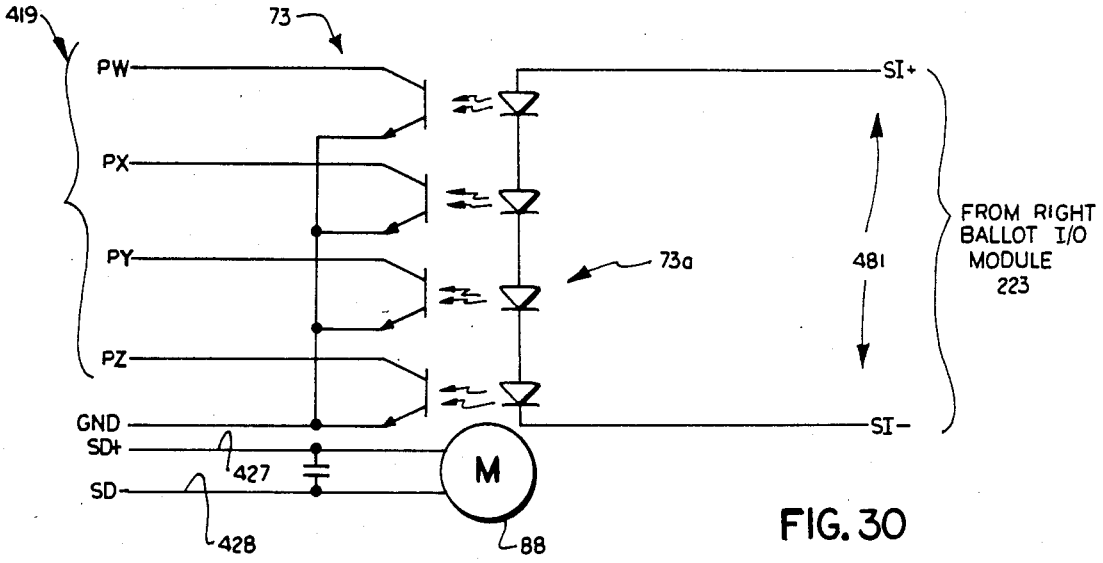
FIG. 30 is a schematic diagram of a scroll page illuminator and sensor optical detector means.

The monitoring circuit 402 also includes a plurality of op-amp comparator circuits 416*a, b, c, d* which monitor the status of the ballot page positioning sensors. The sensors provide voltage inputs 417 to the comparators 416*a, b, c, d* in response to the actual position of the ballot web as described hereinbefore. The sensors or detectors 73 are located on the scroll drive module 218 and are schematically shown in FIG. 30. The detectors generate voltage outputs 419 which are connected respectively to the inputs 417 and are a function of the presence of absence of light from corresponding LED's 419 impinging on their light sensitive areas as described previously herein.

The page sensor comparator outputs 421 are also connected to the main data buss 254 by the buffer 414.

The scroll drive motor control circuit 406 controls power to the bidirectional scroll drive mechanism 80. The MPU 251 has two software controlled dedicated outputs 422, 423 designated SCRLF and SCRLB ("scroll forward" and "scroll back"). These signals are respectively connected to lines 424, 426 on the power/-driver module.

The drive circuit 406 generates either a voltage SD+ signal with respect to ground on output line 427 for scrolling forward or a voltage SD− signal with respect to ground on output line 428 for scrolling back. The SD+ and SD− signals are inputted to the scroll motor 88 shown schematically on FIGS. 29 and 30.

This circuit 406 supplies power used to drive the scroll motor 88. Inputs to this area of circuitry include the plus twelve volt power supply and ground and SCRLF and SCRLB. The output lines 427, 428 will be controlled by the microprocessor 251. SCRLF is brought to a positive logic level or plus five volts to move the scroll in a forward direction. The SCRLB signal is brought to positive five volts to drive the scroll in the reverse direction or backwards. Both lines in the quiescent state will be at zero volts. Zero volts applied to both the lines stops the scroll system.

The two input lines 424, 426 control two switching transistors, respectively, SCRLF corresponds to transistor 431, and SCRLB corresponds to transistor 432. These are general purpose small signal devices and are used to provide a voltage translation effect. In essence on the SCRLF and SCRLB lines a voltage is presented to these transistors of either zero or five volts. It is necessary to adjust this voltage range from zero to twelve volts to operate the scroll drive motor 88. These transistors 431, 432 are used to drive, respectively, a pair of power transistors numbered 433, 434. These power transistors act as switches betwen the motor 88 and the plus twelve volt power supply such that in the event that the SCRLF or the forward direction is indicated, transistor 431 will be in full saturation causing a zero volt level to appear at its collector thus providing a saturating turn on bias of the base emitter junction of the power transistor 433. This will give a positive twelve volts at the collector of transistor 433. Thus, there is a plus twelve volts at the SD+ terminal on line 427 which is connected to the drive motor 88 of the scroll mechanism 80. At the same time this plus twelve volt signal is connected to the base of another transistor 436. This applies a saturating positive bias to the base emitter junction of transistor 436 and results in effectively zero volts appearing at its collector. This provides zero volts at the SD− terminal on line 428 to the scroll drive motor 88. At this point it is apparent that there is plus twelve volts and the zero volts required on the SD+ and SD− lines respectively to drive the motor 88 in the forward direction.

Now in the event of the reverse direction, transistors 433 and 436 will be in their quiescent state, or non-conductive. This will effectively leave line 427 at zero volts. When the MPU activates the SCRLB control line transistor 432 conducts fully thus causing the transistor 434 to conduct fully saturated in a similar manner. This will then cause a plus twleve volts to appear at the SD− terminal on line 428 which is of course the opposite polarity as was presented in the forward direction. Similarly, a transistor 437 is caused to conduct by means of plus twelve volts being applied through a resistor to the base emitter junction of transistors 437 thus causing this transistor to fully conduct and thereby providing zero volts at the SD+ terminal on line 427.

Figure 31:
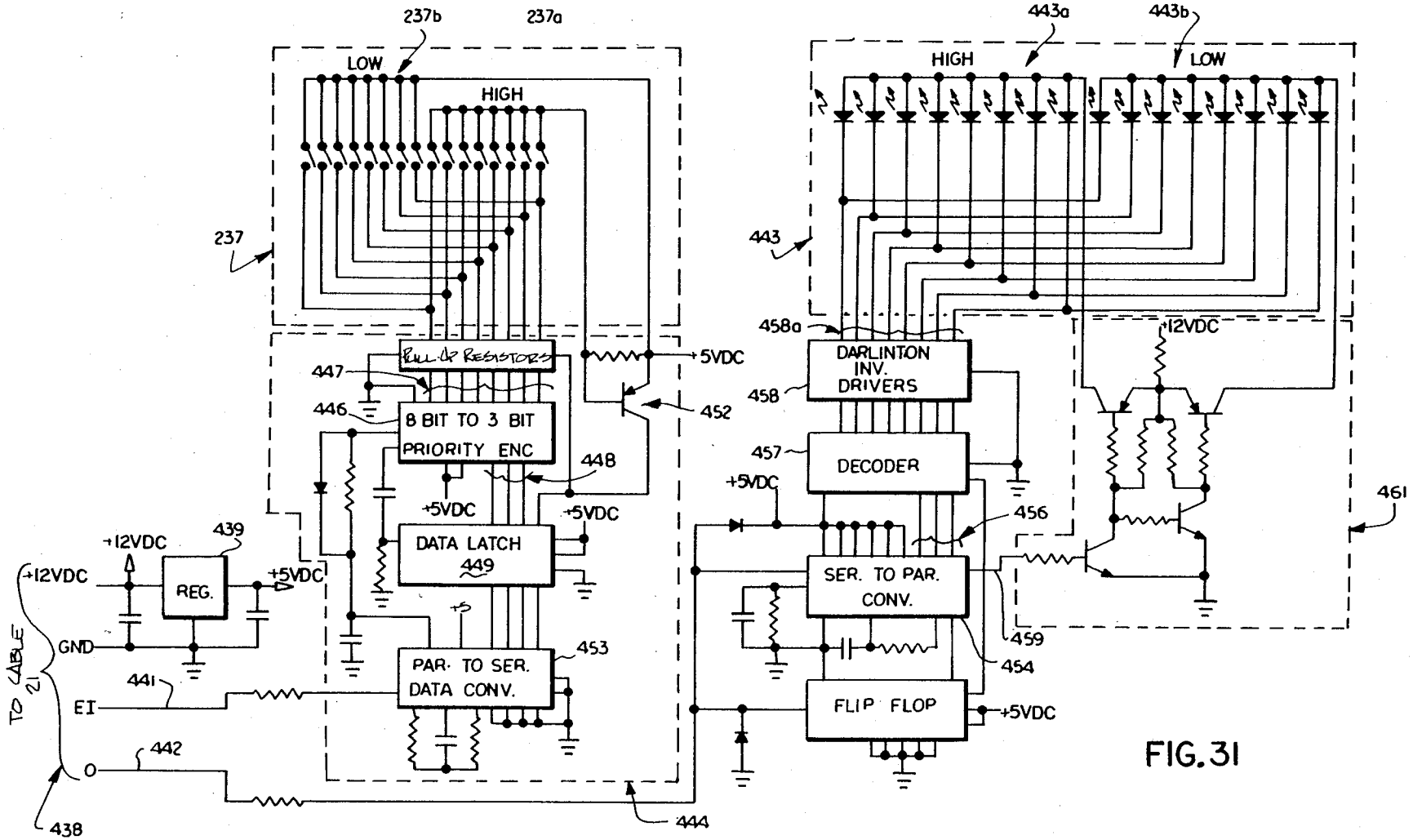
FIG. 31 is a schematic diagram of a judge's panel used for remote programming of the voting machine.

Turning now to FIG. 31 there is shown a circuit schematic for the external selector or judge's panel 20. The judge's panel 20 is used by precinct officials during an election to instruct the main controller 201 as to which ballot format is to be presented to a voter. The judge's panel is also used during the machine set-up mode to program the ballot format into the main controller 201 and also for test purposes during the verification mode. The judge's panel 20 also includes a test button for checking during an election that the ballot light arrays 43, 45, the switch arrays 42, 44, display 50, etc. are functional.

The design of the judge's panel is intended to permit a programming and control function remote from the voting machine 10. Accordingly, the panel 20 is connected to the primary voting machine hardware via the 4-wire cable link 21 (see FIG. 22). The judge's panel 20 includes circuitry for transmitting and receiving data to and from the main controller 201 in accordance with system software. Selections via the judge's panel are made using a plurality of pushbutton switches and associated light indicators.

As illustrated in FIG. 31, the 4-wire cable 21 provides a +12 VDC, ground and signals EI and EO to the judge's panel 20 on inputs 438. A voltage regulator 439 generates a +5 volt power from the +12 volt input. The EI signal line 441 is used for transmitting information to the main controller 201 and the EO signal line 442 is used for receiving data transmissions from the main controller.

A sixteen pushbutton switch array 237 is provided as illustrated. The purpose of the EI signal is to transmit information to the main controller 201 as to which ones of the switches 237 have been actuated. Associated with each switch in the array 237 is a light. Hence, a sixteen light array 443 is illustrated. The purpose of the EO signal from the main controller is to receive information as to which light should be activated thus indicating that a valid button switch 237 was actuated, or that a particular switch 237 should be actuated (as would be the case during the set-up programming mode).

The switches 237 are connected to a transmission circuit 444 which includes an eight line to three line priority encoder 446. The encoder 446 has eight binarily weighted inputs 447 connected to the switch array 237 (two switches per input since there are sixteen switches 237 but only 8 inputs 447) and produces a 3-bit binary code at outputs 448 in direct relation to which one of the switches 237 were activated.

Because there are two switches 237 for every decoder input 447, it is necessary to determine which pushbutton switch has been actuated. First, the sixteen switches are divided into two sets of eight, one set called High order **237*a* and the other set called Low order 237*b*. A latching device 449 receives the decoder output 448 signals and also receives a fourth signal on line 451 from a PNP switch 452. The switch 452 is activated only when one or more of the High order switches 237*a* are activated. Therefore, the fourth input 451 into the latch 449 indicates which set 237*a* or 237*b*** of the array has been activated.

The latch 449 is connected to a parallel-to-serial data converter 453 which transforms the parallel 4-bit encoded data into serial format. The converter 453 when transmits the serialized 4-bit data to the main controller on line 441 (EI). The main controller 201 has associated circuitry designed to reconvert the serialized data back to parallel 4-bit format.

Data transmission from the main controller 201 to the judge's panel 20 is accomplished essentially by a reverse operation. Serialized data information is sent from the main controller to the judge's panel on line 442 (EO). The data is inputted to a serial-to-parallel converter 454 which provides a 4-bit binary output. Specifically, three of the output bits 456 are connected to a 3-line to 8-line decoder 457. The decoder 457 drives a darlington inverter IC 458. The three-bit code 456 determines which light in the array 443 will be activated.

Just as the switch array 237 was divided into a High order side **443*a* and a Low order side 443*b*, so too are the lights in the array 443 because there are two lights 443 for each inverter output 458*a*. The fourth data output bit 459 of the converter 454 is used to distinguish whether the activated light is one of the eight High order or Low order lights. The output 459 is connected to a switching circuit 461 which selects either the High order side 443*a* or Low order side 443*b* as a function of the logic state of the signal on line 459** as transmitted from the main controller.

Figure 32:
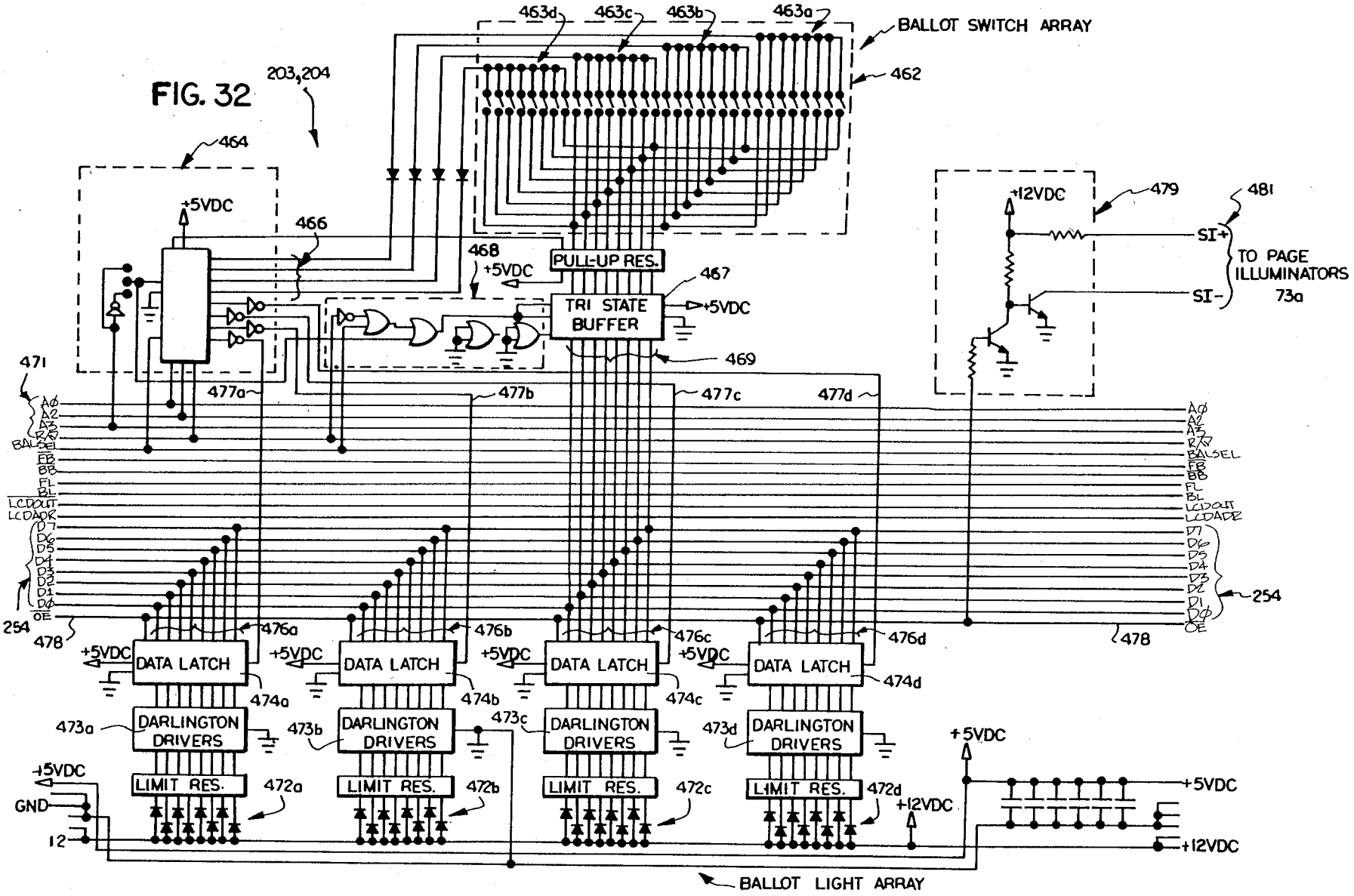
FIG. 32 is a schematic diagram of a ballot I/O circuit used in the voting machine.

Turning now to FIG. 32, there is shown an I/O multiplexing circuit 203, 204 (FIG. 21) which is used both on the Left Ballot I/O Module 222 and the Right Ballot I/O Module 223 respectively. This circuit 203, 204 essentially permits the main controller 201 to sequentially scan the sixty-four ballot selection switches actuated by the ballot buttons in the arrays 44, 42 (thirty-two buttons on the left side of the ballot viewing panel 41 and thirty-two buttons on the right side of the viewing panel 41) to determine whether a ballot button has been actuated. After determining that a ballot button was actuated, system software determines if the selection is valid for the particular voter using the machine. If the selection was valid the main controller 201 causes the associated ballot button lamp in the arrays 43, 45 to be activated.

The left and right ballot I/O modules are also used during the voting machine set-up mode and verification mode to permit the precinct official to program the ballot format into the main controller 201 and run a "test" election to verify that the electronic tallying if functioning properly.

As illustrated, each I/O multiplexing circuit 203, 204 is connected to the corresponding thirty-two switch arrays 42, 44 generally grouped by the number 462 in FIG. 32. Again, since the I/O circuit of FIG. 32 is used on each module 222, 223, the circuit will be described in general terms.

The switches 462 are grouped in 4 sets of 8 switches per set designated 463*a, b, c, d.* Within each set of 8 the switches are connected as illustrated. The high side of each switch set is connected to an address logic decoder circuit 464. The decoder 464 has 4 outputs 466 which respectively drive the common high side of each set of switches 463*a, b, c, d.* The low sides of each switch are connected in common with one other switch from each set 463*a, b, c, d.* That is, the low side of the switches are divided in 8 groups of 4 switches, with each group of 4 switches comprising one switch from each set 463*a, b, c, d.* The low sides are connected to an 8-input logic tri-state inverter buffer 467. The buffer 467 is actuated by a control circuit 468 which decodes the $\overline{\text{BALSEL}}$ and R/$\overline{\text{W}}$ signals as required. The buffer outputs 469 are connected to the main data buss 254 as illustrated.

The just described circuit permits multiplexing of the thirty-two ballot button switches 462 on to only eight available data buss lines 254. By sequentially scanning the decoder outputs 466 via the address inputs 471, the MPU 251 can look at individual sets of 8 switches one at a time. The MPU first scans the left ballot I/O 203, then the right ballot I/O 204 and thereafter sequentially back and forth. The R/W signal controls the point in time when the switch array 462 status is transferred to the data buss 254 since such is only permitted to occur when the MPU 251 is in a Read status. The $\overline{\text{BALSEL}}$ signal and address A3 are used by the MPU to control timing and addressing of the left ballot I/O or the right ballot I/O. The buffer 469, of course, must be a tri-state device because of the multiplexed use of the data buss 254.

Once the MPU 251 and appropriate system software have determined that one or more of the selected ballot button switches 462 are valid, it must activate the associated ballot button light in the arrays 43, 45. The MPU must also be able to activate the ballot lights in the set-up, verification, and light test modes.

This capability is achieved again through multiplexing. The thirty-two ballot lights 43, 45 are grouped in 4 sets of eight lights 472*a, b, c, d* as illustrated for each I/O module. Each group of eight lights 472 is parallel connected to a darlington driver 473*a, b, c, d* respectively. The drivers 473*a, b, c, d* are parallel connected to 8-bit data latches 474*a, b, c, d,* respectively having inputs 476*a, b, c, d,* connected to the main data buss 254 as illustrated.

Each latch 474*a, b, c, d* has an associated latch enable line 477*a, b, c, d,* connected to the address decoder circuit 464. When the MPU 251 determines that a valid switch has been selected it transmits to the decoder circuit 464 an address code 471 to select the correct group of lights 472*a, b, c, d.* The desired button switch information is then momentarily applied to the data buss 254 and latched by the appropriate latch 474*a, b, c, d.* The light which then corresponds to the activated switch is thus actuated.

During the set-up mode, the master controller 201 indicates to the precinct official which of the switches 462 must be activated at certain times. The controller does this by again addressing the correct latch 474*a, b, c, d* via the decoder 464, however, the MPU then directly applies the light selection information on the data buss 254. The information is then latched as before and the ballot light or lights are thus activated.

The latches 474*a, b, c, d* also each have an associated output enable line connected to a main $\overline{\text{OE}}$ signal 478. This $\overline{\text{OE}}$ signal is a primary reset signal used throughout the voting machine during power up. It is determined by system software and generates from a dedicated output on the MPU 251 (see FIG. 23). As it pertains to the latches 474*a, b, c, d* the signal OE prevents any output from the latches until the MPU under software control clears all latches upon power-up.

The $\overline{\text{OE}}$ signal is also used to actuate a ballot page sensor switch circuit 479. The circuit is activated when $\overline{\text{OE}}$ is logic low and has outputs 481 (designated SI+ and SI−) which are connected to the page sensor illuminators 73*a* on the illuminator module 219 (see FIG. 30). The circuit 479 functions to apply +12 volt excitation across the ballot page sensing devices 73*a.*

Figure 33:
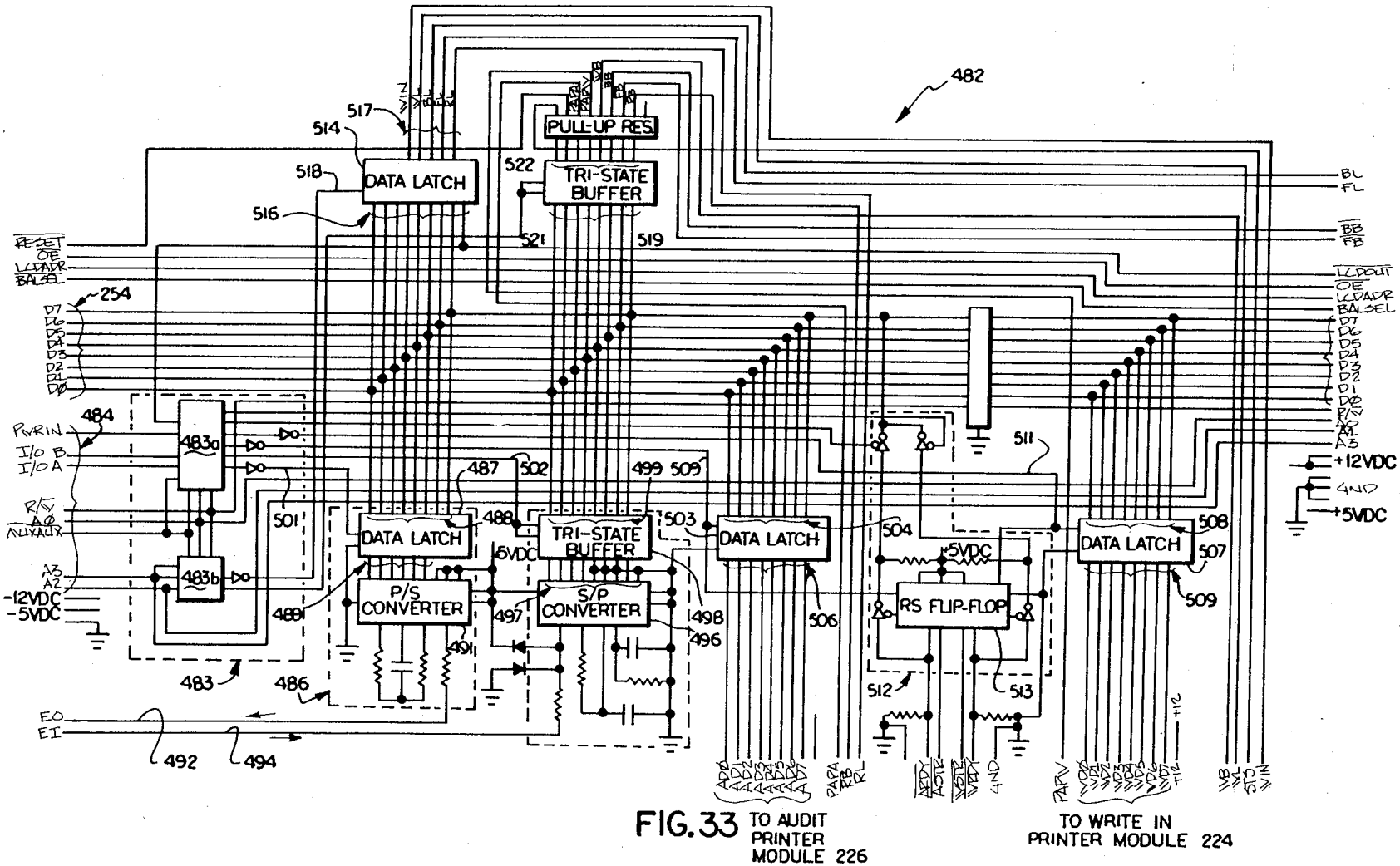
FIG. 33 is a schematic diagram of an interface circuit used in the voting machine.

Referring now to FIG. 33, the interface module 216 includes a multiplexing circuit 482 which permits the main controller 201 to communicate with peripheral circuitry via the main data buss 254. Specifically, the interface circuit 482 multiplexes the data information sent to and from the judge's panel 20, the various auxiliary pushbuttons and associated lamps 46, 47, 49, 48, the write-in window motor control circuit 366, the write-in printer circuit 207 and the audit printer circuit 206.

An address decoder circuit 483 interprets input data 484 from the main controller 201 for determining when specific data is to be transmitted to the MPU 251 via the main data buss 254. The circuit 483 includes a pair of 1-of-8 decoders 483*a, b.*

A data transmitter circuit 486 includes a data latch 487 having inputs 488 connected to the main data buss 254 and outputs 489 connected to a parallel-to-serial data converter 491. The transmitter circuit 486 converts the parallel MPU data information into serial format and transmits it on line 492 (designated EO) to the judge's panel 20 for processing as described above (see FIG. 31).

A receiver circuit 493 essentially functions exactly opposite to the transmitter circuit 486. The receiver accepts transmitted serialized data from the judge's panel 20 on line 494 designated EI. The EI signal is generated by the judge's panel circuitry as described above (see FIG. 1) and is inputted to a serial-to-parallel data converter 496. The converter parallel outputs 497 are connected to a tri-state buffer 498 which has its outputs 499 connected to the main data buss 254. The IC 498 is a buffer, of course, instead of a data latch because the circuit 493 is feeding data to the data buss 254 whereas the circuit 486 is receiving data from the buss 254. The circuits 486, 493 are selectively enabled by output signals from the decoder circuit 483 on lines 501, 502 respectively.

An 8-bit data latch 503 has inputs 504 connected to the main data buss 254 and outputs 506 which are routed via ribbon cable to the audit printer module 226. The latch 503 receives audit printer data signals from the MPU 251 and latches this data to provide reliable input signals to the audit printer circuit 206 for further processing (see FIG. 26).

Another 8-bit data latch 507 has inputs 508 connected to the main data buss 254 and outputs 509 routed via ribbon cable to the write-in printer module 224. The latch 507 receives write-in printer data signals from the MPU 251 and latches this data to provide reliable input signals to the write-in printer circuit 207 for further processing as described above (see FIG. 26).

It will be recalled that FIG. 26 shows a common printer circuit used for both the audit printer 206 and the write-in printer 207. Thus, the data inputs 351 on the audit printer module are connected to the outputs 506 of the data latch 503. For the write-in printer 207, the data inputs 351 are connected to the outputs 509 of the data latch 507.

The data latches 503, 507 are selectively enabled by output signals from the decoder circuit 483 on lines 509, 511 respectively.

It will also be recalled that the audit and write-in printer circuits 206, 207 utilize $\overline{RDY}$ (ready) and $\overline{STR}$ (strobe) signals for timing purposes. For the audit printer these signals are designated $\overline{ASTR}$ and $\overline{ARDY}$ and for the write-in printer the designations are $\overline{WSTR}$ and $\overline{WRDY}$. These signals are generated by a logic decoder circuit 512 based on address signals from the main data buss 254 and outputs from the address decoder circuit 483. The circuit 512 primarily uses a dual RS flip-flop 513 to provide the necessary control signals to the printers.

An 8-bit data latch 514 is used to multiplex instructions from the main controller 201 to activate the auxiliary button lights for the write in button 49, the register button 48, the scroll advance button 47 and the review button 46. Specifically these are the signals WL, RL, FL and BL described earlier. The latch 514 also multiplexes the WIN signal used by the MPU to actuate the window shutter drive circuit 366 on the write-in printer module 224 (see FIG. 27). The latch inputs 516 are connected to the main data buss 254 and the outputs 517 are routed to the appropriate module as described. The latch 514 is enabled by an output signal from the decoder circuit 483 on line 518.

The remaining signals, utilized by the main controller 201 for monitoring the peripherals via the data buss 254, are multiplexed using a tri-state buffer 519. The buffer outputs 521 are connected to the main data buss 254. The inputs 522 are the signals $\overline{WB}$, $\overline{RB}$, $\overline{BB}$, $\overline{FB}$, PAPW, PAPA, $\overline{Reset}$ and $\overline{STS}$ received from the peripheral circuits. It will be recalled that the first four are the pushbutton signals corresponding to actuation of the write-in button 49, vote register button 48, ballot review button 46 and ballot advance button 47. PAPA and PAPW are the paper-out signals for the audit and write-in printer circuits 206, 207. The $\overline{Reset}$ signal is generated by the mode switch to reinitialize the electronic control means as controlled by software. The $\overline{STS}$ signal is used by the master controller 201 for determining the position of the write-in window shutter as described.

The interface module 216 circuitry thus provides a means by which the main controller 201 can sequentially monitor and control various aspects of the peripheral circuitry with only 8 main data bits. As in all microprocessor based systems, the system software is designed to dictate to the MPU 251 the sequences and steps to be followed in monitoring and controlling the electronic voting machine.

The set-up and verification modes of operation will now be described. The system software dictates the sequence of events for programming the voting machine by controlling the MPU 251 and its interface with main controller hardware and peripheral circuitry. The numerous functional features which will now be discussed are accomplished of course by the hardware configuration as fully described hereinabove and reference should again be made to the drawings and related discussions for specific details and embodiments.

The set-up programming is performed, for example, by a precinct official. The voting machine in general has a pre-programmed operational set of instructions but also is programmable in an interactive mode by the election officials. The primary set-up programming functions are: to input to the main controller 201 memory the ballot format for the particular precinct and election, and to program the control functions of the judge's panel 20. The ballot format and judge's panel control program are inputted to the temporary storage SET-UP RAM 258 by interactive operations between the system software and the precinct official. The official interfaces with the main controller via the ballot button arrays 44, 42 on the voting machine viewing panel 40 and the judge's panel button array 237. This is accomplished by the fact that during the set-up mode the system software redefines the button arrays so that actuation thereof does not correspond to a vote cast but rather corresponds to ballot formatting instructions.

After the set-up mode is completed, the verification mode is used to check that the set-up information is correct and also to make changes to correct any errors. This is done by running through a sample election. Thus, during the verification mode the ballot buttons are operative in a vote casting mode. However, the sample election results are not permanently tallied by the system software as this would invalidate the real election.

After the verify mode is completed, the set-up RAM 258 information is permanently stored in the EPROM cartridge 202 as described hereinbefore.

When the voting machine is delivered to a precinct prior to an election, the EPROM cartridge 202 is completely blank. That is, there is no information stored in its memory. When the voting machine is initially powered up, the system software performs initializing and reset operations to clear all lights, memories, latches and so on. In addition, the ballot is moved to page or field one (in the described embodiment it will be recalled there are four available ballot fields selectively presentable via the viewing panel 41). The EPROM cartridge 202 is checked for any stored information. The status of the EPROM is an indication of what operating mode the machine should be in. That is, when the EPROM is determined to be blank, the system automatically goes into the set-up mode since the machine cannot function as a voting apparatus until the set-up information has been inputted.

One or more hardware test modes (system software program phase one) can also be used to check-out circuits such as lights and printer operation before beginning the set-up programming sequence. This is important since it would be a waste of time to go through the set-up programming if there is a bad printer, lights, power supply, battery, memories and so on. The electronic control system is designed to perform as many self-checks as possible to ensure the hardware is good. Reference should again be made to the discussions above as to the hardware configuration which accomplishes the self-check features as controlled by the system software.

The set-up programming phase (phase two) is begun after the self-check phase (phase one) is completed. The set-up programming software includes a series of software loops which are used to program predetermined portions of the machine. These software loops can be entered and exited interactively via the write-in pushbutton 49 and the vote register button 48. During the setup mode these switches are redefined by software to correspond to instructions for entering and exiting the system software loops. Clearly, once set-up and verification are completed, these buttons 49, 48 are again redefined to correspond to a write-in vote instruction and a ballot cast (register) instruction.

Phase two is entered by actuating the vote register button 48. The first loop is used to enter and store the precinct number, date and serial number. The ballot scroll is automatically shifted slightly to one side (leftwards in the preferred embodiment) to expose the vertical strip chart which otherwise is not presented with the ballot page one. The ballot buttons which correspond to the strip chart legend are used first to enter the precinct number and visual feedback is provided to the operator via the LCD display. When the information is correct, the write-in button 49 is actuated and this causes the main controller 201 to store the precinct number in a SET-UP RAM 258 memory location. In a similar manner the date and serial number of the voting machine are inputted and stored.

After the serial number is stored, a single actuation of the write-in button 49 returns the program to the beginning of this first loop. A successive actuation of the write-in button 49 permits changes or updates to be made within this loop since the static ram memory can be changed. When the data has been corrected the loop is exited by actuating the vote register button 48 and the next set-up loop is entered. The LCD display is used to tell the operator what loop is currently operating.

The next software loop in phase two of the setup programming mode is to input the ballot format. This includes defining to the machine the office markers which are used to identify which ballot buttons are associated with a particular office i.e. where on the ballot page an office starts sequentially. The office markers can be thought of as defining field to the machine which group associated ballot button. That is, one field (presidential) groups all ballot buttons associated with the presidential nominees and so on. These fields are defined by actuating the appropriate buttons. Also defined to the machine at this time is how many votes per office are permitted. For example, when voting for president only one vote is permitted from three or four candidates (Republican, Democrat and Independent). But when voting for a board, council or representatives it may be necessary for the voter to select, for example, three names from ten candidates. The procedure of defining the office markers and number of permissible votes per office is then followed for ballot fields two, three and four.

Actuation of the write-in button stores the ballot format information in the SET-UP RAM 258 and exits the office marker software loop. At this time other loops can be used to define secret primary ballots and ballot buttons which are used for voting straight party tickets. Again, these ballot formats are defined by actuating the appropriate ballot buttons. Another software loop can be used to define which ballot buttons will be associated with write-in selections. For example, a write-in option must be available within the presidential selection field but for issues such as tax levies, the only available vote options would be "For" or "Against". Thus, when a voter wants to write-in a selection he must first activate the write-in ballot button for the office of interest and then he must activate the write-in window button 49 to open the shutter window 95. Actuation of the appropriate write-in ballot button instructs the machine as to which office the write-in selection is intended for and the machine prints this ballot button number on the write-in printer tape before opening the shutter.

As before, each ballot formatting loop is exited (and the inputted data stored in RAM) by actuating the write-in button 49. When the final loop is completed the machine will cycle back again to permit changes as described hereinbefore. If the information is correct the operator actuates the vote register button which exits phase two of the set-up programming procedure and begins phase three.

Phase three of the set-up programming sequence includes defining to the machine the function of the pushbutton switches on the judge's panel 20. Each button defines what is referred to herein as either an activation mask or a slate mask. In the disclosed embodiment there are sixteen buttons on the judge's panel and hence fifteen available masks plus one test button. The activation masks define to the machine which ballot fields and ballot buttons are valid options for the current voter. The slate masks are used to define which ballot buttons are associated with a single party. This programming at the judge's panel makes possible an interactive or real-time program modification by an election official during the actual voting process. For example, during a primary, a Republican can only vote for Republican candidates. One of the judge's panel buttons will define to the machine a slate mask which only activates for that voter the Republican ballot buttons (and any other valid options on other issues).

The activation masks are programmed during the set-up mode in much the same way that the office marker fields are defined. The appropriate light emitting diode indicator on the judge's panel 20 is activated. Then all ballot buttons in the arrays 44, 42, which are to be activated (i.e. available selections to the voter) when that particular judge's panel button is used, are then actuated.

Again, actuating the write-in button at this time stores the information for each activation mask in RAM and causes the software to enter the next routine to program the next activation mask. When all activation masks are defined the vote register button is pressed and the activation mask loop is exited and the slate mask loop is entered. A slate mask allows activation of only single-party related ballot buttons. Again, these are defined by actuating all ballot buttons associated with the particular political party being programmed at that time. Also, actuating the write-in button stores the loop information in RAM and actuating the vote register button now exits the set-up programming phase three.

Phase four of the set-up mode permits a print out of all the programmed set-up information to be obtained via the write-in printer. This provides a hard copy detailed description of exactly how the machine was formatted for the ballots and election. The set-up information on the write-in printer tape therefore can be used to audit the election results.

After the set-up information is printed out the verification mode is begun by actuating the Reset switch. In the verify mode a test voting sequence can be performed to ensure that the ballot formatting information is correct and that the electronic tallying is functioning properly. All the votes cast during the verification mode are automatically invalidated so as not to affect the actual election returns.

The verification mode permits the machine to operate just as it would during the election. However, the ballot buttons when pressed during the verify mode cause an audible beep so that the election official knows the machine is not in an election vote mode. Also, the LCD display is fully operational during the set-up, verify and election modes of operation to provide real-time feedback to the operator or voter as to what to do next, or why something is not working, or diagnostics for helping to isolate problems. Operation of the judge's panel control functions can also be made during the verification mode.

After the verify mode is completed the register vote button 48 is actuated and all the set-up information in the SET-UP RAM 258 is transferred permanently to the EPROM cartridge 202. During the election, ballot format information and control will be maintained based on the EPROM contents, not the SET-UP RAM. After the information has been transferred system software runs a check to make certain that the data stored in the EPROM matches the SET-UP RAM information.

After the EPROM is checked out as accurate the set-up information is printed out in addition to the test information on both the audit trail printer tape and write-in printer tape. After the election is run the final tally information is also stored in the EPROM and the final four sets of voter data (the random audit trail selection of the last four voter results stored in RAM as described hereinbefore) is transferred to the audit printer. It will be recalled that in addition to the precinct number, data and machine serial number, which all tie the printers, EPROM and machine together for audit purposes, the EPROM also contains the random number selected to and only known to the machine to prevent switching EPROMS after the machine has been readied for the election.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A portable, self-contained electronic voting machine for use by a voter in casting a vote in an election, said voting machine comprising:

a motor-driven mechanism for carrying printed ballots having voter selections indicated thereon, the mechanism visually presenting to the voter only a preselected portion of the printed ballots at any one time;

a plurality of switch means fixed in position relative to the mechanism, the switch means being positioned next to all voter selections on the preselected portion of the printed ballots then being viewed by the voter, the voter actuating selected ones of the switch means to make vote selections; and programmable electronic control means for actuating the motor-driven mechanism and for recording the vote selections indicated by said actuated selected ones of the switch means.

2. An electronic voting machine according to claim 1, wherein said printed ballots are constituted by a plurality of separate sheets.

3. An electronic voting machine according to claim 2, wherein said motor-driven mechanism includes an elongated movable web supporting the said plurality of sheets along its length, said web moving portions of said sheets into and out of the view of the voter.

4. An electronic voting machine according to claim 1, including printed programming indicators carried by said mechanism, said printed programming indicators being positioned next to a portion of said plurality of switch means only when said voting machine is in a programming mode, said portion of said plurality of switch means being viewed by and actuated by a non-voter to program said electronic control means prior to an election, said programming indicators not being viewable by a voter during an election wherein said portion of said plurality of switch means can be actuated by the voter to make said vote selections.

5. A portable, self-contained electronic voting machine for use by a voter in casting a vote in an election, said voting machine comprising:

a motor-driven scroll mechanism for carrying a plurality of printed ballot sheets having voter selections indicated thereon, the scroll mechanism visually presenting to the voter only a preselected portion of the ballot sheets at any one time;

a plurality of push-button type switches fixed in position relative to the scroll mechanism, one said push-button type switch being positioned next to each corresponding one of the voter selections indicated on the preselected portion of the printed ballot sheets then being viewed by the voter, the voter actuating selected ones of the switches to make vote selections; and programmable electronic control means for actuating the scroll mechanism and for recording the vote selections indicated by said actuated selected ones of the switches.

6. An electronic voting machine according to claim 5, wherein said electronic control means actuates the scroll mechanism to visually present to the voter another preselected portion of the ballot sheets wherein the voter again actuates selected ones of said switches to make voter selections corresponding to said another preselected portion of the ballot sheets then presented by the scroll mechanism.

7. An electronic voting machine according to claim 6, including scrolling switch means actuated by the voter to cause said electronic control means to actuate the scroll mechanism to visually present each of said preselected portions to the voter.

8. An electronic voting machine according to claim 7, including remote switch means actuated by a non-voter to cause the said electronic control means to visually present less than all of the said preselected portions to the voter in response to actuation of the scrolling switch means by the voter so as to preclude a voter from viewing all portions of said plurality of printed ballot sheets.

9. An electronic voting machine according to claim 5, wherein the motor-driven scroll mechanism includes a pair of spaced apart, juxtaposed rollers rotatable on parallel axes, and a flexible ballot-carrying elongated web extending between the rollers, the web being wound onto one roller when both rollers simultaneously rotate at the same general rate in a clockwise direction, the web being wound onto the other roller when both rollers simultaneously rotate at the same general rate in a counterclockwise direction, said plurality of ballot sheets being carried on said web, only the portion of the ballot sheets carried on that portion of the web then extending between the rollers being viewable by the voter.

10. An electronic voting machine according to claim 9, including means for maintaining in tension any portion of the web extending between the said rollers.

11. An electronic voting machine according to claim 9, wherein said web includes transparent pocket portions into which said ballot sheets are inserted for viewing by the voter, said ballot sheets being paper and having printed matter thereon constituting said voter selections.

12. An electronic voting machine according to claim 9, including detector means fixed in relation to the scroll mechanism and located adjacent to an edge of the elongated web, said web carrying on said edge a plurality of detectable indicia for identifying that portion of the web extending between the rollers at any given time, said detector means detecting said indicia and providing to said electronic control means a signal indicative of said indicia wherein said electronic control means in response to said signal actuates said scroll mechanism to present said preselected portions of said ballot sheets.

13. An electronic voting machine according to claim 12, wherein said detector means is an optical detector means and said detectable indicia are optically detectable indicia.

14. An electronic voting machine according to claim 12, wherein said indicia also indicates the position, relative to the detector means, of the identified web portion extending between the rollers at any given time.

15. An electronic voting machine according to claim 5, including a write-in window mechanism fixed in position relative to the scroll mechanism, said write-in window mechanism including a paper tape unwound from a supply roll onto a takeup roll, only a portion of the paper tape extending between the supply roll and the takeup roll at any given time being exposable and accessible to the voter via an aperture wherein the voter can write on said portion of the paper tape a write-in vote selection, said write-in window mechanism further including a movable motor-driven shutter for opening and closing said aperture to permit or preclude access to said portion of the paper tape, opening and closing movement of said motor-driven shutter being regulated by said electronic control means.

16. An electronic voting machine according to claim 15, wherein said shutter is driven by a linear stepper motor, said shutter linearly moving back and forth across the aperture.

17. An electronic voting machine according to claim 15, wherein said write-in window mechanism includes means for providing to said electronic control means a signal indicative of the position of said shutter relative to said aperture.

18. An electronic voting machine according to claim 17, wherein said means for providing is a pair of optical detectors, one optical detector sensing the position of said shutter when it fully closes said aperture, the other optical detector sensing the position of said shutter when it fully opens said aperture.

19. An electronic voting machine according to claim 15, including paper drive means for moving the paper tape by unwinding said tape from said supply roll and by winding said tape onto said takeup roll wherein a plurality of exposable and accessible portions of said tape are sequentially presented to the voter or voters via said aperture when opened and closed a plurality of times by said movable motor-driven shutter, wherein all write-in vote selections are sequentially recorded on that portion of the paper tape wound onto the takeup roll during an election.

20. An electronic voting machine according to claim 19, wherein said paper drive means is a portion of a printer mechanism, said printer mechanism printing on said paper tape identifying data for tallying each write-in vote recorded thereon.

21. A portable, self-contained electronic voting machine for use by a voter in casting a vote in an election, said voting machine comprising:

a boxlike housing having a bottom, four sidewalls, and an open top end;

a control panel for closing the open top end of the boxlike housing, the control panel having a transparent portion to permit the voter to view printed ballots positioned below the transparent portion of the control panel, said transparent portion and the remainder of the control panel precluding direct access to the ballots by the voter;

a motor-driven scroll mechanism for carrying the printed ballots, the printed ballots having voter selections indicated thereon, the scroll mechanism being positioned below said transparent portion of the control panel and being completely contained within said boxlike housing, said scroll mechanism visually presenting to the voter only a preselected portion of the ballots at any one time;

a plurality of switch means fixed in position on said control panel and located adjacent to opposite edges of said transparent portion via which the voter views said preselected portion of the ballots, the switch means being positioned next to all voter selections on the preselected portion of the ballots then being viewed by the voter, the voter actuating selected ones of the switch means to make voter selections; and programmable electronic control means for actuating the scroll mechanism and for recording the vote selections indicated by said actuated selected ones of the switch means.

22. An electronic voting machine according to claim 21, wherein said transparent portion and said switch means are parts of a window panel assembly forming a part of said control panel, said window panel assembly being hinge mounted to the remainder of said control panel to permit the window panel assembly to be upwardly raised from a closed position and pivot about a hinge axis to permit access to said underlying scroll mechanism so that said printed ballots can be replaced with other printed ballots.

23. An electronic voting machine according to claim 22, including means to lock the said window panel assembly at its said closed position.

24. An electronic voting machine according to claim 22, wherein said printed ballots and said other printed ballots are constituted by a plurality of separate paper sheets only some of which are visually presented to the voter via the transparent portion of the control panel at any given time.

25. An electronic voting machine according to claim 21, wherein the transparent portion is rectangular and the switch means are constituted by a single column of push-button switches extending along one edge of the rectangular transparent portion and by another single column of push-button switches extending along an opposite edge of the rectangular transparent portion.

26. In a scroll mechanism having a pair of spaced apart, juxtaposed rollers rotatable on parallel axes and a flexible, elongated web having a tensioned portion extending between the rollers, the web being wound on to one roller when both rollers simultaneously rotate at the same general rate, the web being wound on to the other roller when both rollers simultaneously rotate at the same general rate, an improved drive mechanism for simultaneously rotating said rollers and for maintaining said extending portion in generally constant tension comprising:

electric motor means mechanically connected to both of the rollers, said motor means when energized simultaneously rotating said rollers at the same general rate; and a spring means mounted on at least one of said rollers and rotatable with it, said spring means being wound to a predetermined fixed degree to apply to a portion of said one roller a generally constant torsion force tending to rotate said one roller portion on its axis of rotation in a direction that will apply a generally constant tension force to said extending web portion as both of said rollers simultaneously rotate, said tension force being generally independent of the force required to simultaneously rotate said rollers by means of said electric motor means.

27. An improved drive mechanism according to claim 26, wherein said one roller includes a rotatable spindle rotatably driven on said axis of rotation by the said motor means; and a scroll drum constituting said portion of said one roller, said scroll drum being rotatably mounted for rotation on said axis of rotation on which said spindle rotates, said spring means being mechanically connected between said spindle and said scroll drum wherein the rotational force applied to the spindle by the motor means is applied to rotatably drive the scroll drum primarily via the spring means wherein the spindle, the spring means, and the scroll drum rotate together as a unit.

28. In a scroll mechanism having a pair of spaced apart, juxtaposed rollers rotatable on parallel axes and a flexible, elongated web having a tensioned portion extending between the rollers, the web being wound on to one roller when both rollers simultaneously rotate at the same general rate in a clockwise direction, the web being wound onto the other roller when both rollers simultaneously rotate at the same general rate in a counterclockwise direction, an improved drive mechanism for simultaneously rotating said rollers and for maintaining said extending portion in generally constant tension comprising:

an electric motor having a rotatable drive shaft, the electric motor being energizable to rotate the drive shaft in either a clockwise or counterclockwise direction;

an endless drive belt means looped over the juxtaposed ends of both rollers and engageable with the said electric motor drive shaft wherein the rotational forces provided by the drive shaft are transmitted via the drive belt means to both of said rollers to simultaneously rotate them, one of said rollers including an elongated spindle rotatably driven by said endless belt means, a scroll drum rotatable on the axis of rotation of the spindle, and a prewound torsion spring connected between the spindle and scroll drum, the scroll drum being rotatably driven solely via the prewound torsion spring connected to the spindle driven by the motor means, said torsion spring providing a torsion force to cause relative rotation between said scroll drum and said spindle, said tensioned portion of the web extending between the rollers maintaining said spindle and said scroll drum in position relative to each other against said torsion force as said rollers simultaneously rotate in either a clockwise or counterclockwise direction.

29. An improved drive mechanism according to claim 28, wherein said torsion spring is elongated and is formed of wire helically wound about a length of said spindle to provide equal diameter turns adjacent to each other, one end of the elongated torsion spring being fixed to the spindle, the other end of the torsion spring being fixed to the scroll drum.

30. An improved drive mechanism according to claim 29, wherein said endless belt means is a toothed timing belt engageable with and positively driving a first driven toothed pulley fixed to the end of said rotatable spindle and a second driven toothed pulley fixed to the end of the other of said rotatable rollers, said motor drive shaft having mounted on it a toothed drive pulley engageable with and positively driving the endless timing belt.

31. An improved drive mechanism according to claim 30, including an idler roller engageable with said belt at all times and applying to a belt portion between said toothed drive pulley and said second or first driven pulleys a force tending to hold said belt against the said pulleys wherein said belt is placed in tension by said idler roller.

32. An improved drive mechanism according to claim 29, wherein said scroll drum is rotatably mounted on and supported by said spindle.

33. An improved drive mechanism according to claim 29, wherein the other of said rollers includes another spindle, and another scroll drum fixedly mounted thereon, both the said another spindle and the said another scroll drum being mounted for rotation on a common axis the said another scroll drum being directly rotatably driven by the endless drive belt means said second driven toothed pulley being fixed to the end of the said another scroll drum.

34. A web handling mechanism for feeding to a device, such as a printer, and then taking up from it, a web material, such as a paper tape, transferred via the device from a supply roll rotatably supported by the mechanism to a take-up roll also rotatably supported by the mechanism comprising:

a supply roll support means;

a supply spool mounted on said supply roll support means and rotatable on a first axis of rotation;

a take-up roll support means;

a take-up spool mounted on said take-up roll support means and rotatable on a second axis of rotation spaced from and parallel to said first axis of rotation; and an endless drive belt looped over one end of the supply spool and over one end of the take-up spool, said belt extending between and frictionally engaging the spool ends wherein rotation of the supply spool causes, via the belt, simultaneous rotation of the take-up spool, that end of the supply spool engaged by the belt being of a diameter greater than the diameter of that end of the take-up spool engaged by the belt wherein the take-up spool can rotate at a rate greater than the rotation rate of the supply spool, the ratio of take-up spool rotation rate to the supply spool rotation rate being fixed until a drag force on the said take-up spool or the supply spool causes said belt to slip on one or both of said spool ends wherein said ratio varies.

35. A web handling mechanism according to claim 34, wherein said fixed ratio is at least 2:1.

36. A web handling mechanism according to claim 34, wherein said supply roll support means and said take-up roll support means are separate members hinge mounted to each other at a pin joint location, said roll support means being pivotally movable relative to each other with the said axes of rotation being spaced a fixed distance from each other for all relative positions between said supply roll support means and said take-up roll support means, wherein said belt is maintained in generally constant tension.

37. A web handling mechanism according to claim 36, wherein said pin joint location is located at a point on said first axis of rotation upon which said supply spool rotates, said take-up spool being revolvable at least in part about said first axis of rotation.

38. A web handling mechanism for feeding to a device, such as a printer, and then taking up from it, a web material, such as paper tape, transferred via the device from a supply roll rotatably supported by the mechanism to a take-up roll also rotatably supported by the mechanism comprising:

a first elongated bracket having one end pivotally mounted at a location fixed in position relative to said device, said first elongated bracket being pivotally movable, in a plane, about said fixed location;

a first elongated spindle for rotatably supporting one of said rolls, said first spindle being mounted to the other end of said first elongated bracket and extending perpendicularly from the first bracket in a first direction;

a second elongated bracket pivotally mounted to the said other end of the first elongated bracket from which said first spindle perpendicularly extends, said second elongated bracket being pivotally movable, in said plane, about said other end of the first elongated bracket; and a second elongated spindle for rotatably supporting the other of said rolls, said second spindle being mounted to the other end of the second bracket and extending perpendicularly from the second bracket in said first direction.

39. A web handling mechanism according to claim 38, wherein said second spindle is pivotally movable to a position between the first spindle and the said fixed location, the spindles then lying in a generally common plane and both spindles being at least in part simultaneously revolvable about said fixed location.

40. A web handling mechanism according to claim 38, including a supply roll support spool rotatably supported by said first spindle, a supply spool pulley fixed to that end of the supply spool adjacent to the first bracket, the supply spool pulley being rotatable on the longitudinal axis of the first spindle, a take-up roll support spool rotatably supported by said second spindle, a take-up spool pulley fixed to that end of the take-up spool adjacent to the second bracket, the take-up spool pulley being rotatable on the longitudinal axis of the second spindle, and an endless drive belt extending in tension between said pulleys and being looped over them for driving engagement wherein rotation of one of said pulleys causes, via said belt, simultaneous rotation of the other of said pulleys.

41. A web handling mechanism according to claim 40, wherein said second bracket member pivots about the longitudinal axis of the first spindle wherein the axis of rotation of the supply spool pulley is spaced a fixed distance from the axis of rotation of the take-up spool pulley so that generally constant tension of said belt is maintained regardless of the position of said pivotally mounted brackets relative to each other.

42. A web handling mechanism according to claim 40, wherein said pulleys are of different diameters to provide a faster rate of rotation of one spool relative to the rate of rotation of the other spool.

43. A web handling mechanism according to claim 42, wherein said belt can slip on either or both of said pulleys when a predetermined drag force is applied to either or both of said spools so that due to such slippage the ratio of the rate of supply spool rotation to take-up spool rotation can vary.

44. A web handling mechanism according to claim 43, wherein said supply roll is mounted on said supply spool and said take-up roll is mounted on said take-up spool, said device engaging the web material extending between the supply roll and the take-up roll, the device pulling the web material from the supply roll to rotationally drive the supply spool pulley which in turn, via said belt, rotationally drives the take-up spool pulley.

* * * * *

UNITED STATES PATENT AND TRADEMARK OFFICE

CERTIFICATE OF CORRECTION

PATENT NO. : 4,649,264

DATED : March 10, 1987

INVENTOR(S) : William H. Carson

It is certified that error appears in the above-identified patent and that said Letters Patent is hereby corrected as shown below:

Column 3, line 42, change "Printed" to --printed--.

Column 4, line 3, change "inyention" to --invention--.

Column 17, line 17, change "locat.de" to --located--.

Column 24, line 17, change "d:scussed" to --discussed--;

line 18, after "figures", insert --.--.

Column 33, line 51, after "Data", insert --of--.

Column 43, line 24, change "(designated '12B)." to --(designated -12B).--.

Signed and Sealed this

Twenty-seventh Day of October, 1987

*Attest:*

*Attesting Officer*

DONALD J. QUIGG

*Commissioner of Patents and Trademarks*